US006298778B1

(12) United States Patent
Onodera et al.

(10) Patent No.: US 6,298,778 B1
(45) Date of Patent: Oct. 9, 2001

(54) SHEET FEEDING DEVICE FOR A PRINTER

(75) Inventors: Takayuki Onodera; Hideki Asai, both of Miyagi (JP)

(73) Assignee: Tohoku Ricoh Co., Ltd., Shibata-gun (JP)

( * ) Notice: Subject to any disclaimer, the term of this patent is extended or adjusted under 35 U.S.C. 154(b) by 0 days.

(21) Appl. No.: 09/432,222

(22) Filed: Nov. 3, 1999

(30) Foreign Application Priority Data

Nov. 10, 1998 (JP) ..... 10-319378

(51) Int. Cl.[7] ..... B41F 13/24; B41F 5/00; B41L 13/04; B65H 1/00; B65H 5/34

(52) U.S. Cl. ..... 101/232; 101/216; 101/116; 101/118; 271/10.05; 271/10.12; 271/10.13; 271/161; 271/270

(58) Field of Search ..... 101/116–118, 216, 101/232; 271/4.1, 4.03, 9.01, 9.06, 9.09, 9.13, 10.03, 10.05, 10.11–10.13, 110, 111, 114, 161, 259, 265.02, 270; 400/605, 624, 625

(56) References Cited

U.S. PATENT DOCUMENTS

| | | | | |
|---|---|---|---|---|
| 5,415,387 | * | 5/1995 | Suzuki | 271/10 |
| 6,095,040 | * | 8/2000 | Ashikagaya et al. | 101/120 |
| 6,098,536 | * | 8/2000 | Ohkawa | 101/118 |

FOREIGN PATENT DOCUMENTS

| | | |
|---|---|---|
| 2-265825 | 10/1990 | (JP) . |
| 5-124737 | 5/1993 | (JP) . |
| 5-18342 | 5/1993 | (JP) . |
| 5-32296 | 5/1993 | (JP) . |
| 5-221536 | 8/1993 | (JP) . |
| 6-40137 | 2/1994 | (JP) . |
| 6-144600 | 5/1994 | (JP) . |
| 7-137851 | 5/1995 | (JP) . |
| 8-59031 | 3/1996 | (JP) . |
| 9-30714 | 2/1997 | (JP) . |
| 9-216448 | 8/1997 | (JP) . |
| 10-35911 | 2/1998 | (JP) . |

* cited by examiner

*Primary Examiner*—Kimberly L. Asher
(74) *Attorney, Agent, or Firm*—Oblon, Spivak, McClelland, Maier & Neustadt, P.C.

(57) ABSTRACT

A sheet feeding device for a printer, e.g., a stencil printer including an ink drum with a master wrapped therearound and a press drum one of which is pressed against the other during printing is disclosed. The sheet feeding device is capable of feeding a sheet at a preselected speed without regard to a print speed varying every moment due to various factors particular to an ink drum driveline, i.e., whether a set print speed is higher than a standard print speed or lower than the same. This successfully obviates the short loop of a sheet which would result in a skew or a feed failure. In addition, the device reduces noise at print speeds lower than the standard print speed and used more often than the other print speeds.

27 Claims, 35 Drawing Sheets

PRESS DRUM POSITION OF 194°

INK DRUM POSITION OF 0°

| Fig. 19A |
| --- |
| Fig. 19B |

| Fig. 30A |
| --- |
| Fig. 30B |

SHEET FEEDING DEVICE FOR A PRINTER

BACKGROUND OF THE INVENTION

The present invention relates to a sheet feeding device for a printer, particularly a stencil printer including an ink drum with a master wrapped therearound and a press drum one of which is pressed against the other during printing.

A thermal digital stencil printer or similar printer extensively used today includes an ink drum capable of rotating at a variable speed in accordance with an input print speed with a master wrapped therearound. A press roller, or pressing means, is pressed against the ink drum relatively to the ink drum with the intermediary of a sheet. A pair of registration rollers, or registering means, feed the leading edge of a sheet toward a print position between the ink drum and the press roller. A pair of separation rollers and a pickup roller, or sheet feeding means, pay out the leading edge of a sheet toward the registration rollers. The sheet abuts against the registration rollers and forms a loop. Japanese Patent Laid-Open Publication No. 8-59031, for example, discloses a sheet feeding device applicable to the above printer.

Japanese Patent Laid-Open Publication No. 6-40137, for example, teaches a sheet feeding device applicable to a stencil printer of the type including a sheet bank in addition to the ink drum, press roller, registration rollers, and sheet feeding means. The sheet bank is positioned below the print position for feeding a sheet toward the registration rollers. A pair of intermediate rollers, or sheet conveying means, convey the leading edge of a sheet paid out from the sheet bank and cause it to abut against the registration in rollers and form a loop. This sheet feeding device includes a plurality of trays loaded with sheets and allows the operator to pull out desired one of the trays for replenishing sheets, standing at the front of the printer (front loading system).

In any one of the conventional printers, a main motor capable of rotating at a variable speed in accordance with the input print speed drives the ink drum. Specifically, a print speed key, or print speed setting means, is positioned on, e.g., an operation panel for allowing the operator to input desired one of a plurality of print speeds. At the time of printing, the rotation speed of the ink drum is varied in accordance with the print speed input on the print speed key (set print speed hereinafter).

The press roller may be replaced with a press drum having substantially the same diameter as the ink drum and including a sheet clamper. The press drum is rotatable at substantially the same peripheral speed as the ink drum in the opposite direction to the ink drum with the sheet damper retaining the leading edge of a sheet, so that the leading edge of the sheet can be forcibly separated from the ink drum. With the press drum, it is possible to prevent the sheet from rolling up without being separated from the ink drum, to reduce noise, and to enhance the positional accuracy of an image on a sheet in the direction of sheet conveyance (registration accuracy hereinafter).

In the printer taught in the above Laid-Open Publication No. 8-59031, the main motor drives the separation rollers and pickup roller via a belt, gears and clutches or cams. This kind of driveline is undesirable because the peripheral speed of the separation rollers and that of the pickup roller are dependent on a print speed varying every moment in accordance with the set print speed or, e.g., the extension of the belt due to aging, backlashes of the gears, and so forth. As a result, the amount of the loop varies from one print speed to another print speed. It follows that particularly when the print speed is low, the slip of the sheet on the separation rollers and pickup roller is aggravated, making the amount of feed short. The short amount of feed causes the sheet to skew or prevents it from being fed. Further, when the print speed is high, the sheet produces noise when straightened, i.e., when its loop disappears because the lower separation roller does not rotate and increases the load on sheet conveyance.

On the other hand, in the printer proposed in Laid-Open Publication No. 6-40137, the trays of the sheet bank each are provided with a respective separation roller, a pickup roller and other rollers for conveyance. A sheet feed motor implemented by a stepping motor drives such rollers of the sheet bank. The sheet feed motor is so controlled as to increase the sheet conveying speed of, e.g., the separation roller by 0% to 25% in accordance with five consecutive print speeds by way of example, taking account of, e.g., the slip of a sheet being conveyed toward the registration rollers. However, when the sheet conveying speed of, e.g., the separation roller is simply increased, a stable loop is not achievable. Therefore, at a low print speed, the slip of the sheet on the separation roller and other rollers is aggravated and makes the amount of feed short, resulting in the skew or the feed failure of the sheet.

At a high print speed, a sheet forms an excessive loop and produces noise when the loop disappears because the separation pad is fixed and increases the load on sheet conveyance. Moreover, as the above document shows in FIG. 1, transport paths extending from the top and bottom trays of the sheet bank are sharply curved. Therefore, when the print speed is high, the sheet produces noise when sliding on guides forming the above transport paths. The above document therefore does not set a sheet conveying speed in consideration of noise of the entire printer.

The conventional sheet bank does not include registering means independent of the registration rollers of the printer body for conveying the leading edge of a sheet toward the registration rollers at a preselected timing. The present invention applies the above problems discussed in relation to the formation of a loop to the exclusive registering means of the bank also.

Technologies relating to the present invention are also disclosed in, e.g., Japanese Patent Laid-Open Publication No. 9-216448, Japanese Patent Publication No. 5-32296, Japanese Utility Model Publication No. 5-18342, Japanese Patent Laid-Open Publication Nos. 9-30714, 5-124737, 5-221536, 6-40137, 6-144600, 7-137851, 2-265825 and 10-35911, and U.S. patent application Ser. No. 09/025,037 which issued as U.S. Pat. No. 6,098,536 and Ser. No. 09/042,615 which issued as U.S. Pat. No. 5,931,090.

SUMMARY OF THE INVENTION

It is therefore an object of the present invention to provide a sheet feeding device for a printer capable of feeding a sheet at a preselected speed without regard to a print speed varying every moment due to various factors particular to an ink drum driveline or a set print speed, i.e., whether a set print speed is higher than a standard print speed or lower than the same, thereby obviating the short loop of a sheet which would result in the skew or feed failure of a sheet and reducing noise at print speeds lower than the standard print speed and used more often than the other print speeds.

It is another object of the present invention to provide a sheet feeding device for a printer capable of stably forming a preselected amount of loop and surely obviating the skew and feed failure of a sheet by recognizing the position of the leading edge of the sheet without regard to a load on sheet conveyance dependent on the configuration of a transport path and sheet size or even when the slip of the sheet on sheet conveying means increases.

It is still another object of the present invention to provide a sheet feeding device for a printer capable of preventing a sheet from rolling up, reducing noise, and increasing registration accuracy.

It is yet another object of the present invention to provide a sheet feeding device for a printer capable of reducing the skew, lateral misregistration and crease of a sheet fed from a sheet bank, feeding a sheet toward the registering means of a printer body at a constant timing, and correcting the variation of the amount of sheet feed ascribable to the slip of a sheet occurring between the sheet bank and the registering means.

It is a further object of the present invention to provide a sheet feeding device for a printer capable of enhancing the stability and reliability of a sheet feed timing toward registering means.

In accordance with the present invention, a sheet feeding device for a printer includes an ink drum rotatable at a variable speed in accordance with any one of a plurality of print speeds with a master wrapped therearound, a pressing member pressed against the ink drum relative to the ink drum with the intermediary of a sheet, a registering device for feeding the leading edge of the sheet toward a print position between the ink drum and the pressing member, a bank sheet feeding section positioned below the print position, and a sheet conveying device for conveying the sheet fed from the bank sheet feeding section toward the registering device. A print speed setting device sets a print speed such that the ink drum rotates in accordance with a set print speed included in the plurality of print speeds. A sheet conveyance drive source independent of a driveline assigned to the ink drum for driving the sheet conveying device. The sheet conveyance drive source drives the sheet conveying device in such a manner as to set up a constant sheet conveying speed without regard to the set print speed set via the print speed setting device.

Also, in accordance with the present invention, a sheet feeding device for a printer includes an ink drum rotatable at a variable speed in accordance with any one of a plurality of print speeds with a master wrapped therearound, a pressing member pressed against the ink drum relative to the ink drum with the intermediary of a sheet, a registering device for feeding the leading edge of the sheet toward a print position between the ink drum and the pressing member, and a bank sheet feeding section for conveying the sheet toward the registering device. A bank registering device is included in the bank sheet feeding section independently of the registering device for feeding the leading edge of the sheet toward the registering device. A bank sheet conveying device feeds the leading edge of the sheet toward the bank registering device such that the leading edge of the sheet abuts against the bank registering device and forms a loop. A bank sheet conveyance drive source independent of a driveline assigned to the ink drum drives the bank sheet conveying device. A print speed setting device sets a print speed such that the ink drum rotates in accordance with a set print speed included in the plurality of print speeds. The bank sheet conveyance drive source drives the bank sheet conveying device in such a manner as to set up a constant sheet conveying speed without regard to the set print speed set via the print speed setting device.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
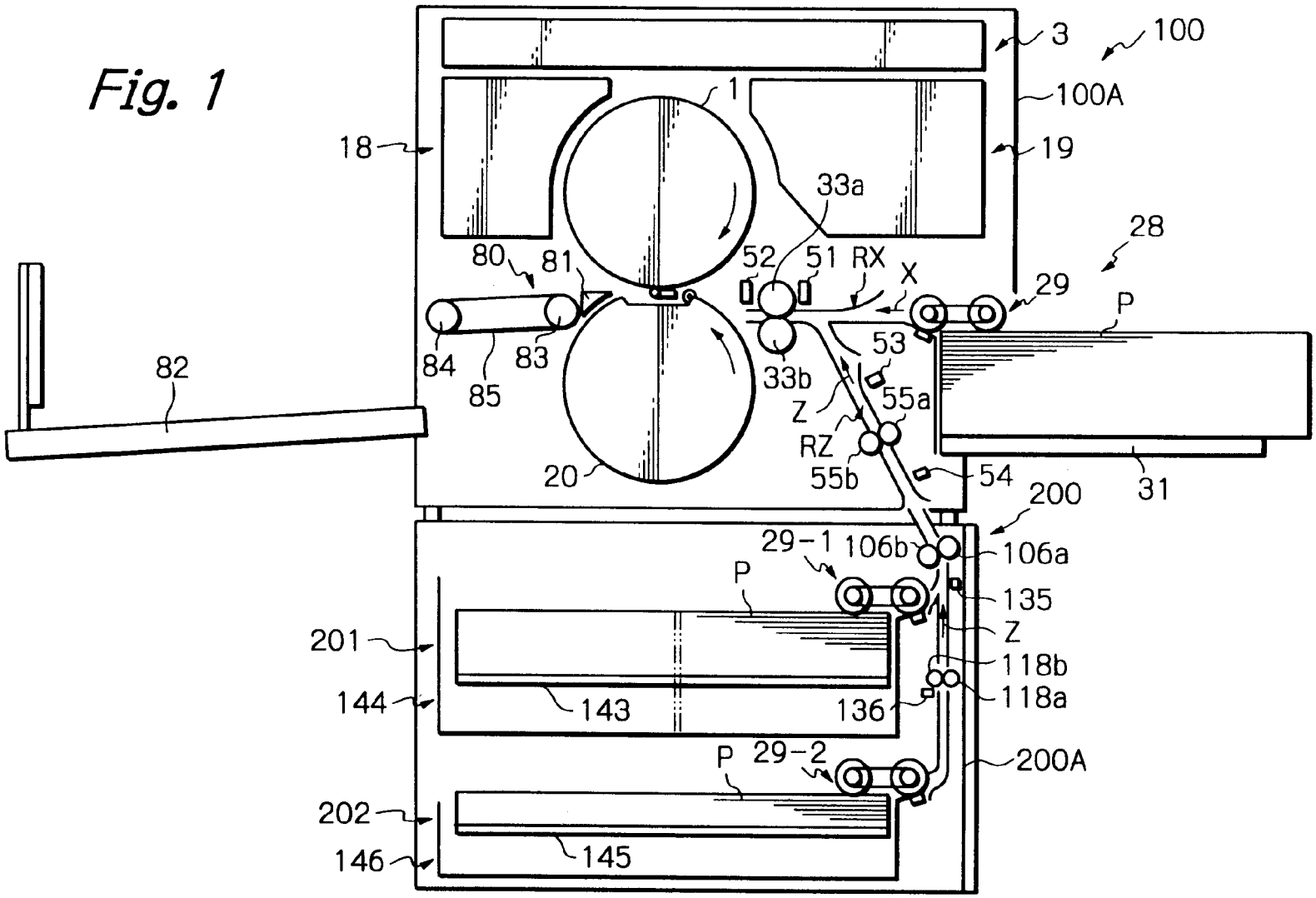
FIG. 1 is a front view showing a stencil printer and a bank sheet feeding section embodying the present invention.

Preferred embodiments of the printer in accordance with the present invention and modifications thereof will be described hereinafter with reference to the accompanying drawings. In the embodiments and modifications thereof, parts and elements identical in function and configuration are designated by identical reference numerals, and a repetitive description thereof will not be made in order to avoid redundancy. As for parts or elements provided in pairs, but not needing distinction, only one of them will be described.

Referring to FIG. 1 of the drawings, a printer to which the present invention is applicable is shown and implemented as a stencil printer by way of example. As shown, the stencil printer, generally 100, includes a bank sheet feeding section 200 positioned below a printing section, which will be described, included in the printer 100. A printer frame 100A and a bank frame 200A constitute the body of the printer 100 and the body of the bank 200, respectively.

Figure 2:
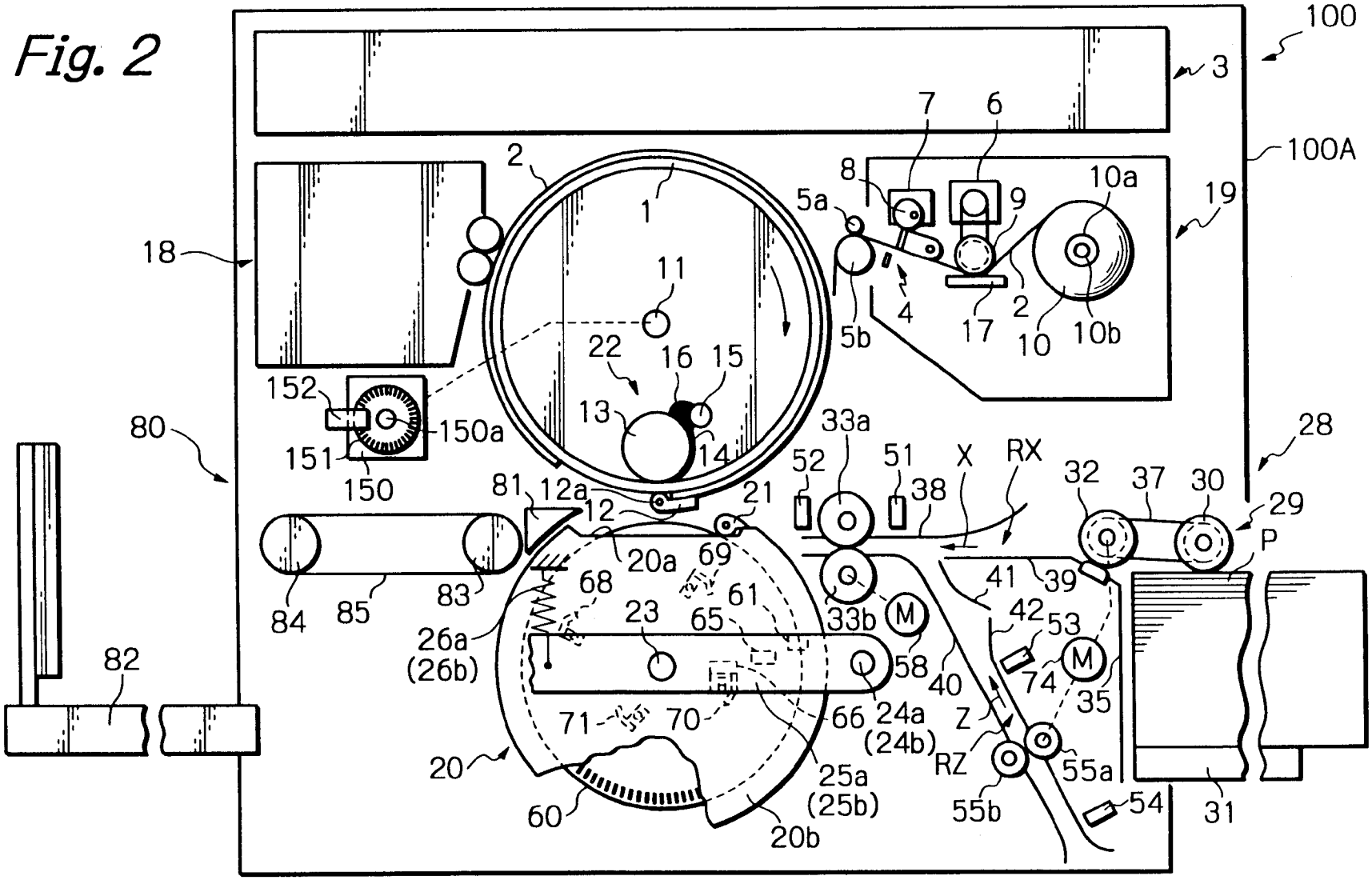
FIG. 2 is a fragmentary enlarged front view of the illustrative embodiment.

As shown in FIGS. 1 and 2, the printer 100 includes a hollow cylindrical ink drum 1 around which a master or cut stencil 2 is to be wrapped. A master discharging section 18 is arranged at the left-hand side of the ink drum 1 for peeling off a used master existing on the ink drum 1. A master making section 19 is located at the right-hand side of the ink drum 1 for making the master 2 while conveying it. A document reading section 3 is arranged above the master discharging section 18, ink drum 1 and master making section 19 in order to read a document image. An ink feeding device 22 is disposed in the ink drum 1 for feeding ink to the master 2 wrapped around the drum 1. A press drum 20 is positioned below the ink drum 1 and includes a sheet damper or sheet retaining means 21 for retaining the leading edge of a sheet P. The press drum 20 presses the sheet P against the master 2 existing on the ink drum 1. A sheet feeding device embodying the present invention is located at the right-hand side of the press drum 20 and includes an auxiliary sheet feeding section 28 representative of a plurality of sheet feeding sections. The sheet feeding device feeds the leading edge of a sheet P toward the sheet damper 21 of the press drum 20. A sheet discharging section 80 is arranged at the left-hand side of the press drum 20.

As shown in FIGS. 1, 2, 9 and 12, the ink drum 1 is made up of a porous hollow cylinder and a laminate mesh screen, not shown, wrapped around the cylinder. The ink drum 1 is rotatably mounted on a shaft 11. A main motor 150 causes the ink drum 1 to rotate at a speed variable in accordance with a print speed via a drive transmission mechanism which will be described specifically later. The main motor 150 implemented by a DC motor by way of example does not transmit its rotation to the sheet feed driveline and sheet conveyance driveline of the auxiliary sheet feeding section 28 or those of the bank sheet feeding section 200. The main motor 150 is therefore smaller in size than the conventional main motor.

As shown in FIG. 2, an encoder 151 is mounted on the output shaft 150*a* of the main motor 150 and implemented by an incremental photo-rotary encoder. An encoder sensor 152 is mounted on the a printer frame 100A in the vicinity of the encoder 151. Specifically, the encoder sensor 152 is implemented by a transmission type optical sensor including a light emitting portion and a light-sensitive portion which sandwich the encoder 151 at a preselected distance from the encoder 151. The encoder 151 rotates together with the main motor 150 while outputting preselected pulses. The encoder sensor 152 senses the pulses representative of the rotation speed of the ink drum 1. The resulting output of the encoder sensor 152 is used to control the rotation speed of the ink drum 1.

A master damper 12 is mounted on the outer periphery of the ink drum 1 and angularly movable about a shaft 12*a* for clamping the leading edge of the master 2 produced from the master making section 19. A stage, not shown, is also mounted on the outer periphery of the ink drum 1 and extends in the direction axial direction of the ink drum 1. The stage is formed of a ferromagnetic material. The master clamper 12 is positioned to face the stage and has a magnet adhered to its surface facing the stage. When the ink drum 1 reaches a preselected angular position, an opening and closing device, not shown, causes the master clamper 12 to open and then close.

Figure 9:
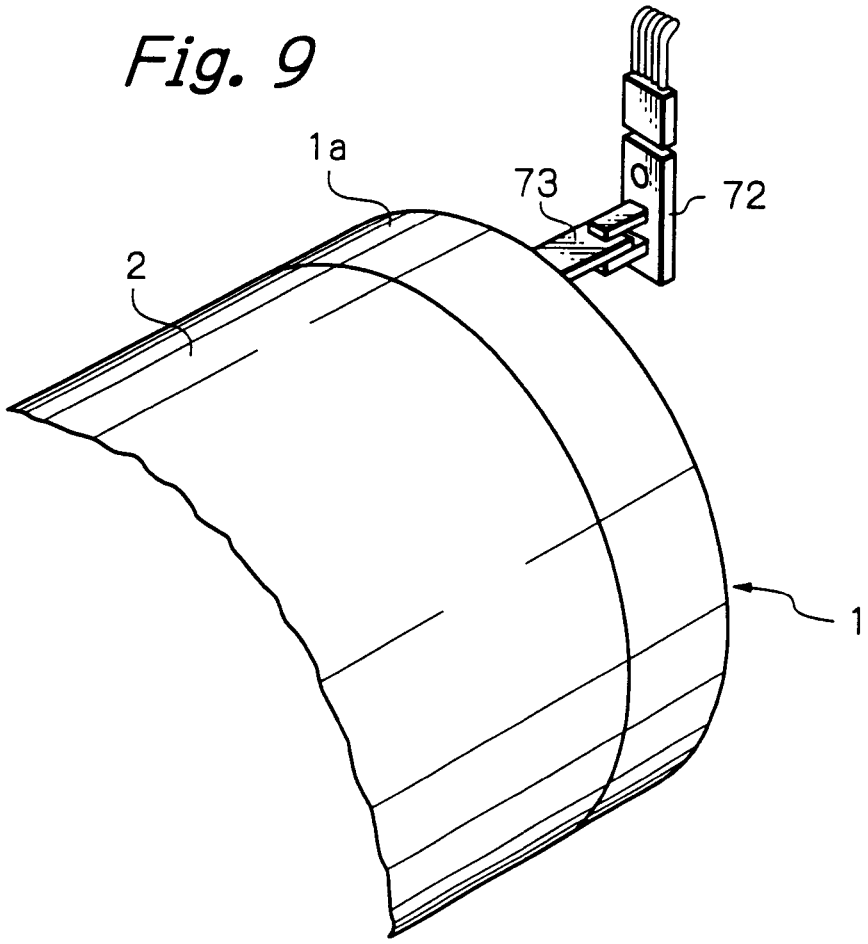
FIG. 9 is an isometric view showing a home position sensor responsive to the home position of an ink drum included in the illustrative embodiment.

As shown in FIG. 9, a home position sensor 72 is mounted on the printer frame 100A to face the rear end wall 1*a* of the ink drum 1. The home position sensor 72 is responsive to a home position H.P (see FIG. 13A) assigned to the ink drum 1. The home position sensor 72 is implemented by a transmission type optical sensor including a light emitting portion and a light-sensitive portion. An interrupter 73 protrudes outward from the rear end wall 1*a* so as to selectively interrupt the optical path of the home position sensor 72.

As shown in FIG. 2, the master making section 19 includes a shaft 10*b* supporting a stencil roll 10 such that a stencil, also labeled 2, can be paid out from the roll 10. The stencil roll 10 includes a core 10*a*. A platen roller 9 conveys the stencil 2 while paying it out from the roll 10. A thermal head 17 is movable into and out of contact with the platen roller 9. A pair of cutter members 4 are located downstream of the platen roller 9 in the direction in which the stencil 2 is paid out, and cuts the stencil 2 at a preselected length. A pair of rollers 5*a* and 5*b* convey the leading edge of the stencil or master 2 toward the master clamper 12.

The platen roller 9 has its shaft rotatably supported. A pulse motor 6 causes the platen roller 9 to rotate at a preselected peripheral speed, so that the platen roller 9 conveys the stencil 2 while pressing it against the thermal head 17.

The thermal head 17 includes a plurality of heating elements arranged in an array in the widthwise direction of the stencil 2. A conventional moving mechanism, not shown, moves the head 17 into and out of contact with the platen roller 9. The head 17 selectively perforates, or cuts, the stencil 2 with heat in accordance with an image signal digitized by an analog-to-digital converter included in the document reading section 3 and processed by a master making control section not shown. As a result, an image corresponding to a document image is formed in the stencil 2. A cutter drive motor 7 moves the upper cutter member 4 up and down via an eccentric cam 8. When the upper cutter member 4 is moved downward, it cuts the stencil 2 in cooperation with the lower cutter member 4.

As shown in FIG. 2, the ink feeding device 22 includes an ink roller 13 rotatable in synchronism with and in the same direction as the ink drum 1 for feeding ink to the inner periphery of the ink drum 1. A doctor roller 15 is positioned in parallel to the ink roller 13 and spaced from the roller 13 by a small gap, forming an ink well 16. The shaft 11 mentioned earlier is tubular and feeds ink to the ink well 16 via apertures formed therein. The ink roller 13 and doctor roller 15 are journalled to a front and a rear side wall affixed to the shaft 11. The ink drum 1 and ink roller 13 are spaced from each other by a small gap to allow ink transferred from the ink well 16 to the ink roller 13 to be fed to the inner periphery of the ink drum 1 by the ink roller 13. The ink is fed under pressure from an ink pack to the hollow shaft 11 by an ink pump, although not shown specifically.

Figure 12:
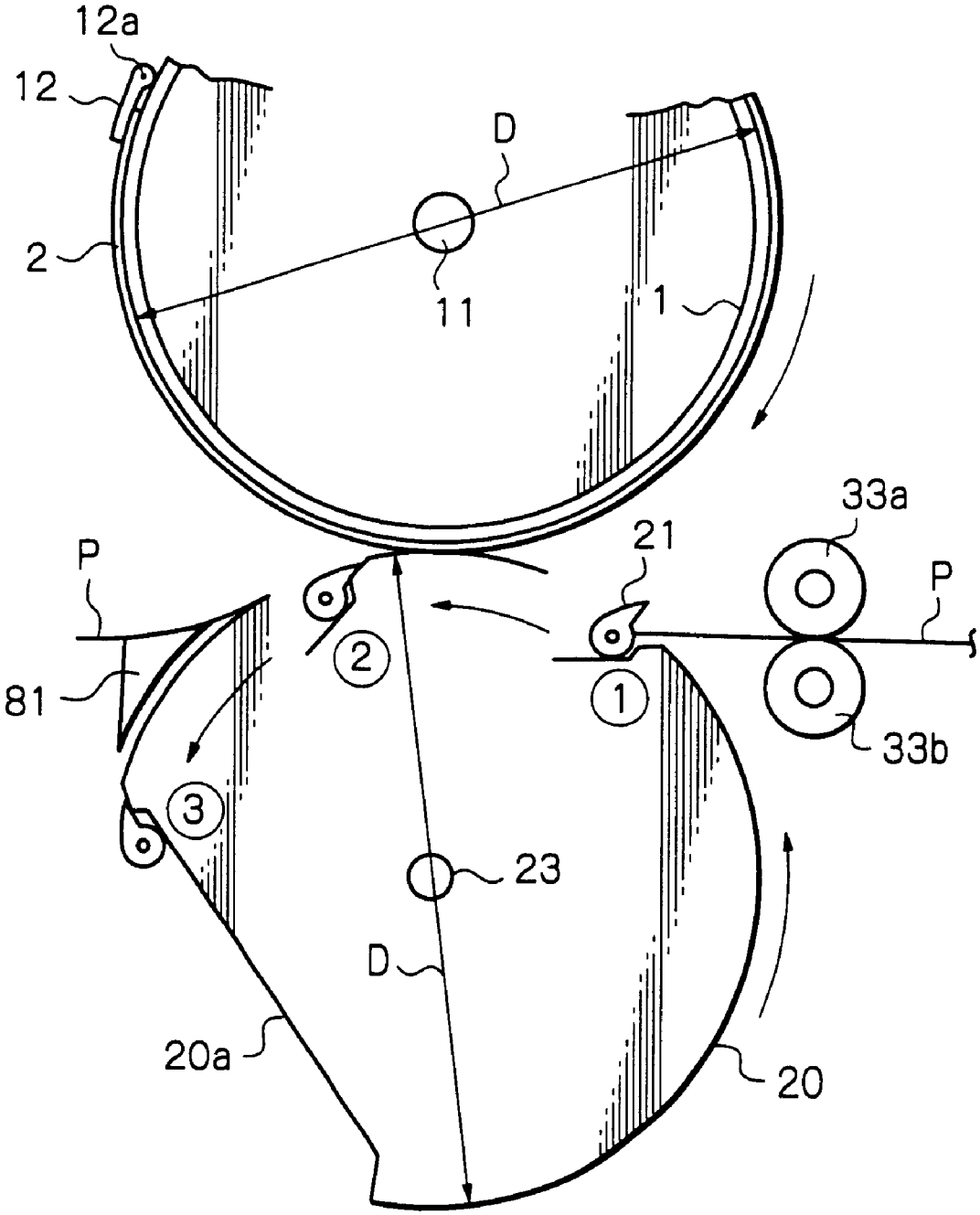
FIG. 12 is a front view showing the angular position of a sheet damper included in the illustrative embodiment and varying in accordance with the rotation of the press drum.

In the illustrative embodiment, the press drum 20 with the sheet clamper 21 is used as pressing means in order to increase registration accuracy relative to the sheet P, to stabilize image density, and to reduce noise during printing. As shown in FIG. 12 in detail, the press drum 20 has an outside diameter D equal to the outside diameter D of the ink drum 1. Therefore, when the ink drum 1 completes one rotation, the press drum 20 also completes one rotation. This allows the sheet clamper 21 for clamping the sheet P to be mounted on the press drum 20. By feeding the sheet P while causing its leading edge to abut against the sheet clamper 21, it is possible to increase registration accuracy relative to the sheet P. In the illustrative embodiment, the press drum 20 has an outside diameter D of 180 mm and a length of 300 mm.

If the above advantage attainable with the press drum 20 is not of primary importance, the pressing means may be implemented by, e.g., a press roller smaller than the ink drum 1 and movable into contact with the ink drum 1 with the intermediary of the master 2.

Another advantage achievable with the press drum 20 is as follows. As shown in FIG. 12, the leading edge of the sheet P abuts against the sheet clamper 21 when the clamper 21 is brought to an angular position $\hat{1}$ (sometimes referred to as a clamp position hereinafter). Then, the sheet clamper 21 is closed to clamp the leading edge of the sheet P. As the clamper 21 clamping the paper P is moved to a position $\hat{2}$, the ink is transferred from the ink drum 1 to the sheet P. As the sheet clamper 21 is further moved to a position $\hat{3}$ (sometimes referred to as an unclamp position hereinafter) past of the position $\hat{2}$, the clamper 21 is opened to release the leading edge of the sheet P. This prevents the sheet P from rolling up on the ink drum 1 due to the adhesion force of the ink.

Figure 7:
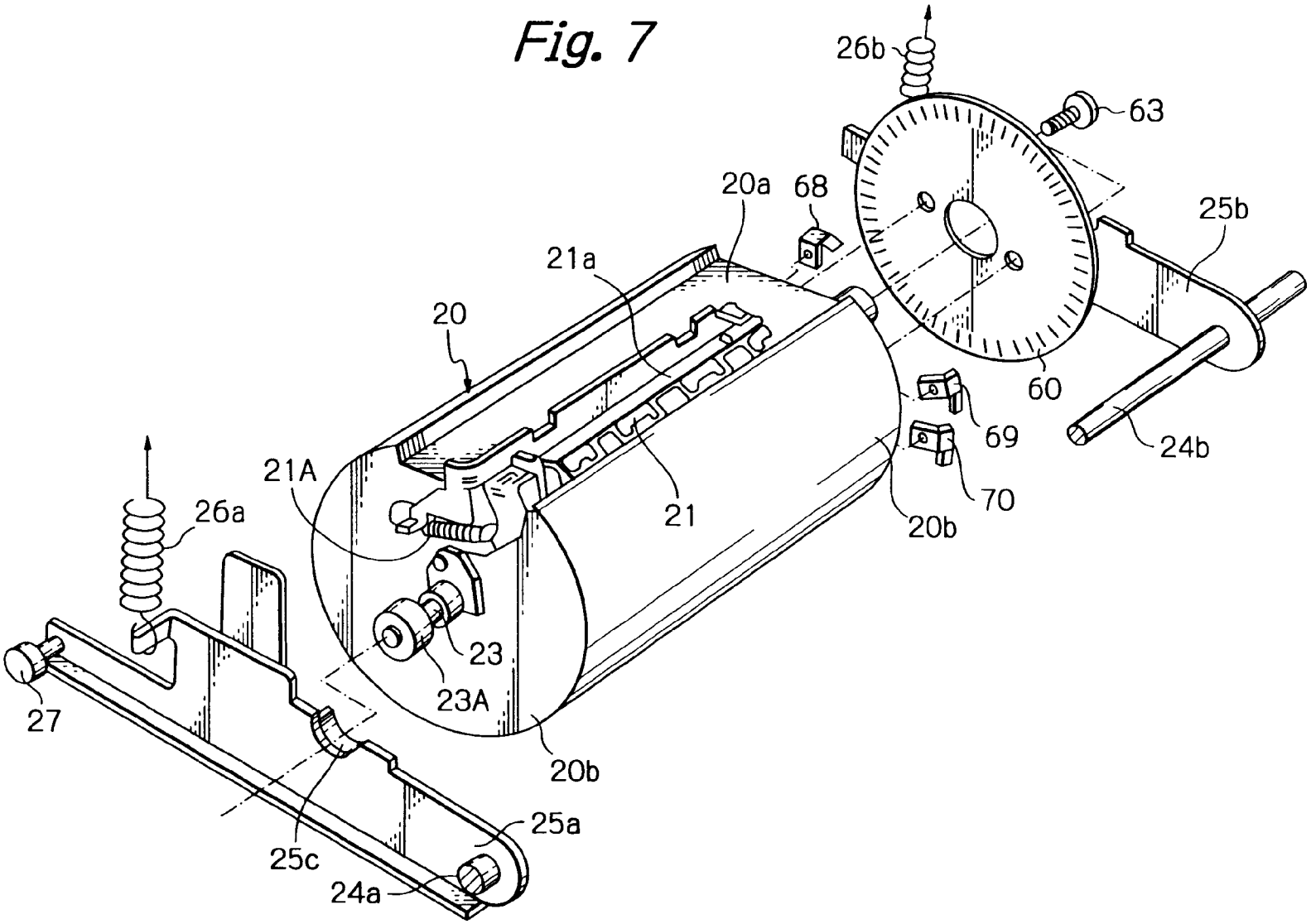
FIG. 7 is a fragmentary exploded isometric view showing a structure for mounting control parts around a press drum included in the illustrative embodiment.
Figure 8:
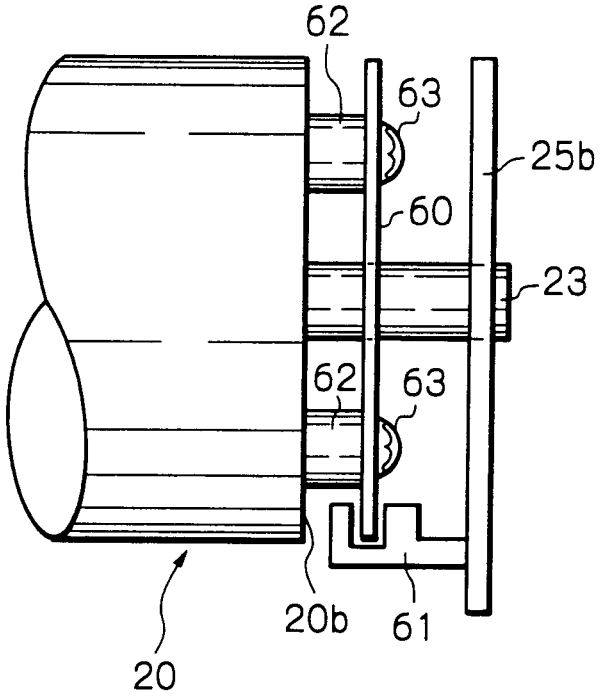
FIG. 8 is a plan view of the structure shown in FIG. 7.
Figure 11:
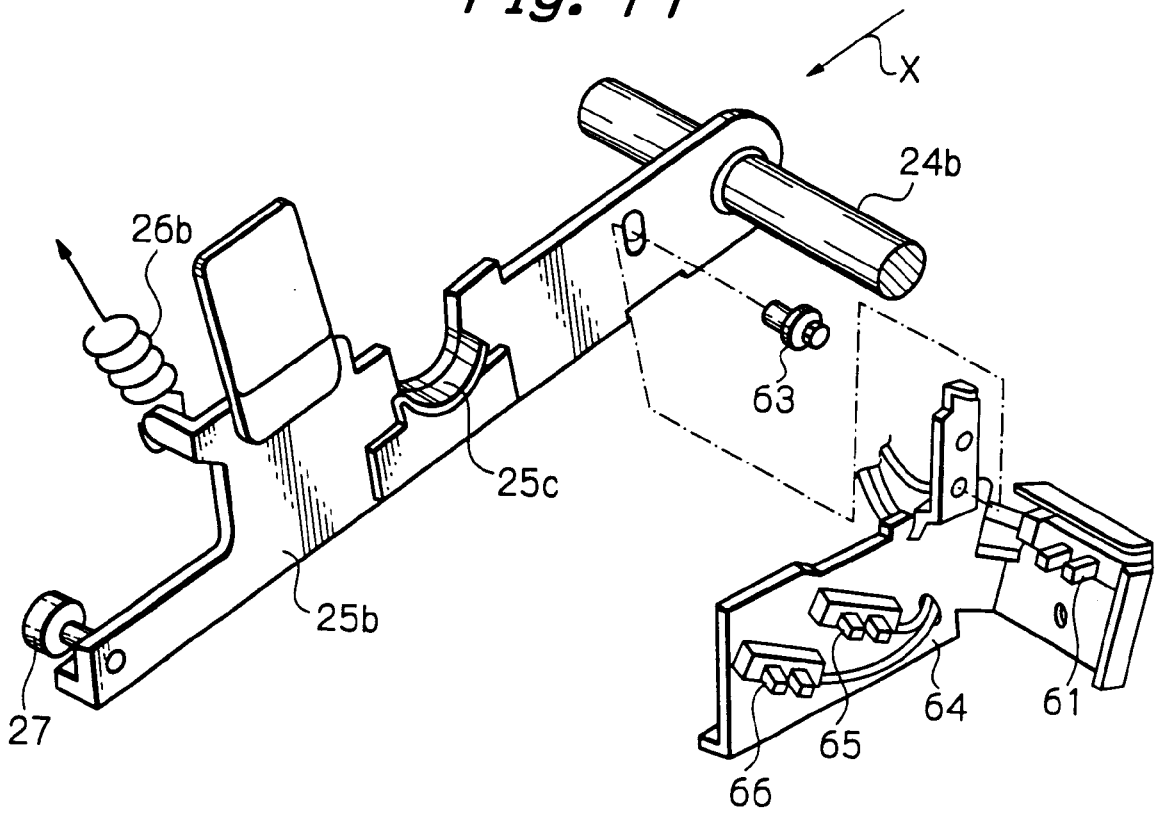
FIG. 11 is an exploded isometric view showing a structure for mounting control parts around an arm associated with a press drum included in the illustrative embodiment.

As shown in FIGS. 2, 7 and 8, the press drum 20 includes end walls 20*b* affixed to a shaft 23. As shown in FIGS. 7 and 11, arms 25*a* and 25*b* are respectively positioned outside of the opposite end walls 20*b*, and each includes a bearing support portion 25*c* and a cam follower 27 implemented by a bearing. The shaft 23 is rotatably supported by the bearing support portions 25*c* via bearings 23A mounted on its axially opposite ends, allowing the press drum 23 to rotate. The printer frame 100A includes a front and a rear side wall although not shown specifically. A shaft 24*a* is affixed to the front side wall. The arm 25*a* has its one end supported by the shaft 24*a* via a bearing not shown. Likewise, the arm 25*b* has its one end supported by a shaft 24*b* supported by the rear side wall via a bearing not shown. The shafts 24*a* and 24*b* are coaxial with each other.

A drive gear, not shown, is affixed to the end portion of the shaft 24*b* inside of the arm 25*b* for transmitting rotation to the press drum 20. A driven gear, not shown, is affixed to the end of the shaft 23 adjoining the arm 25*b* and held in mesh with the drive gear. A toothed pulley, not shown, is affixed the shaft 24*b* outside of the arm 25*b* for transmitting the rotation of the ink drum 1. A toothed belt, not shown, is passed over the above toothed pulley and a toothed pulley affixed to the end wall 1*a* of the ink drum 1. Another pulley is mounted on the above end plate 1*a* coaxially with the toothed pulley. In this configuration, the rotation of the main motor 150 is transmitted to the driven gear via the pulleys, belt and drive gear. The press drum 20 is therefore rotated in the same direction (counterclockwise) as and in synchronism with the ink drum 1.

The press drum 20 has a contour made up of a cylindrical portion capable of contacting the ink drum 1 and a generally D-shaped recess 20*a* capable of preventing the drum 20 from interfering with the master clamper 12 of the drum 1. In the illustrative embodiment, the press drum 20 consists of a core formed of synthetic resin for a light weight configuration and a nitrile rubber layer covering the core. The nitrite rubber layer reduces the irregular rotation of the press drum 20.

The sheet clamper 21 is positioned in the recess 20*a* of the press drum 20 and includes a magnet not shown. A shaft 21*a* is disposed in the recess 20*a* and supports the base end of the clamper 21. A spring 21A constantly biases the clamper 21 in a direction in which the clamper 21 tends to close. A cam, not shown, causes the clamper 21 to open at a preselected timing and then close after clamping the leading edge of the sheet P, thereby retaining the sheet P on the press drum 20.

When the sheet P is, e.g., a plain paper or a thin paper, the sheet clamper 21 clamps the leading edge portion of the sheet P over about 2 mm. On the other hand, when the sheet P is, e.g., a relatively thick paper, the clamper 21 does not clamp the leading edge of the sheet P. Should the clamper 21 clamp, e.g., a relatively thick paper, it would fail to fully close due to the elasticity of the sheet P and would thereby cause the leading edge of the sheet P to hit against the master 2 or the mesh screen present on the ink drum 1, causing the ink to fly about.

The press drum 20 is selectively moved into or out of contact with the ink drum 1 by the following moving means. The moving means includes a pair of springs 26*a* and 26*b* and a pair of cams, not shown, in addition to the two arms 25*a* and 25*b* and two cam followers 27 stated earlier. The arms 25*a* and 25*b* are angularly movable about the shafts 24*a* and 24*b*, respectively, moving the press drum 20 toward or away from the ink drum 1. The two cam followers 27 are rotatably mounted on the ends of the arms 25*a* and 25*b*, respectively. The springs 26*a* and 26*b* constantly bias the arms 25*a* and 25*b*, respectively, toward the ink drum 1. The cams each contact one of the two cam followers 27.

The above two cams each are connected to the ink drum 1 and main motor 150 by a toothed belt, not shown, and rotated in synchronism with the ink drum 1. Each cam has a contour contacting the associated cam follower such that the outer periphery of the press drum 20 except for the recess 20*a* is pressed against the preselected porous region of the ink drum 1 where the master clamper 12 is absent. A pressure canceling mechanism, not shown, is mounted on the printer frame 100A and includes a solenoid not shown. When an error occurs in the conveyance of the sheet P or during master making operation, the pressure canceling mechanism releases the cams and cam followers 27 and therefore the ink drum 1 and press drum 20. In this manner, the press drum 20 is movable about the shafts 24*a* and 24*b* between a position where it is pressed against the ink drum 1 and a position where it is spaced from the ink drum 1.

The springs 26*a* and 26*b* generate a force for pressing the press drum 20 against the ink drum 1. The springs 26*a* and 26*b* are respectively anchored to the arms 25*a* and 25*b* in order to cause the above force to evenly act on the ink drum 1.

The driveline including the main motor 150, the moving means and so forth described above are shown in, e.g., FIGS. 1–5 of Japanese Patent Laid-Open Publication No. 9-216448 mentioned earlier.

The sheet discharging section 80 adjoining the left end of the press drum 20 includes a peeler 81 for peeling off the sheet P from the press drum 20. A belt 85 is passed over two rollers 83 and 84 for conveying the sheet removed by the peeler 81. A suction fan, not shown, holds the sheet P on the belt 85 by suction. The belt 85 is driven by, e.g., a motor at a speed higher than the peripheral speed of the ink drum 1. A tray 82 is positioned at the left-hand side of the sheet discharging section 80 for receiving the sheet or printing P.

The sheet feeding device including the auxiliary sheet feeding section 28 is arranged at the right-hand side of the press drum 20. As shown in FIGS. 1–4, the sheet feeding device includes an upper and a lower registration roller 33*a* and 33*b*, respectively. The registration rollers, or registering means, 33*a* and 33*b* cause the leading edge portion of the sheet P to form a loop and then convey the leading edge toward a print position between the ink drum 1 and the press drum 20. The auxiliary sheet feeding section 28 feeds the sheets P toward the registration rollers 33*a* and 33*b*.

A substantially vertical transport path RZ extend between the registration rollers 33*a* and 33*b* and the bank sheet feeding section 200 and includes a pair of intermediate rollers or conveying means 55*a* and 55*b*. The intermediate rollers 55*a* and 55*b* drive the leading edge of the sheet P fed from the sheet feeding section 200 toward the registration rollers 33*a* and 33*b*. On abutting against the registration rollers 33*a* and 33*b*, this sheet P forms a loop. A sheet feed motor or conveyance drive means 74 drives the intermediate rollers 55*a* and 55*b*. A substantially horizontal transport path RX extends between the auxiliary sheet feeding device 28 and the registration rollers 33*a* and 33*b*. Guides 38, 39 and 40 are arranged in the transport path RX for guiding the leading edge of the sheet P to the registration rollers 33*a* and 33*b* and then to the sheet clamper 21 of the press drum 20.

A leading edge sensor 51 is positioned in the vicinity of a position where the above two transport paths RZ and RZ join each other for sensing the leading edge of the sheet P fed from the intermediate rollers 55*a* and 55*b*. A registration sensor 52 is positioned on the transport path RX between the registration rollers 33*a* and 33*b* and the press drum 20 for sensing the leading edge of the sheet P. The leading edge sensor 51 is also responsive to the leading edge of the sheet P fed from the auxiliary sheet feeding section 28 via the transport path RX.

As shown in FIGS. 1–4, the auxiliary sheet feeding section 28 includes an elevatable tray 31 on which the sheets P are stacked. Sheet feeding means picks up the sheets P on the tray 31 one by one while feeding them toward the registration rollers 33 and 33*b*. The front end of the sheet stack P on the tray 31 is positioned by a front plate 35.

In the illustrative embodiment, a registration motor 58 independent of the main motor 150 drives the registration rollers 33 and 33*b* in place of the conventional sector gear system.

The sheet feeding means includes a pickup roller 30 for paying out the sheets P stacked on the tray 31 and a separation roller 32 and a separation pad 34 (FIG. 5) cooperating to separate the top sheet P from the under lying sheets P. The sheet feeding means 29 is driven by the previously mentioned sheet feed motor 74 independent of the main motor 150 in place of the conventional sector gear system.

The tray 31 is elevatable such that the pickup roller 30 constantly contacts the top sheet P with a preselected pressure capable of conveying the sheet P. The tray 31 allows sheets to be fed even by hand, i.e., allows a broad range of sheets to be used. Up to 500 sheets of size A3 or A4 can be stacked on the tray 31. A structure for implementing manual sheet feed is taught in, e.g., Japanese Utility Model Laid-Open Publication No. 5-18342 by way of example.

Figure 3:
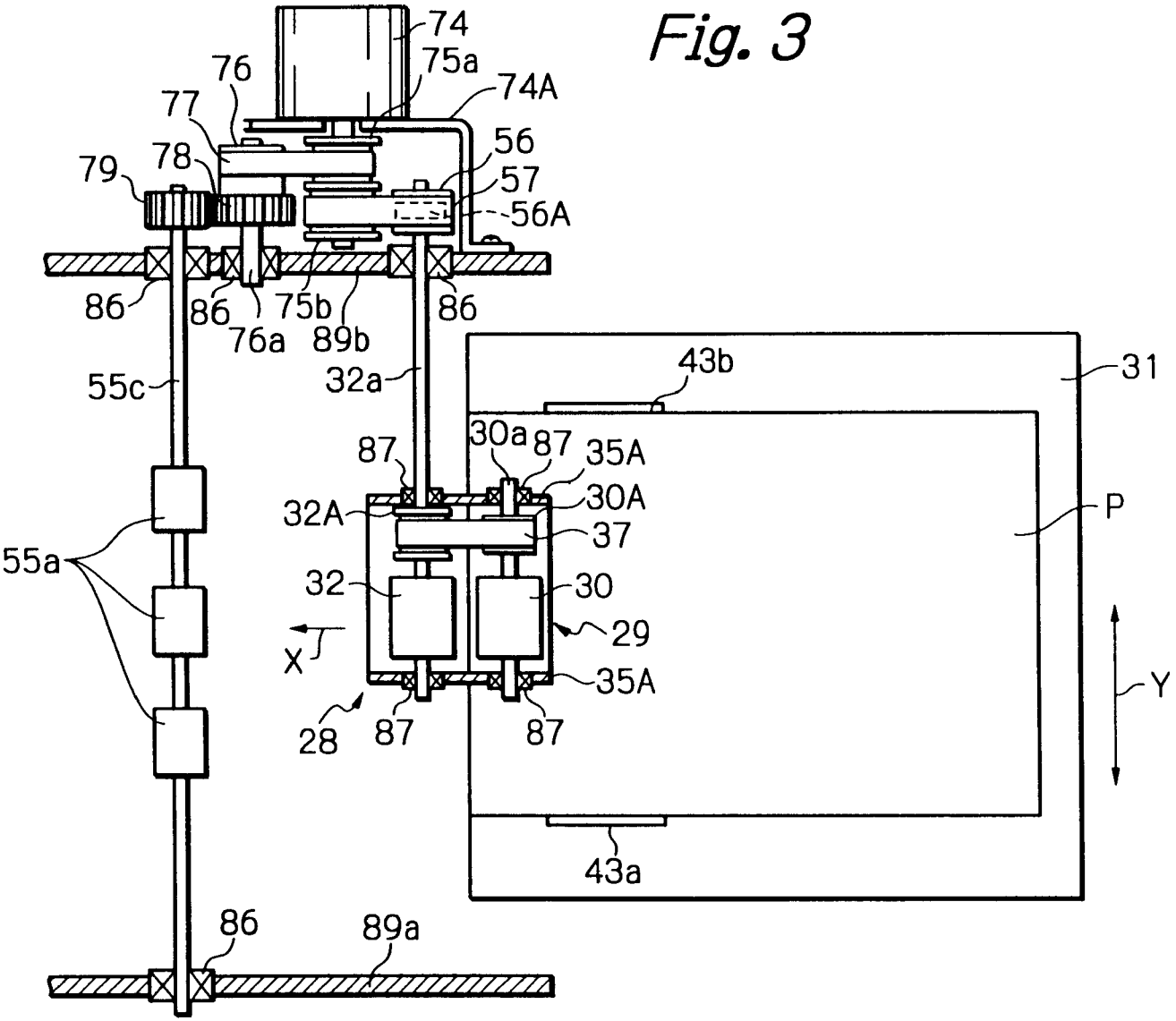
FIG. 3 is a plan view showing an auxiliary sheet feeding section included in the illustrative embodiment.
Figure 14:
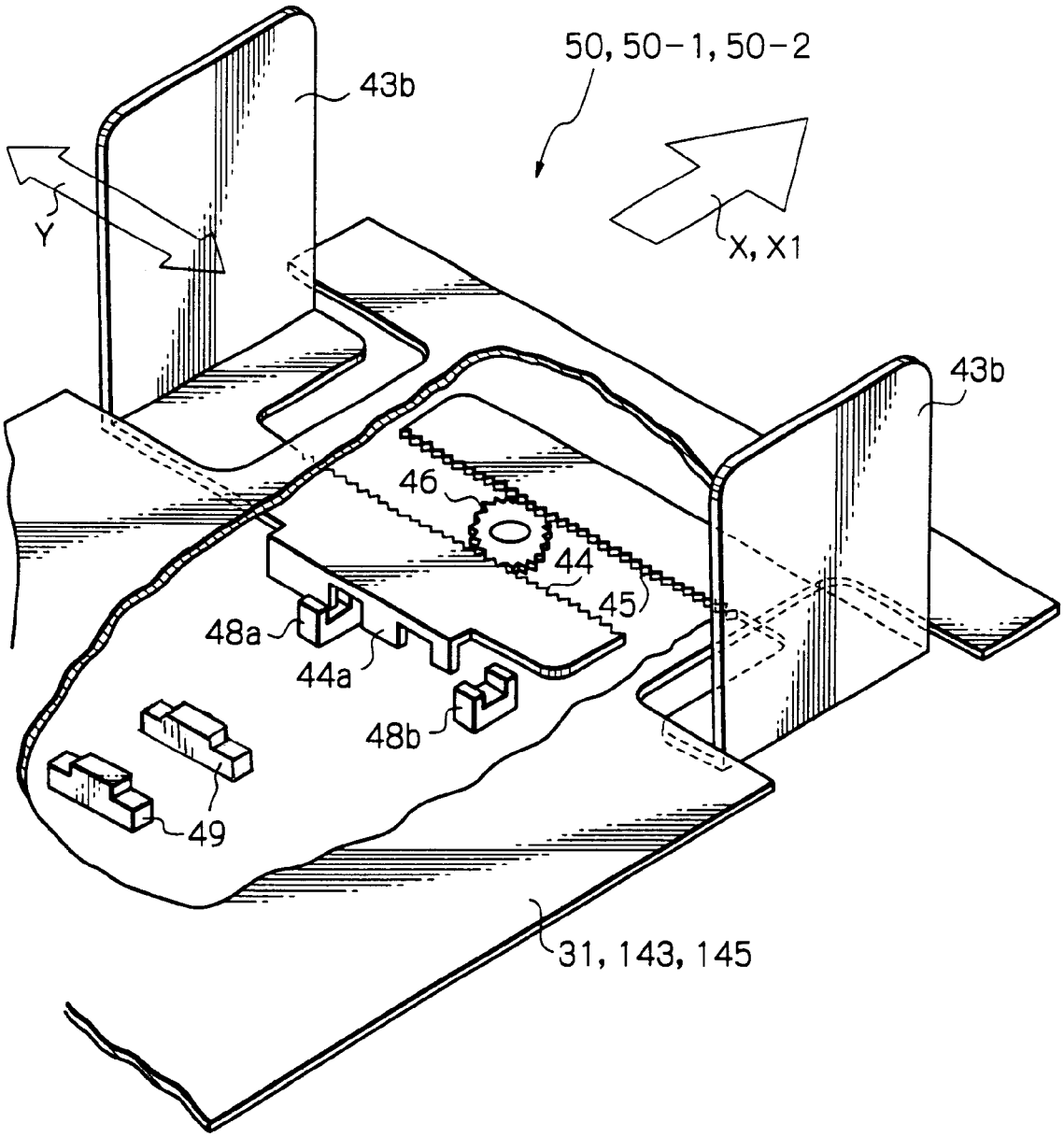
FIG. 14 is a fragmentary isometric view showing a sheet size sensing mechanism associated with, e.g., an auxiliary tray included in the illustrative embodiment.

As shown in FIGS. 3 and 14, a pair of side fences 43*a* and 43*b* are positioned on the tray 31 and movable toward and away from each other in the widthwise direction Y of the sheets P. The side fences 43*a* and 43*b* position the opposite sides of the sheets P in accordance with the size of the sheets P. FIG. 14 shows a sheet size sensing mechanism specifically. The sheet size sensing mechanism determines the size of the sheets P in interlocked relation to the movement of the side fences 43*a* and 43*b* in the widthwise direction Y. The mechanism includes a pinion 46 rotatably mounted on a stationary member positioned on the bottom of the tray 31. A rack 45 is formed at one edge of the lower portion of the side fence 43*a* and held in mesh with the pinion 46. Likewise, a rack 44 is formed at one end of the lower portion of the side fence 43*a* and held in mesh with the pinion 46. The racks 45 and 44 face each other, as illustrated. An interrupt wall 44*a* protrudes downward from the other edge of the lower portion of the side fence 43*b* opposite to the rack 44 and is formed with a plurality of notches. Two lateral size sensors 48*a* and 48*b* are mounted on the above stationary member at a preselected distance from each other such that the interrupt wall 44*a* selectively aligns with the sensor 48*a* or 48*b*. Longitudinal size sensors 49 are also mounted on the stationary member and spaced from each other at a preselected distance in a direction of sheet feed X.

The lateral size sensors 48*a* and 48*b* each are implemented by a transmission type optical sensor having a light emitting portion and a light-sensitive portion. The size of the sheets P in the widthwise direction Y is determined on the basis of the outputs of the sensors 48*a* and 48*b* with which the interrupt portion 44*a* selectively aligns. The lengthwise size sensors 49 each are implemented by a reflection type optical sensor responsive to the size of the sheets P in the direction of sheet feed X. The sensors 48*a*, 48*b* and 49 constitute a sensor group 50. A sheet feed control unit, which will be described later, includes a CPU (Central Processing Unit) which determines the size of the sheets P on the basis of the combination of size data output from the sensor group 50. This kind of sheet size sensing system is taught in, e.g., Japanese Patent Laid-Open Publication No. 9-30714 mentioned earlier. Of course, the illustrative embodiment is practicable with any other suitable sheet size sensing system.

The bank sheet feeding section 200 includes trays 143 and 145, as will be described specifically later. Sheet size sensing mechanisms similar to the above sheet size sensing mechanism are also arranged on the trays 143 and 145 and include sensor groups 50-1 and 50-2, respectively. The sensor groups 50-1 and 50-2 will not be described specifically in order to avoid redundancy.

As shown in FIGS. 2. 4 and 6, the substantially horizontal transport path RX is delimited by the guides 38, 39 and 40. The upstream end of the guide 38 in the direction of sheet feed X is curved upward. In this configuration, the sheet P fed by the sheet feeding means in the direction X abuts against the portion of the guide 38 just upstream of the nip between the registration rollers 33*a* and 33*b*, forming a loop PA shown in FIG. 5.

Figure 6:
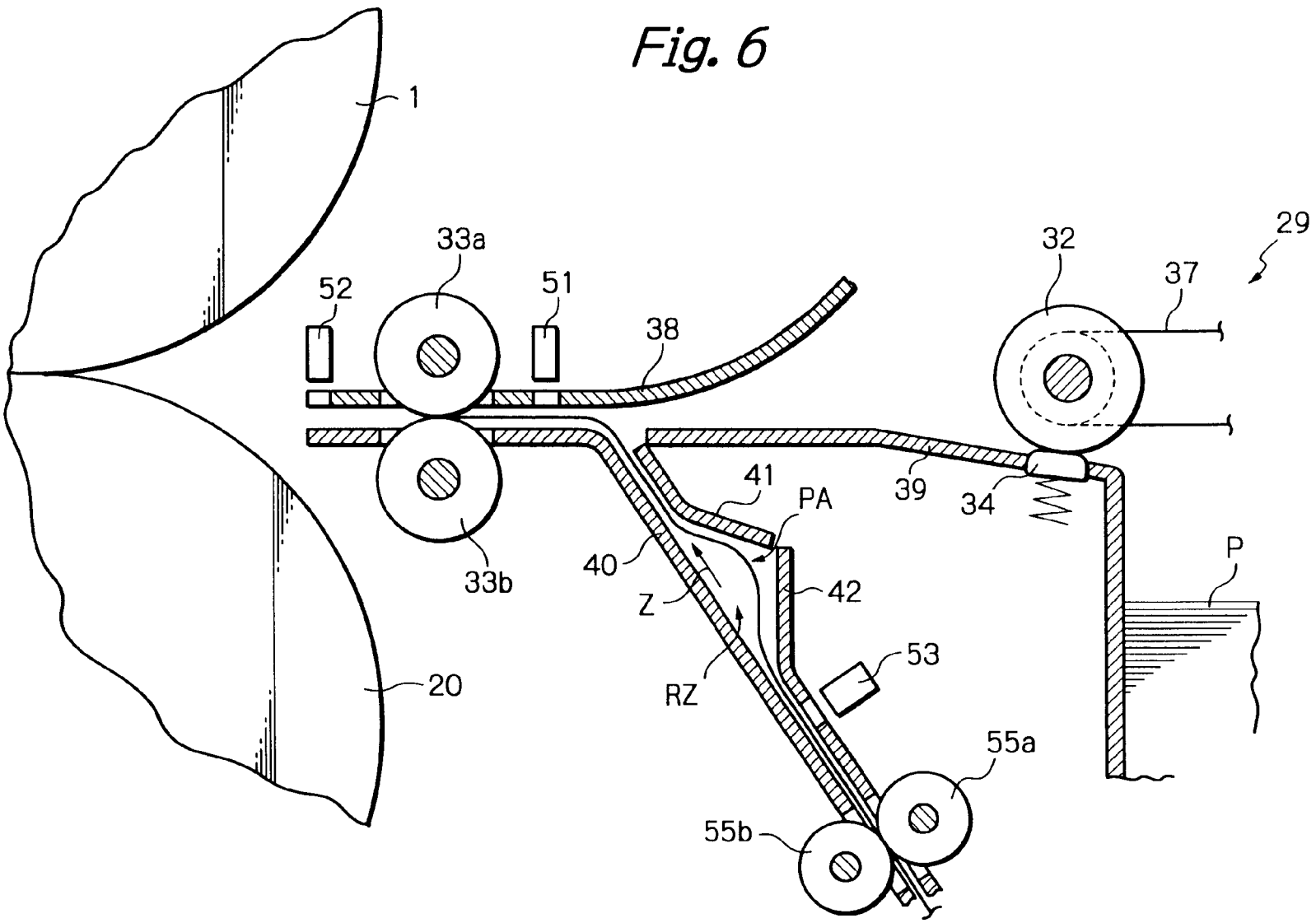
FIG. 6 is a fragmentary sectional view showing a portion where a sheet fed from the bank sheet feeding section forms a loop.

The guide 40 is bent obliquely downward from the portion of the horizontal transport path RX adjacent to the registration rollers 33*a* and 33*b*. The guide 40 forms the upper portion of the substantially vertical transport path RZ in combination with intermediate guides 41 and 42 facing the guide 40. The end portions of intermediate guides 41 and 42 facing each other are curved away from the guide 40, as illustrated. The bank 200 sheet feeding section includes sheet feeding means 29-1 and 29-2. When the sheet feeding means 29-1 or 29-2 feeds the sheet P to the downstream side in a direction of sheet feed Z via a plurality of rollers, which will be described later, the leading edge of the sheet P abuts against the above portion just upstream of the nip between the registration rollers 33*a* and 33*b* and forms a loop PA, as shown in FIG. 6.

Figure 4:
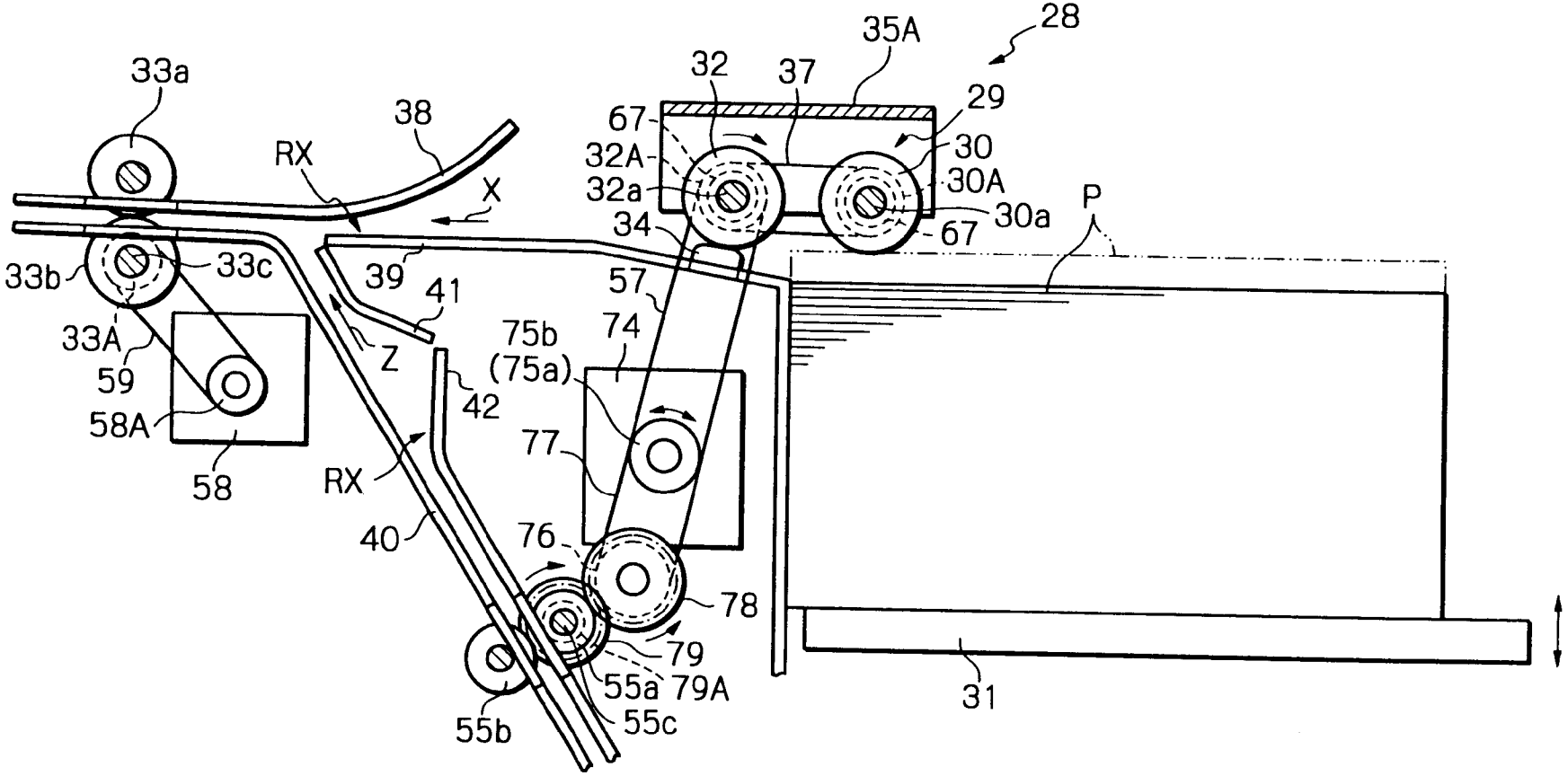
FIG. 4 is a fragmentary sectional front view of the auxiliary sheet feeding section.

The intermediate rollers 55*a* and 55*b* mentioned earlier are positioned in the upper portion of the vertical transport path RZ for causing the leading edge of the sheet P fed from the bank 200 to abut against the registration rollers 33*a* and 33*b*. More specifically, the rollers 55*a* and 55*b* cause the leading edge of the sheet to abut against the portion just upstream of the nip between the registration rollers 33*a* and 33*b* and form the loop PA. As shown in FIGS. 3 and 4, the right intermediate roller 55*a*, as viewed in FIGS. 2 and 4, is implemented as a drive roller made up of three roller elements. The roller elements are mounted on a single shaft 55*c* for reducing the crease of a thin sheet. The other intermediate roller 55*b* is implemented as a driven roller constantly pressed against the intermediate roller 55*a* by a spring or similar biasing means. The intermediate roller 55*b* is also made up of three roller elements although not shown in FIG. 3. The shaft 55*c* and a shaft, not shown, on which the roller 55*b* is mounted are rotatably supported by a front panel and a rear panel included in the printer body via roller bearings 86.

A drive system for selectively driving the intermediate rollers 55*a* and 55*b* or the sheet feeding means 29 will be described with reference to FIGS. 3 and 4 together with a more detailed configuration of the feeding means 29. One-way clutches 67 are interposed between the separation roller 32 and a shaft 32*a* on which the roller 32 is mounted and between the pickup roller 30 and a shaft 30*a* on which the roller 30 is mounted. Toothed pulleys 32A and 30A are mounted on the shafts 32*a* and 30*a*, respectively. A timing belt 37 is passed over the pulleys 32A and 30A. When the one-way clutches 67 are coupled, the pickup roller 30 and separation roller 32 are rotated clockwise, as indicated by an arrow in FIG. 4 for feeding the sheets P one by one. That is, the pickup roller 30 and separation roller 32 are rotatable only in the clockwise direction.

The shafts 30*a* and 32*a* supporting the pickup roller 30 and separation roller 32, respectively, are rotatably supported by a generally U-shaped arm 35A whose bottom is open. The pickup roller 30 is angularly movable about the shaft 32*a* over a preselected angle due to its own weight and the weight of the arm 35A. The shaft 32*a* protrudes outward from the rear side panel 89*b* and rotatably supported by the panel 89*b* via the roller bearing 86. A toothed driven pulley 56 is mounted on the end of the end of the shaft 32*a* protruding from the rear panel 89*b*. A one-way clutch 56A is interposed between the driven pulley 56 and the shaft 32*a* and allows the shaft 32*a* to rotate only in the clockwise direction, as viewed in FIG. 4, when coupled.

The sheet feed motor 74 is implemented by a stepping motor and independent of the driveline assigned to the ink drum 1 and including the main motor 150. The operator of the printer 100 is capable of setting a desired print speed on print speed keys 96 (see FIG. 17). When the desired print speed is higher than a standard print speed, the motor 74 drives the intermediate rollers 55*a* and 55*b* at a speed matching with the desired print speed. When the desired print speed is lower than the standard print speed, the motor 74 drives the rollers 55 and 55*b* at a speed matching with the standard print speed. The motor 74 therefore serves not only as sheet feed drive means for driving the separation roller 32 and pickup roller 30, but also as sheet conveyance drive means for driving the intermediate rollers 55*a* and 55*b*.

As shown in FIGS. 3 and 4, the sheet feed motor 74 is mounted on a motor bracket 74A affixed to the rear panel 89*b* by screws. Toothed drive pulleys 75*a* and 75*b* are mounted on the output shaft of the motor 74. A timing belt 57 is passed over the driven pulley 56 and drive pulley 75*b*.

A drive gear 78 and a toothed driven pulley 76 are mounted on a shaft 76*a* in the vicinity of the drive pulley 75*a*. A timing belt 77 is passed over the driven pulley 76 and drive pulley 75*a*. A driven gear 79 is mounted on one end of the shaft 55*c* of the intermediate roller 55*a* and held in mesh with the drive gear 78. A one-way clutch 79A is interposed between the shaft 55*c* and the driven gear 79. The one-way clutch 79A causes the intermediate roller 55*a* to rotate clockwise for conveying the sheet P via the driven gear 79 when coupled.

When the auxiliary sheet feeding section 28 is to feed a sheet P, the sheet feed motor 74 is rotated clockwise or forward in FIG. 4. The rotation of the motor 74 is transferred to the shaft 32*a* via the drive pulley 75*b*, timing belt 57, driven pulley 56 and one-way clutch 56A which is coupled then. The rotation of the shaft 32*a* is transmitted to the separation roller 32 via the one-way clutch 67, which is coupled then, causing the roller 32 to rotate clockwise. At the same time, the rotation of the shaft 32*a* is transferred to the pulley 32A and then to the shaft 30*a* via the timing belt 37, pulley 30A and one-way clutch 67 which is coupled then, causing the pickup roller 30 to rotate clockwise. The separation roller 32 and pickup roller 30 both rotating clockwise feed the top sheet P from the auxiliary tray 31 toward the registration rollers 31. Although the rotation of the motor 74 is transferred from the drive pulley 75*a* to the driven gear 79 via the timing belt 77, driven pulley 76 and drive gear 78, the one-way clutch 79A is not coupled and causes the driven gear 79 to simply idle. Therefore, the rotation of the motor 74 is not transmitted to the intermediate rollers 55 and 55*b*.

On the other hand, when the bank sheet feeding section 200 is to feed a sheet P, the motor 74 is reversed, i.e., rotated in the counterclockwise direction in FIG. 4. This rotation of the motor 74 is transmitted to the shaft 55*c* via the drive pulley 75*a*, timing belt 77, driven pulley 76, drive gear 78, driven gear 79 and one-way clutch 79A which is coupled then. As a result, the intermediate roller 55*a* is rotated clockwise while the intermediate roller 55*b* contacting the roller 55*a* is rotated counterclockwise. The intermediate rollers 55*a* and 55*b* cooperate to convey the sheet P fed from the sheet feeding section 200 toward the registration rollers 33*a* and 33*b*. In this case, although the rotation of the motor 74 is transferred to the driven pulley 56 via the drive pulley 75*b* and timing belt 57, the one-way clutch 56A is not coupled and causes the driven pulley 56 to simply idle. The rotation of the motor 74 is therefore not transferred to the shaft 32*a*, so that the separation roller 32 and pickup roller 30 do not rotate.

As stated above, a single motor 74 implements both of the conveyance drive means assigned to the intermediate rollers 55*a* and 55*b* and sheet feed drive means. That is, the motor 74 is reversibly driven to selectively rotate the intermediate rollers 55*a* and 55*b* or the separation roller 32 and pickup roller 30. This obviates the need for two drive motors respectively assigned to a pair of intermediate rollers and a separation roller and a pickup roller, as taught in, e.g., Japanese Patent Laid-Open Publication No. 6-40137. It follows that the illustrative embodiment is free from layout limitations ascribable to two motors and therefore saves space and cost.

An upper intermediate sensor 53 is mounted on the intermediate guide 42 between the leading edge sensor 51 and the intermediate rollers 55*a* and 55*b* for sensing the leading edge of the sheet P. The bank sheet feeding section 200 includes a pair of bank registration rollers 106*a* and 106*b*. A lower intermediate sensor 54 is mounted on the lower portion of the intermediate guide 42 on the vertical transport path RZ between the intermediate rollers 55*a* and 55*b* and the bank registration rollers 106*a* and 106*b*. The lower intermediate sensor 54 is also responsive to the leading edge of the sheet P. The intermediate sensors 53 and 54 each are implemented by a reflection type optical sensor including a light emitting portion and a light-sensitive portion. As partly shown in FIG. 5, the intermediate guide 42 is formed with holes for passing light issuing from the light emitting portions of the sensors 53 and 54.

A sheet jam occurred on the upstream portion of the vertical transport path RZ including the intermediate rollers 55*a* and 55*b* is detected on the basis of the output of the intermediate sensor 53. The lower intermediate sensor 54 determines whether or not the sheet P is fed from the bank sheet feeding section 200 within a preselected period of time, and senses a sheet jam occurred on the path RZ upstream of the intermediate rollers 55*a* and 55*b*.

The registration motor 58 for driving the registration roller 33*b* is also implemented by a stepping motor. As shown in FIG. 4, a drive pulley 58A is mounted on the output shaft of the motor 58. A timing belt 59 is passed over the drive pulley 58A and a driven pulley 33A mounted on the shaft 33*c* of the registration roller 33*b*. The drive pulley 58A and driven pulley 33A both are toothed pulleys engaged with the timing belt 59 without slipping.

Figure 10:
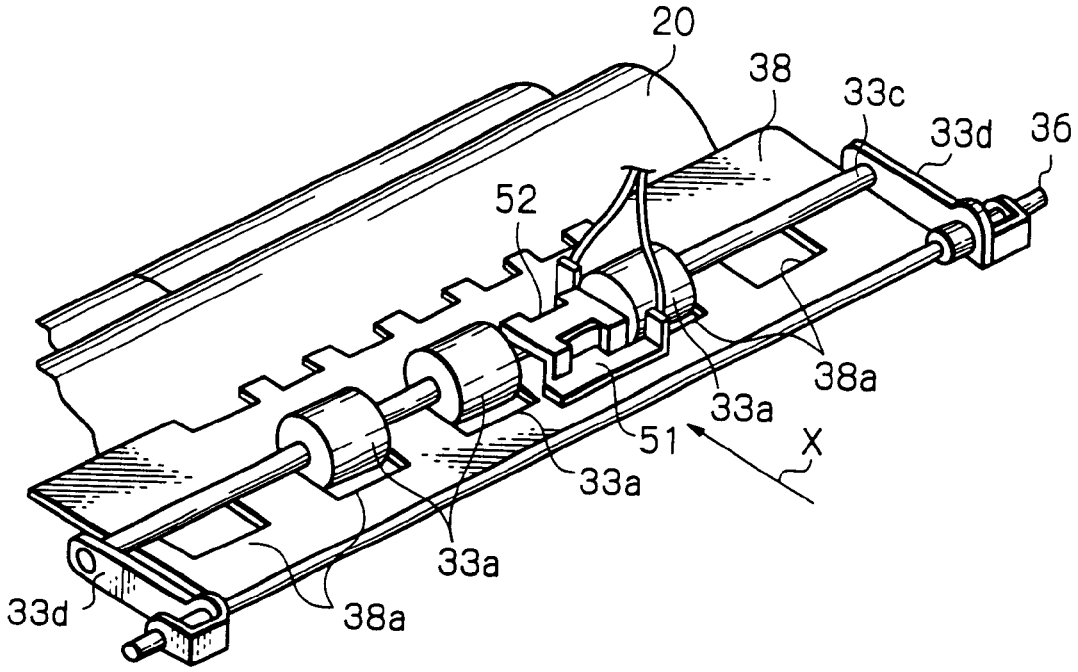
FIG. 10 is an isometric view showing a structure for mounting control parts around a pair of registration rollers included in the illustrative embodiment.

As shown in FIG. 10, the upper registration roller 33*a* is made up of three roller elements mounted on the shaft 33*c* for reducing the crease of a thin sheet. While the upper guide 38 is formed with five holes 38*a* in an array, the three roller elements of the registration roller 33*a* are respectively rotatably received in three intermediate holes 38*a*. A moving mechanism, not shown, moves the registration roller 33*a* into and out of contact with the registration roller 33*b* which is implemented as five roller elements, not shown in FIG. 10.

Figure 5:
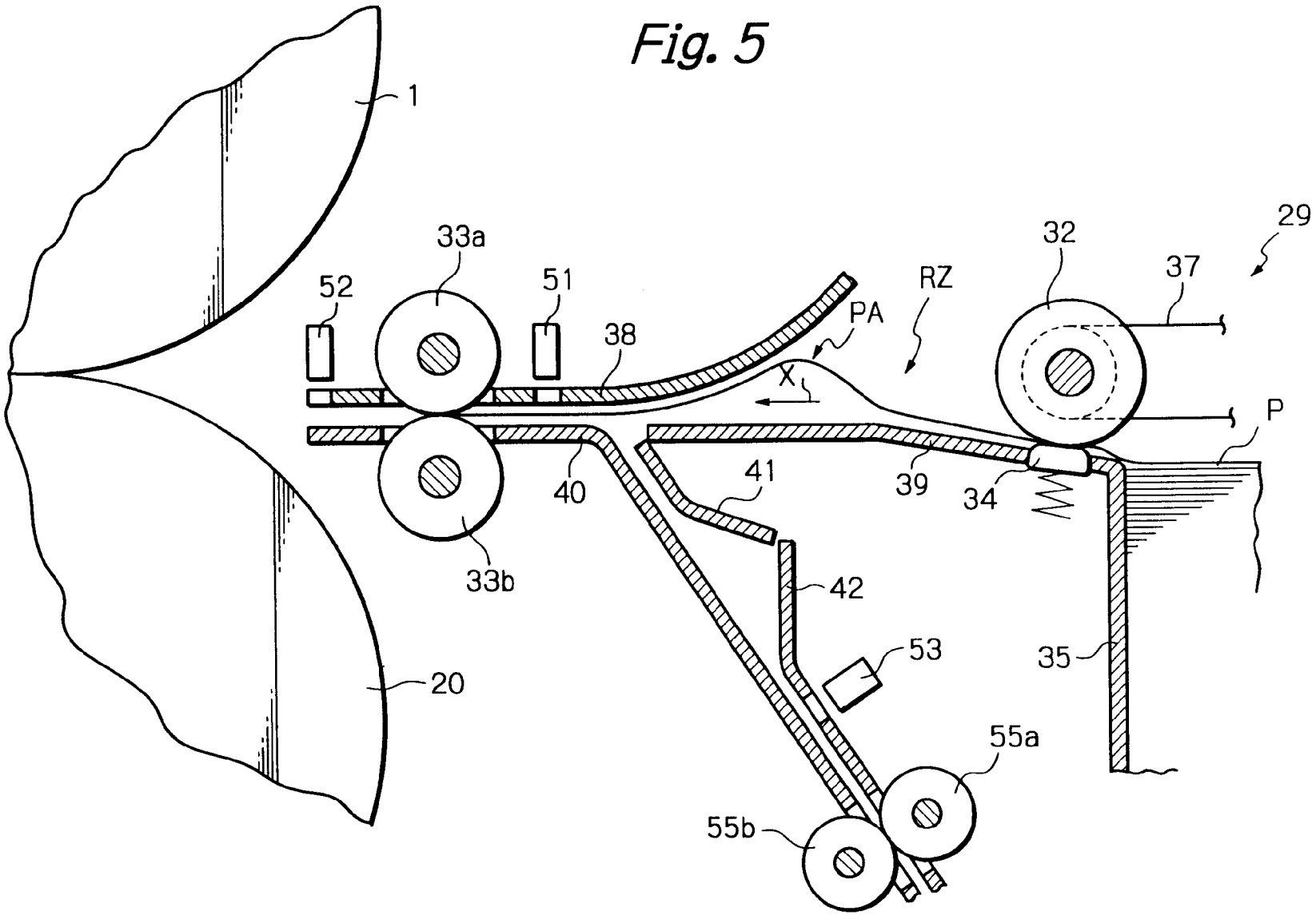
FIG. 5 is a fragmentary sectional view showing a portion where a sheet fed from the auxiliary sheet feeding section forms a loop.

As shown in FIGS. 1 and 10, in the illustrative embodiment, the leading edge sensor 51 is mounted on the upper guide 38 at a position 19 mm upstream of the center of the shaft 33*c* in the direction of sheet feed X. Likewise, in the illustrative embodiment, the registration sensor 52 is mounted on the upper guide 38 at a position 19 mm downstream of the center of the shaft 33*c* in the above direction X. The sensors 51 and 52 both are reflection type optical sensors each including a light emitting portion and a light-sensitive portion. As shown in FIGS. 5 and 6, the guide 38 is formed with holes for passing light issuing from the light transmitting portions and light reflected from the sheet P.

The leading edge sensor 51 senses a jam occurred in the direction of horizontal sheet feed X including the sheet feeding means 29 or at the upstream side in the direction of vertical sheet feed Z. In addition, when the leading edge of the sheet P fed from the auxiliary sheet feeding section 28 or the bank sheet feeding section 200 abuts against the portion just upstream of the nip between the registration rollers 33*a* and 33*b*, the leading edge sensor 51 joins in the adjustment of the loop PA which the sheet P is expected to form. The registration sensor 52 also responsive to the leading edge of the sheet P senses a sheet jam occurred in the direction X including the registration rollers 33*a* and 33*b* or at the upstream side of the direction Z.

The moving mechanism assigned to the upper registration roller 33*a* includes a pair of roller arms 33*d* supporting the opposite ends of the shaft 33*c* at one end. The roller arms 33*d* are affixed at the other end to a shaft 36 rotatable by a preselected angle about its own axis. A cam follower, not shown, for canceling a pressure is mounted on the rear end of the shaft 36 and includes a bearing. A cam, not shown, is mounted on the printer frame 100A and slidably contacts the cam follower. A spring, not shown, constantly biases the upper registration roller 33*a* toward the lower registration roller 33*b*.

In the illustrative embodiment, the above cam is driven by the main motor 150 via gears or similar drive transmitting members. Alternatively, such a mechanism moving mechanism may be replaced with a solenoid, stepping motor or similar electrical mechanism in order to further reduce the load to act on the main motor 150, as stated previously.

Figure 13B:
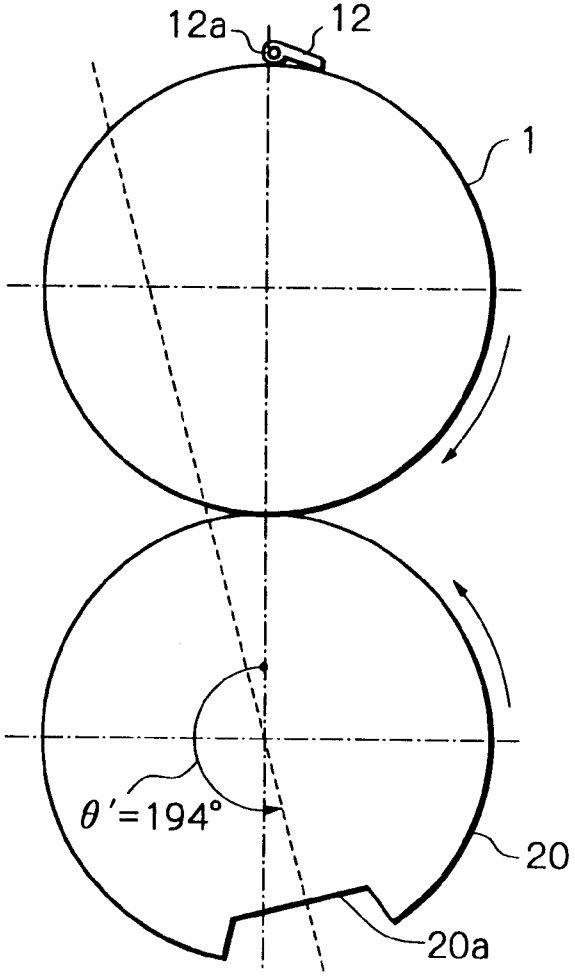
FIGS. 13A and 13B are views each showing a particular angular position of the press drum.
Figure 13A:
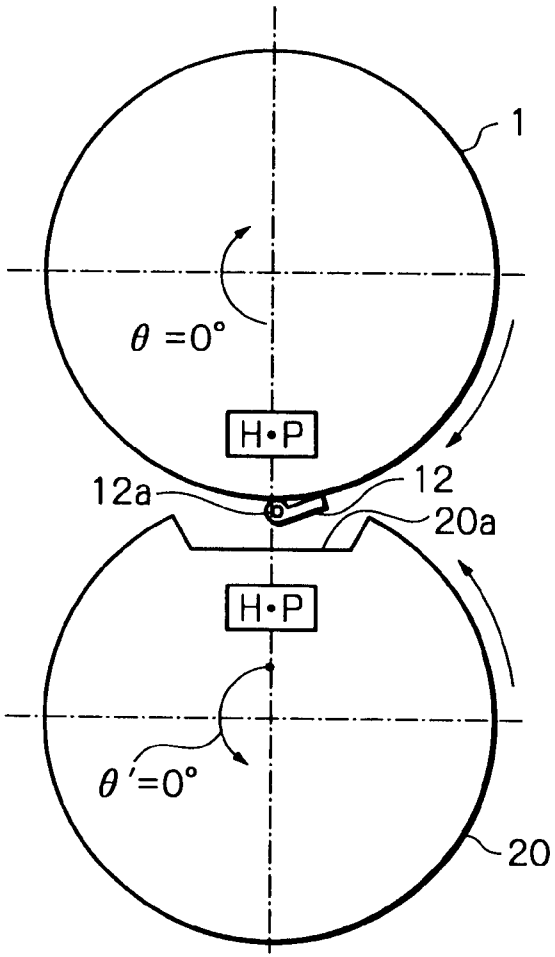

Assume that the ink drum 1 and press drum 20 each rotate via the positions to be described with reference to FIGS. 13A and 13B while the sheet P is conveyed. FIG. 13 shows the ink drum 1 and press drum 20 held in their home positions H.P. When the press drum 20 is in its home position H.P, the recess 20*a* is positioned on the top of the drum 20 and faces the master clamper 12 of the ink drum 1. The clockwise rotation of the ink drum 1 from the home position H.P is represented by an angle θ. The counterclockwise rotation of the press drum 20 from the home position H.P is represented by an angle θ'. It is to be noted that the ink drum 1 and press drum 20 each are removable from the printer body 100A when held in the home position H.P.

Figure 20:
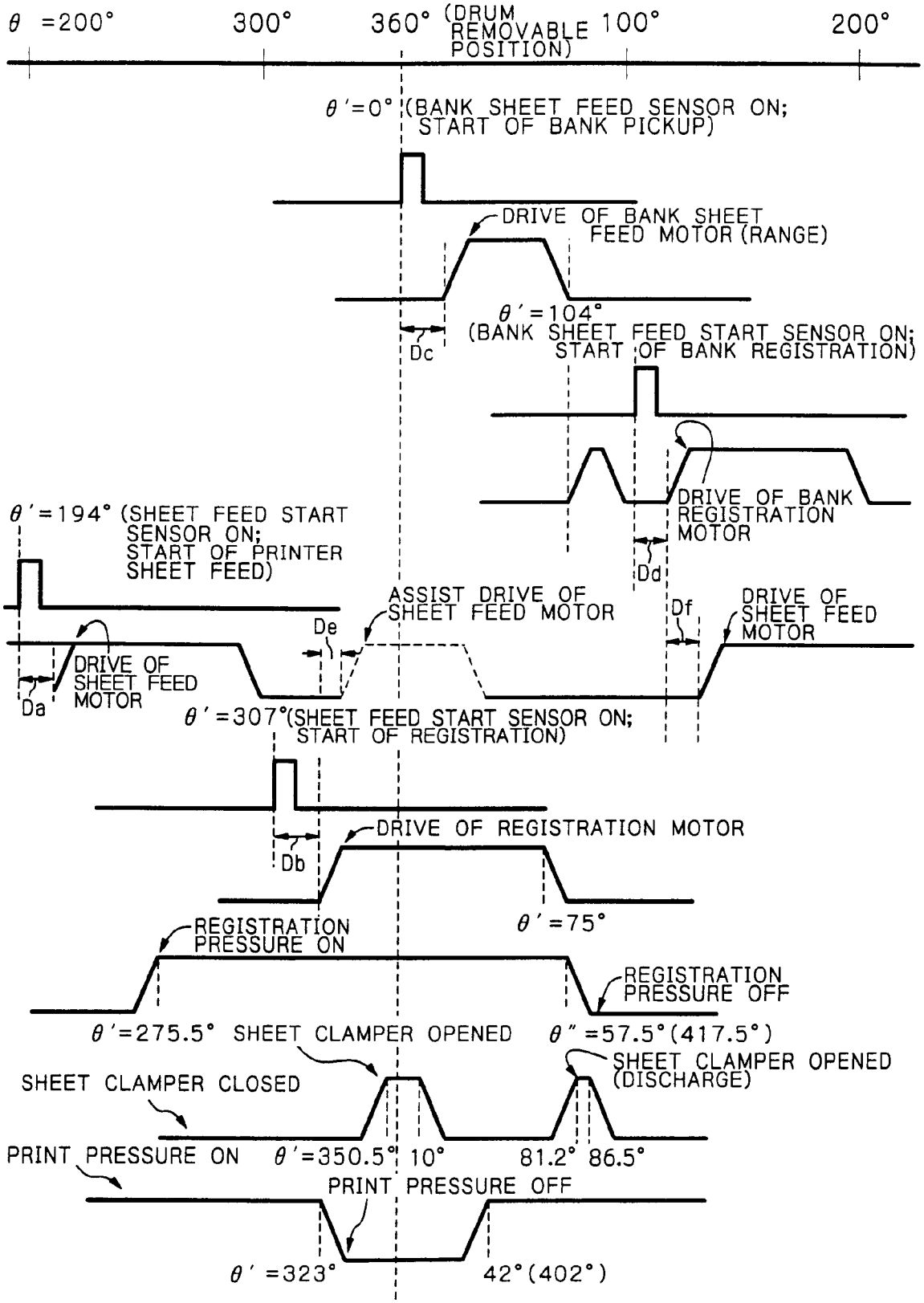
FIG. 20 is a timing chart demonstrating the sheet feeding operation of the entire printer representative of the first embodiment.

The operation of the moving mechanism associated with the upper registration roller 33*a* is as follows. As shown in FIG. 20, in the illustrative embodiment, the pressure for pressing the upper registration roller 33*a* against the lower registration roller 33*b* is applied (ON) when the ink drum 1 is rotated to a position θ=257.5° and then canceled (OFF) when it is rotated to a position θ=57.5° (417.5°). After the sheet clamper 21 has clamped the leading edge of the sheet P, the registration roller cam is rotated such that the bearing of the cam follower contacts the projection of the cam. As a result, the registration roller 33*a* is raised away from the lower registration roller 33*b* against the action of the spring. The roller 33*a* is continuously spaced from the roller 33*b* until the trailing edge of the above sheet P fully moves away from the rollers 33*a* and 33*b*.

Referring again to FIG. 1, the bank sheet feeding section 200 is removably positioned beneath the printer frame 100A via its bank frame 200A. The bank frame 200A accommodates an upper and a lower sheet feeding section 201 and 202 therein. Guides, which will be described, form a lower portion of the vertical transport path RZ. A pair of bank registration rollers 106*a* and 106*b*, a bank registration sensor 135, a pair of intermediate rollers 118*a* and 118*b* and a bank feed sensor 136 are sequentially arranged in this order toward the bottom of the bank frame 200A.

Figure 15:
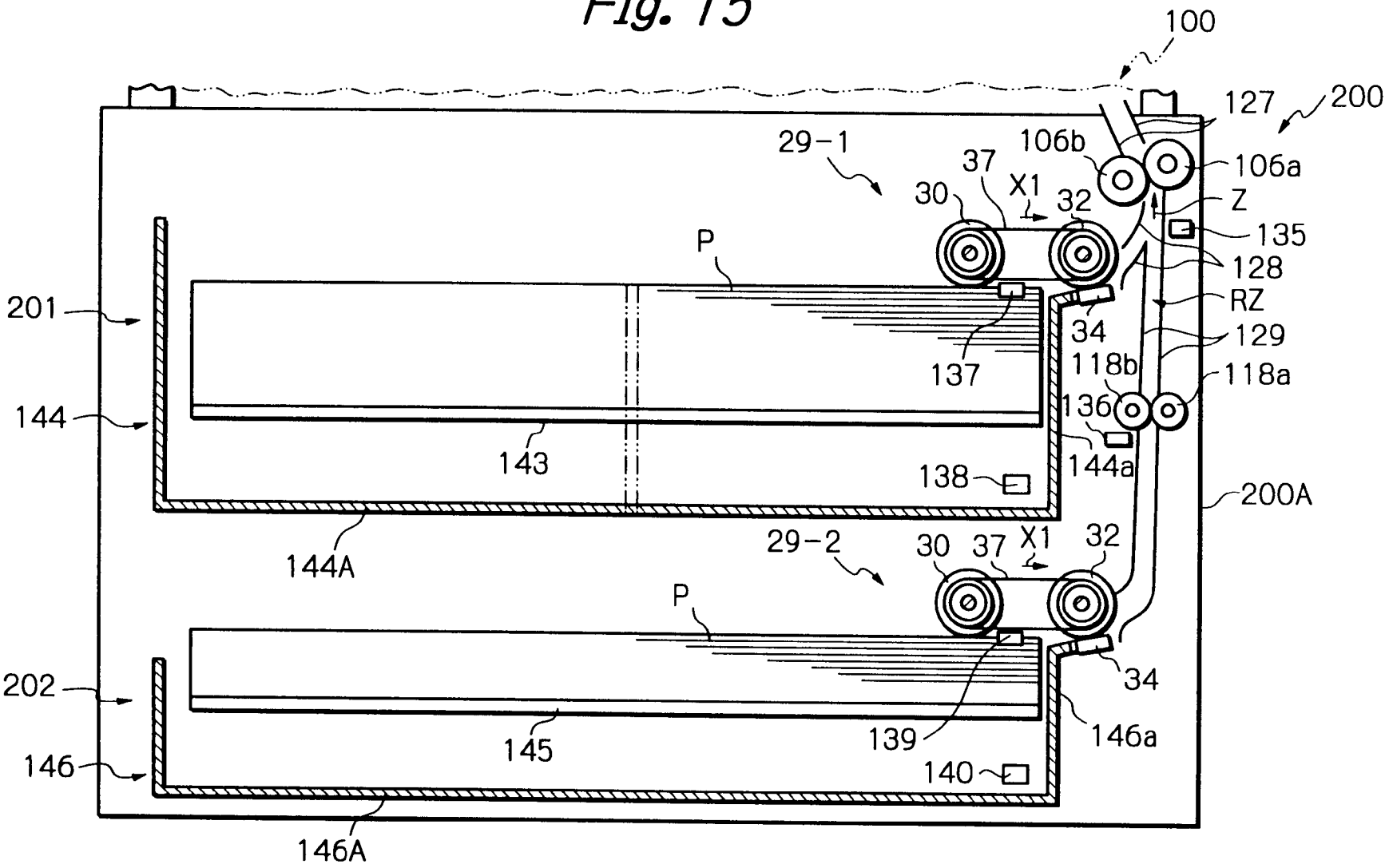
FIG. 15 is a fragmentary front sectional view showing the bank sheet feeding section.

As shown in FIGS. 1 and 15, the upper sheet feeding section 201 includes an upper tray unit 144 including a tray 143 and raising and lowering means. The raising and lowering means causes the tray 143 to move, in a horizontal position, up and down between an upper limit position locating the top of a sheet stack P loaded thereon at a sheet feed position and a lower limit position. An upper limit sensor 137 is responsive to the upper limit position of the top of the sheet stack P. A lower limit sensor 138 is responsive to the lower limit position of the tray 143. Sheet feeding means 29-1 feeds the top sheet P from the tray 143 while separating it from the underlying sheets P. A sheet size sensing mechanism includes the sensor group 50-1 stated earlier.

The upper tray 143 is implemented by sheet metal and forms a part of the tray unit 144 which is removable from the bank frame 200A via the front end of the frame 200A in the direction perpendicular to a direction of sheet feed X1, i.e., perpendicular to the sheet surfaces of FIGS. 1 and 15. The upper tray unit 144 includes a casing 144A on which the upper tray 143 is mounted together with other structural parts. The casing 144A includes a front wall 144*a* for positioning the front edge of the sheet stack P below the sheet feeding means 29-1.

In the illustrative embodiment, the tray 143 is expected to be loaded with sheets P of size A3 or A4 and up to 1,000 sheets in terms of plain papers. Of course, sheets of any other size can be stacked on the tray 143, as needed.

Alternatively, the upper tray unit 144 may be implemented as a sheet feeding device taught in any one of Japanese Patent Laid-Open Publication Nos. 5-124737, 5-221536, 6-144600 and 7-137851 mentioned earlier. Sheet feeding devices disclosed in these documents each use a front loading system which allow the operator to perform various operations including a sheet replenishing operation, standing at the front of the device. In addition, the devices each selectively effect tandem sheet feed allowing sheets to be replenished without interrupting sheet feed under way or non-tandem sheet feed.

Use may also be made of a sheet feeding device taught in Japanese Patent Application No. 10-199188 and having the following construction. A first tray is movable up and down with a stack of sheets. Sheet feeding means sequentially feeds the sheets from the first tray in a preselected direction. A second tray is positioned substantially parallel to the first tray in the horizontal direction and loaded with a stack of sheets. Shifting means is capable of shifting the entire sheet stack from the second tray to the first tray. Sheets greater in size than at least the sheets to be stacked on the first tray or the second tray can be stacked over the first and second trays and fed by the above sheet feeding means. Raising and lowering means causes the first tray to move up and down in a horizontal position. When the sheets of great size are stacked over the first and second trays, interlocking means raises the second tray in a substantially horizontal position in interlocked relation to at least the elevation of the first tray. In FIGS. 1 and 15, the upper tray unit 144 and tray 143 are shown as being bisected by phantom lines in order to show the outline of the tandem sheet feed.

The sheet feeding means 29-1 includes a pickup roller 30. The upper limit sensor 137 is responsive to the position of the pickup roller 30 where it contacts the top sheet P on the tray 143 with an adequate pressure and pays it out. The sensor 137 is implemented by an interruption type optical sensor made up of a light emitting portion and a light-sensitive portion. The sensor 137 includes a feeler, not shown, affixed to the arm 35A, FIG. 4, and angularly movable to contact the top sheet P. An interrupter, not shown, is interlocked to the feeler and selectively interrupts the optical path between the light emitting portion and the light-sensitive portion. The sensor 137 is mounted on the bank frame 200A in the vicinity of the pickup roller 30. The sensor 137 may be identical in configuration with, e.g., an optical sensor PS2 shown in FIG. 3 of Laid-Open Publication No. 2-265825 mentioned earlier.

The lower limit sensor 138 is located at a preselected position in the bank frame 200A and implemented by a reflection type optical sensor made up of a light emitting portion and a light-sensitive portion. While the light emitting portion emits light toward one side wall of the tray 143, the light-sensitive portion receives the resulting reflection from the side wall.

As shown in FIGS. 1 and 15, a lower sheet feeding section 202 includes a lower tray unit 146 including a tray 145 and raising and lowering means. The raising and lowering means causes the tray 145 to move, in a horizontal position, up and down between an upper limit position locating the top of a sheet stack P loaded thereon at a sheet feed position and a lower limit position. An upper limit sensor 139 is responsive to the upper limit position of the top of the sheet stack P. A lower limit sensor 140 is responsive to the lower limit position of the tray 145. Sheet feeding means 29-2 feeds the top sheet P from the tray 145 while separating it from the underlying sheets P. A sheet size sensing mechanism includes the sensor group 50-2 stated earlier.

The lower tray 145 is implemented by sheet metal and forms a part of the lower tray unit 146 which is removable from the bank frame 200A via the front end of the frame 200A in the direction perpendicular to a direction of sheet feed X1, i.e., perpendicular to the sheet surfaces of FIGS. 1 and 15. The lower tray unit 146 includes a casing 146A on which the tray 145 is mounted together with other structural parts. The casing 146A includes a front wall 146*a* for positioning the front edge of the sheet stack P be low the sheet feeding means 29-2.

In the illustrative embodiment, the tray 145 is expected to be loaded with sheets P of size A3 or A4 and up to 500 sheets in terms of plain papers. Of course, sheets of any other size can be stacked on the tray 145, as needed.

The sheet feeding means 29-2 also includes a pickup roller 30. The upper limit sensor 139, like the upper limit sensor 137, is responsive to the position of the pickup roller 30 where it contacts the top sheet P on the tray 145 with an adequate pressure and pays it out. The sensor 139 is mounted on the bank frame 200A in the vicinity of the pickup roller 30.

The lower limit sensor 140 is located at a preselected position in the bank frame 200A and senses the lower limit position of the tray 145 with the same configuration and operation with the lower limit sensor 138.

Figures 19, 19A:
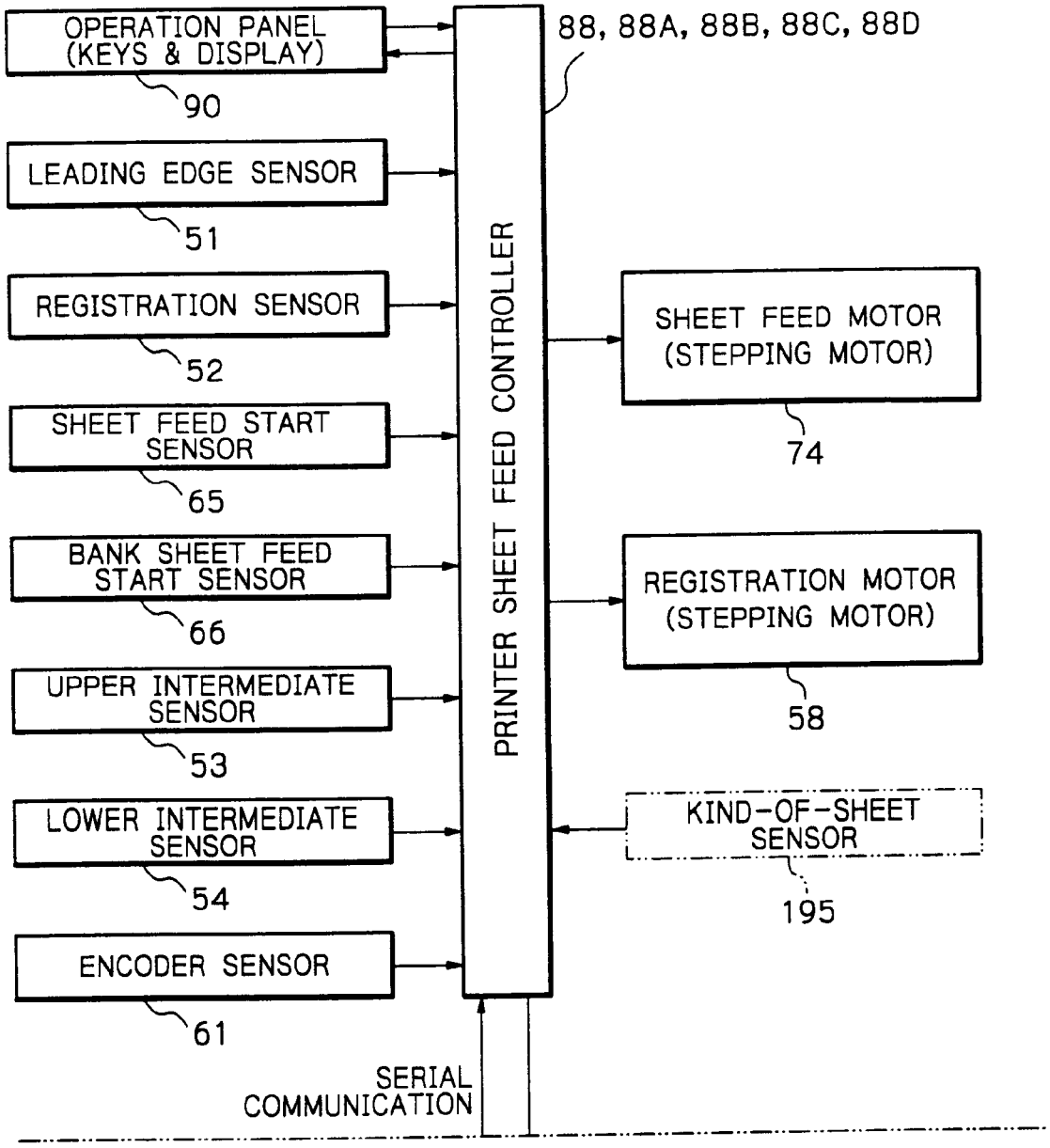
FIG. 19 is a block diagram schematically showing a sheet feed control system with which a first to a third embodiment of the present invention are practicable.
Figure 19B:
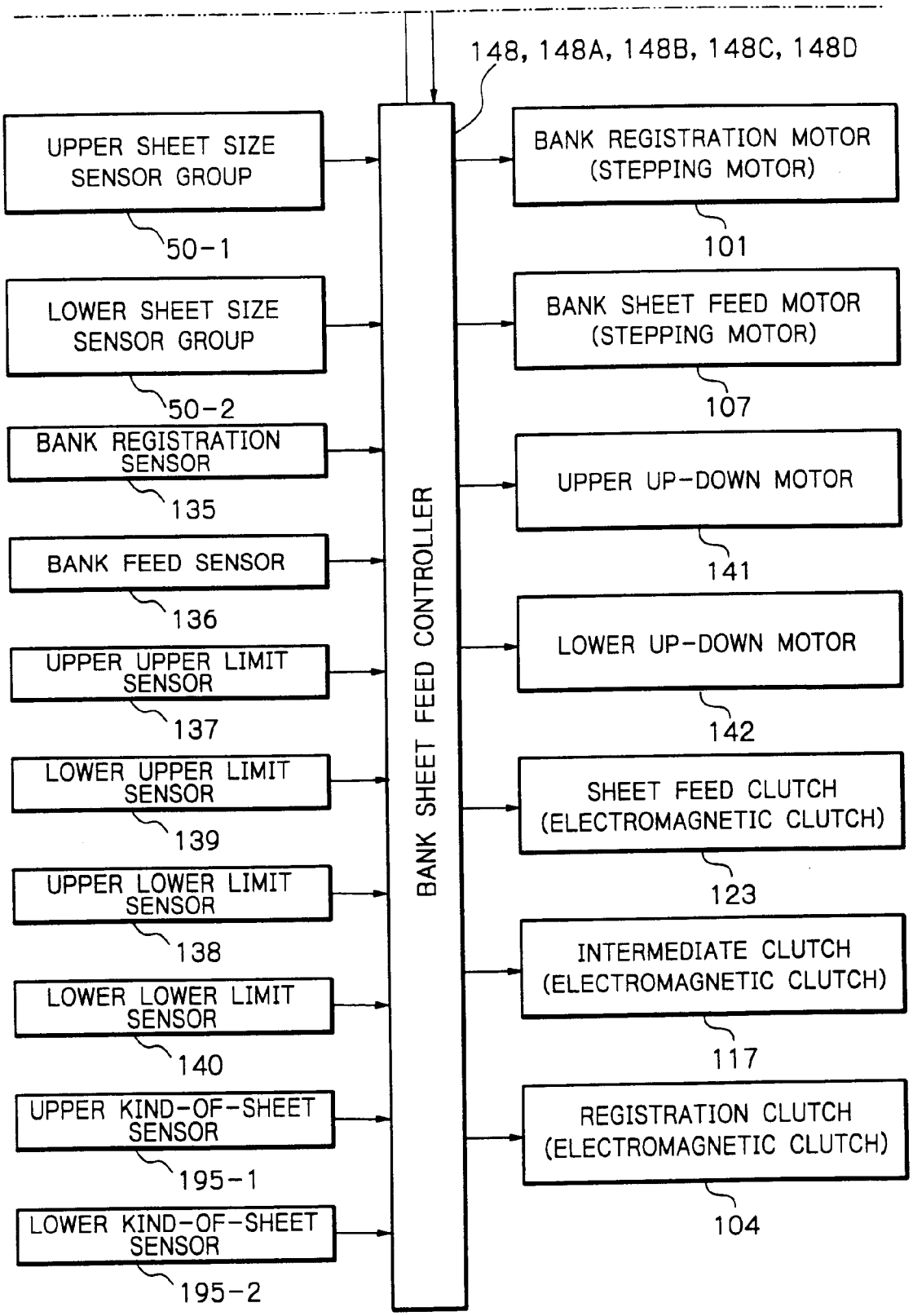

The raising and lowering means included in the upper sheet feeding means 201 is driven by an upper up-down motor 141 shown only in FIG. 19 and may be implemented by a wire type elevation mechanism shown in, e.g., FIGS. 3 and 4 of Laid-Open Publication No. 6-40137 mentioned earlier. The raising and lowering means included in the lower sheet feeding means 202 is driven by a lower up-down motor 142 also shown only in FIG. 19 via a wire type elevation mechanism. The up-down motors 141 and 142 are implemented by DC motors. Of course, use may be made of a pantograph type elevation mechanism using X arms and taught in Laid-Open Publication No. 10-199188 mentioned earlier.

The auxiliary sheet feeding section 28 also includes raising and lowering means similar to the above raising and lowering means and sensors similar to the upper limit sensor 139 and lower limit sensor 140.

As shown in FIG. 15, the lower portion of the vertical transport path RZ includes a pair of guides 127 respectively connectable to the guide 40 and intermediate guide 42 of the printer body 100A. A pair of upper guides 128 guide the sheet P paid out from the sheet feeding means 29-1 of the upper sheet feeding section 201.

A pair of lower guides 129 are branched off the upper guides 128 and extend downward for guiding the sheet P paid out from the sheet feeding means of the lower sheet feeding section 202.

The bank registration rollers 106*a* and 106*b* are positioned on the vertical transport path PZ downstream of the sheet feeding means 29-1 and 29-2 in the direction of vertical sheet feed Z. The rollers 106*a* and 106*b* feed the leading edge of the sheet P toward the registration rollers 33*a* and 33*b* disposed in the printer body at a preselected timing. The rollers 106*a* and 106*b* are unique to the bank sheet feeding section 200 and used to obviate the skew, crease and lateral misregistration of the sheet P ascribable to the long transport path to the registration rollers 33*a* and 33*b*. The rollers 106*a* and 106*b* are different from the rollers 33*a* and 33*b* in that they slightly bite the leading edge of the sheet P fed thereto in order to prevent it from falling due to its own weight. Another difference is that the rollers 106*a* and 106*b* are constantly held in contact with each other by a spring not shown.

The bank registration sensor 135 is positioned on the path RZ upstream of the bank registration rollers 106*a* and 106*b* and implemented by a reflection type sensor made up of a light emitting portion and a light-sensitive portion. The sensor 135 senses the leading edge and trailing edge of the sheet P to thereby determine whether or not the sheet P has reached the registration rollers 106*a* and 106*b* within a preselected period of time. Also, the sensor 135 serves to detect a sheet jam occurred on the path RZ upstream of the registration rollers 106*a* and 106*b*. In addition, the sensor 135 joins in the adjustment of a loop which the sheet P fed from the sheet feeding means 29-1 or the intermediate rollers 118*a* and 118*b* forms on abutting against the portion just upstream of the nip between the registration rollers 106*a* and 106*b*.

The intermediate rollers 118*a* and 118*b* are positioned on the path RZ between the sheet feeding means 29-1 and 29-2 for conveying the sheet P paid out from the sheet feeding means 29-2 to the downstream side of the path RZ. The bank feed sensor 136 is positioned on the path RZ upstream of the intermediate rollers 118*a* and 118*b* and implemented by a reflection type optical sensor made up of a light emitting portion and a light-sensitive portion. By sensing the leading edge and trailing edge of the sheet P, the sensor 136 determines whether or not the leading edge of the sheet P has reached the intermediate rollers 118*a* and 118*b* within a preselected period of time. In addition, the sensor 136 detects a sheet jam occurred on the path RZ between the sheet feeding means 29-2 and the intermediate rollers 118*a* and 118*b*.

As stated above, the sheet feeding means 29-1 and intermediate rollers 118*a* and 118*b* play the role of bank sheet feeding means for feeding the leading edge of the sheet P toward the bank registration rollers 106*a* and 106*b* and causing it to form a loop on abutting against the rollers 106*a* and 106*b*.

Figure 16:
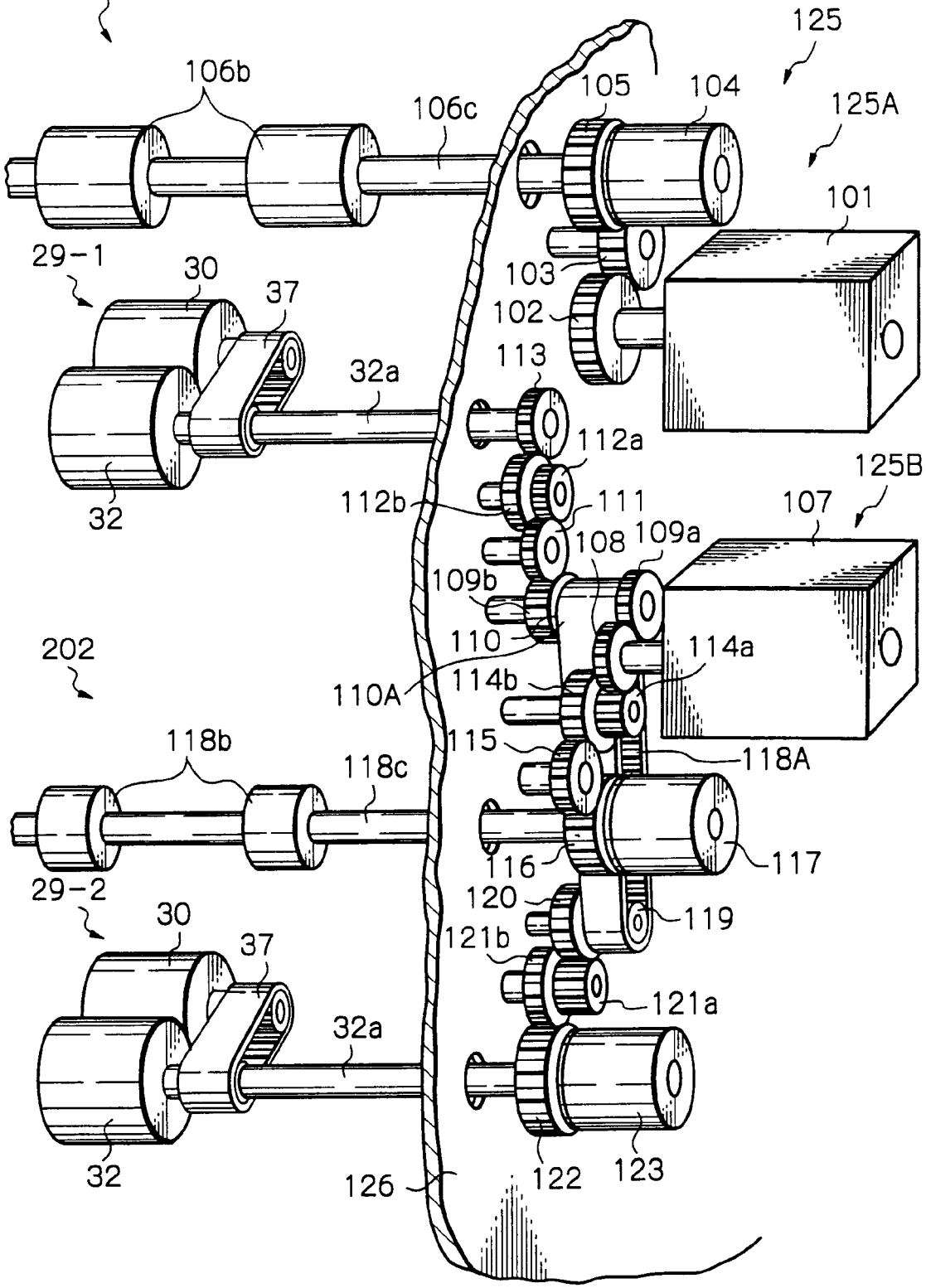
FIG. 16 is a fragmentary isometric view showing a sheet feed drive mechanism included in the bank sheet feeding section.

FIG. 16 shows a bank sheet feed drive mechanism 125 for causing the sheets P to be sequentially fed from the bank sheet feeding section 200. As shown, the sheet feed drive mechanism 125 includes a bank registration roller drive mechanism 125A for driving the bank registration rollers 106*a* and 106*b*. A sheet feeding section drive mechanism 125B selectively drives the pickup roller 30 and a separation roller 32 included in the upper sheet feeding means 29-1, the intermediate rollers 118*a* and 118*b* or the pickup roller 30 and a separation roller 32 included in the lower sheet feeding means 29-2. It is to be noted that the directions of rotation of the various structural elements to be described hereinafter are the directions as seen from the right in FIG. 16.

The bank registration roller drive mechanism 125A includes a reversible bank registration motor or bank registration drive means 101 for driving the bank registration rollers 106*a* and 106*b*. A gear train for transmitting the rotation of the motor 101 to the shaft 106*c* of the registration roller 106*b* includes a drive gear 102 mounted on the output shaft of the motor 101, an idle gear 103 meshing with the drive gear 102, and a driven gear 105 meshing with the idle gear 103. A registration clutch 104 is interposed between the driven gear 105 and the above shaft 106*c* for selectively interrupting the transfer of the rotation of the motor 101 transmitted to the driven gear 105.

The motor 101 is implemented by a stepping motor. The idle gear 103 is journalled to a bank side wall 126. The shaft 106*c* of the registration roller 106*b* is rotatably supported by the side wall 126 via a roller bearing not shown. The registration clutch 104 is implemented by an electromagnetic clutch.

The sheet feeding section drive mechanism 125B includes a reversible bank sheet feed motor 107 for selectively driving the separation roller 32 and pickup roller 30 of the upper sheet feeding means 29-1 or those of the lower sheet feeding means 29-2 or the intermediate rollers 118*a* and 118*b*. An upper gear train, which will be described later, transfers the forward rotation (clockwise) of the motor 107 to the shaft 32*a* of the separation roller 32 of the upper sheet feeding means 29-1. A one-way clutch 110A interposed between intermediate gears 109*a* and 109*b* and a drive pulley 110 coaxial with the gears 109*a* and 109*b*. The one-way clutch 110A transfers clockwise rotation when coupled. An intermediate gear train, which will also be described later, transmits the reverse rotation (counterclockwise) of the motor 107 to the shaft 118*c* of the intermediate roller 118*b*. An intermediate clutch 117 is interposed between the shaft 118*c* of the intermediate roller 118*b* and the driven gear 116 for selectively interrupting the transfer of the rotation of the motor 107. A timing belt 118A is passed over the drive pulley 110 and driven pulley 119. A lower gear train, which will also be described later, transmits the reverse rotation (counterclockwise) of the motor 107 to the shaft 32*a* of the separation roller 30 of the lower sheet feeding means 29-2. A sheet feed clutch 123 is interposed between the shaft 32*a* of the separation roller 32 of the lower sheet feeding means 29-2 for selectively interrupting the transfer of the rotation of the motor 107.

As stated above, the motor 107 selectively plays the role of bank sheet conveyance drive means or bank sheet feed drive means independent of the driveline assigned to the ink drum 1. The bank sheet conveyance drive means drives the upper sheet feeding means 29-1 and intermediate rollers 118*a* and 118*b*. The bank sheet feed drive means drives the separation roller 32 and pickup roller 30 of the upper sheet feeding means 29-1 or those of the lower sheet feeding means 29-2. In addition, the motor 107 drives the sheet feeding means 29-1 or the intermediate rollers 118*a* and 118*b* in accordance with the desired print speed input on the print speed keys 96. Specifically, if the desired print speed is higher than the previously mentioned standard print speed, the motor 107 causes the upper sheet feeding means 29-1 or the intermediate rollers 118*a* and 118*b* to convey the sheet P at a speed matching with the desired print speed. If the desired print speed is lower than the standard speed, the motor 107 causes the sheet feeding means 29-1 or the rollers 118*a* and 118*b* to convey the sheet P at a speed matching with the standard print speed.

The upper gear train includes a drive gear 108 mounted on the output shaft of the motor 107. An intermediate gear 109*a* is held in mesh with the drive gear 108. A drive pulley 110 and an intermediate gear 109*b* are coaxial with the intermediate gear 108. An idle gear 111 is held in mesh with the intermediate gear 109*b*. A small diameter idle gear 112*a* is held in mesh with the idle gear 111. A large diameter idle gear 112*b* is coaxial with the idle gear 112*a*. A driven gear 113 is mounted on the end of the shaft 32*a* of the separation roller 32 included in the upper sheet feeding means 29-1 and held in mesh with the above idle gear 112*b*.

The intermediate gears 109*a* and 109*b*, idle gear 111, small diameter idle gear 112*a* and large diameter idle gear 112*b* each are journalled to the bank side wall 126 via a respective shaft. The shaft 32*a* of the separation roller 32 of the upper sheet feeding means 29-1 is journalled to the bank side wall 1265 via a roller bearing not shown.

The intermediate gear train includes a small diameter idle gear 114*a* meshing with the drive gear 108, a large diameter idle gear 114*b* coaxial with the idle gear 114*a*, an idle gear 115 meshing with the idle gear 114*b*, and a driven gear 116 mounted on the end of the shaft 118*c* of the intermediate roller 118*b* and meshing with the idle gear 115. The small diameter idle gear 114*a*, large diameter idle gear 114*b* and idle gear 115 each are journalled to the bank side wall 126 via a respective shaft. The shaft 118*c* of the intermediate roller 118*b* is journalled to the bank side wall 1265 via a roller bearing not shown.

The lower gear train includes an intermediate gear 120 coaxial with the driven pulley 119, a small diameter idle gear 121*a* meshing with the intermediate gear 120, a large diameter idle gear 121*b* coaxial with the idle gear 121*a*, and driven gear 122 mounted on the end of the shaft 32*a* of the separation roller 32 of the lower sheet feeding means 29-2 and meshing with the idle gear 121*b*. The intermediate gear 120, small diameter idle gear 121*a* and large diameter idle gear 121*b* each are journalled to the bank side wall 126 via a respective shaft. The shaft 32*a* of the separation roller 32 of the lower sheet feeding means 29-2 is journalled to the bank side wall 126 via a roller bearing not shown.

The intermediate clutch 117 and sheet feed clutch 123 are electromagnetic clutches.

The sheet feeding section drive mechanism 125B is operated as follows. To feed the sheet P from the upper sheet feeding means 29-1, the motor 107 is rotated, e. g., clockwise in FIG. 16. The rotation of the motor 107 is transferred to the shaft 32*a* of the separation roller 32 of the upper sheet feeding means 29-1 via the upper gear train. As a result, the shaft 32*a* and therefore the separation roller 32 and pickup roller 30 are rotated clockwise, as described with reference to FIGS. 3 and 4. The separation roller 32 and pickup roller 30 cooperate to pay out only the top sheet P from the tray 143. At this instant, the intermediate gear 109*a* is rotated counterclockwise, so that only the shafts of the intermediate gears 109*a* and 109*b* rotate counterclockwise due to the action of the one-way clutch 110A. Therefore, the rotation of the motor 107 is not transmitted to the drive pulley 110.

To feed the sheet P from the lower sheet feeding means 29-2, the motor 107 is rotated in the opposite direction, e.g., counterclockwise in FIG. 16. Then, the intermediate gear 109*a* is rotated clockwise with the result that the shafts of the intermediate gears 109*a* and 109*b* and drive pulley 110 are integrally rotated clockwise due to the action of the one-way clutch 110A. In this condition, the rotation of the motor 107 causes the shaft 32*a* of the separation roller 32 of the lower sheet feeding means 29-2 to rotate clockwise via the lower gear train. Consequently, the separation roller 32 and pickup roller 30 rotate clockwise, as described with reference to FIGS. 3 and 4. At the same time, the intermediate gears 109*a* and 109*b* are rotated clockwise with the result that the shaft 32*a* of the separation roller 32 of the upper sheet feeding means 29-1 tends to rotate counterclockwise via the upper gear train. However, the one-way clutch 67 causes only the shaft 32*a* to rotate and prevents the rotation from being transferred to the pulley 32A. This prevents the rotation of the motor 107 from being transmitted to the separation roller 32 or the pickup roller 30.

Arrangements for sheet feed control included in the illustrative embodiment in addition to the above sensors and motors will be described hereinafter with reference to FIGS. 2–19. As shown in FIG. 2 and 7, interrupters 68 and 69 for printer sheet feed and printer registration, respectively, are fastened to the outer surface of the rear end wall 20*b* of the press drum 20 by screws. The interrupters 68 and 69 are spaced by a preselected distance in the circumferential direction of the ink drum 20. In addition, interrupters 70 and 71 for bank sheet feed and bank registration, respectively, are fastened to the above surface of the rear end wall 20*b* by screws and spaced by a preselected distance from each other. The interrupters 70 and 71 are positioned on a circle radially inward of a circle on which the interrupters 68 and 69 are positioned. The interrupters 68–71 each are formed of, e.g., stainless steel or similar sheet metal or synthetic resin and is generally L-shaped in a front view and a side elevation; the end of the letter "L" protrudes to the rear.

As shown in FIGS. 2, 7 and 11, a sheet feed start sensor 65 and a bank sheet feed start sensor 66 are fastened to a sensor bracket 64 by screws 63. The sheet feed start sensor 65 faces the circle of the press drum 20 on which the printer sheet feed interrupter 68 and printer registration interrupter 69 are positioned. The bank sheet feed start sensor 66 faces the circle of the press drum 20 on which the bank sheet feed interrupter 70 and bank registration interrupter 71 are positioned. The sensors 65 and 66 are transmission type optical sensors each having a light emitting portion and a light-sensitive portion.

The printer sheet feed interrupter 68 interrupts the optical path of the sheet feed start sensor 65 when the press drum 20 i s rotated counterclockwise to a preselected position. These interrupter 68 and sensor 65 constitute sheet feed timing sensing means for determining the time when the sheet feeding means 29 of the auxiliary sheet feeding section 28 should pay out the leading edge of the top sheet P toward the registration rollers 33*a* and 33*b*. As shown in FIG. 20, in the illustrative embodiment, the above preselected position of the press drum 20, i.e., the position of the interrupter 68 on the press drum 20 is such that the sensor 65 turns on when the press drum 20 is rotated counterclockwise to an angular position θ' of 194°. At this instant, the registration roller moving mechanism stated earlier moves the upper registration roller 33*a* away from the lower registration roller 33*b*. In this condition, the bias of the spring does not act on the sheet P.

The printer registration interrupter 69 interrupts the optical path of the sheet feed sensor 65 when the press drum 20 is rotated counterclockwise to a preselected position. These interrupter 69 and sensor 65 constitute timing sensing means for determining the time when the registration rollers 33*a* and 33*b* should drive the leading edge of the sheet P toward the sheet clamper 21 of the press drum 20. The above preselected position of the press drum 20, i.e., the position of the interrupter 69 on the press drum 20 is such that the sensor 65 turns on when the press drum 20 is rotated counterclockwise to an angular position θ' of 307°.

The bank sheet feed interrupter 70 interrupts the optical path of the bank sheet feed start sensor 66 when the press drum 20 is rotated counterclockwise to a preselected position. These interrupter 70 and sensor 66 serve as bank sheet feed timing sensing means for determining the time when the upper sheet feeding means 29-1 or the lower sheet feeding means 29-2 should pay out the leading edge of the sheet P. As shown in FIG. 20, in the illustrative embodiment, the above preselected position of the press drum 20, i.e., the position of the interrupter 70 on the press drum 20 is such that the sensor 66 turns on when the press drum 20 is rotated counterclockwise to an angular position θ' of 0° (home position of the press drum 20).

The bank registration interrupter 71 interrupts the optical path of the bank sheet feed start sensor 66 when the press drum 20 is rotated counterclockwise to a preselected position. These interrupter 71 and sensor 66 constitute bank registration timing sensing means for determining the time when the registration rollers 106*a* and 106*b* should drive the leading edge of the sheet P toward the registration rollers 33*a* and 33*b*. In the illustrative embodiment, the above preselected position of the press drum 20, i.e., the position of the interrupter 71 on the press drum 20 is such that the sensor 66 turns on when the press drum 20 is rotated counterclockwise to an angular position θ' of 104°.

As shown in FIGS. 2, 7 and 8, an encoder 60 is fastened to the rear wall 20*b* of the press drum 20 by screws 63 via two spacers 62. In the illustrative embodiment, the encoder 60 is implemented by a single channel, incremental photo-encoder formed with a number of radial slits, as illustrated. As shown in FIGS. 2, 8 and 11, an encoder sensor 61 is fastened to the inner surface of the arm 25*b* in the vicinity of the encoder 60 via the previously mentioned sensor bracket 64. The encoder sensor 61 sandwiches the peripheral portion of the encoder 60 at a preselected distance. The encoder 60 and encoder sensor 61 constitute a pulse encoder for sensing a change in the rotation speed of the press drum 20 in order to control the time when the registration rollers 33*a* and 33*b* should feed the leading edge of the sheet P toward the sheet clamper 21 of the press drum 20.

As shown in FIGS. 7 and 8, the encoder 60 has the same outside diameter as the press drum 20 although it is shown in a reduced scale in, e.g., FIG. 2 for the sake of illustration. The encoder 61 is not shown in FIG. 7 for the same reason, and the center bracket 64 is not shown in, e.g., FIGS. 2 and 8.

Reference will be made to FIG. 19 for describing an operation panel 90 in detail. The operation panel 90 is mounted above the reading section 3. As shown, the operation panel 90 includes a perforation start key 91 for setting and inputting the start of a sequence beginning with the reading of a document image and ending with the perforation of the stencil 2. Numeral keys 93 allow, e.g., a desired number of printings to be input thereon. A print start key 92 is used to start printing the desired number of printings. An LCD 94 displays various information set or sensed during a procedure beginning with the reading of a document image and ending with printing. A tray selection and sheet size key (sheet size key hereinafter) 98 is used to select and input the sheet size of the auxiliary tray 31, upper tray 143 or lower tray 145. A set key 95 is used to set the above sheet size selected and input or any other information input. A left arrow key 99B is used to select job information appearing on the LCD 94 by shifting it to the left. A right arrow key 99C is used to select the job information by shifting it to the right. Cursor keys 99A, i.e., four shift keys 99A*c*, 99A*a*, 99A*b* and 99A*d* are used to select the job information appearing on the LCD 94 by shifting it rightward, leftward, upward or downward. The print speed keys or print speed setting means 96 mentioned earlier are made up of an UP key 96*b* and a DOWN key 96*a*. A speed indicator 97 is implemented by a group of LEDs (Light Emitting Diodes) for displaying a print speed input on the UP key 96*b* or the DOWN key 96*a*. A kind-of-sheet key or kind-of-sheet setting means 190 is used to set the kind of sheets. LEDs 191 display the kind of sheet input on the key 190 or the kinds of sheets automatically sensed by kind-of-sheet sensors 195, 195-1 and 195-2 which will be described later. The sensors 195, 195-1 and 195-2 are indicated by phantom lines in FIG. 19 and constitute kind-of-sheet sensing means.

Every time the operator presses the sheet size input key 98, "Sheet Size" appearing on the LCD 94 is replaced with "Cancel". In this sense, the key 98 bifunctions as a cancel key 98A for restoring the original picture of the LCD 94.

Figure 18:
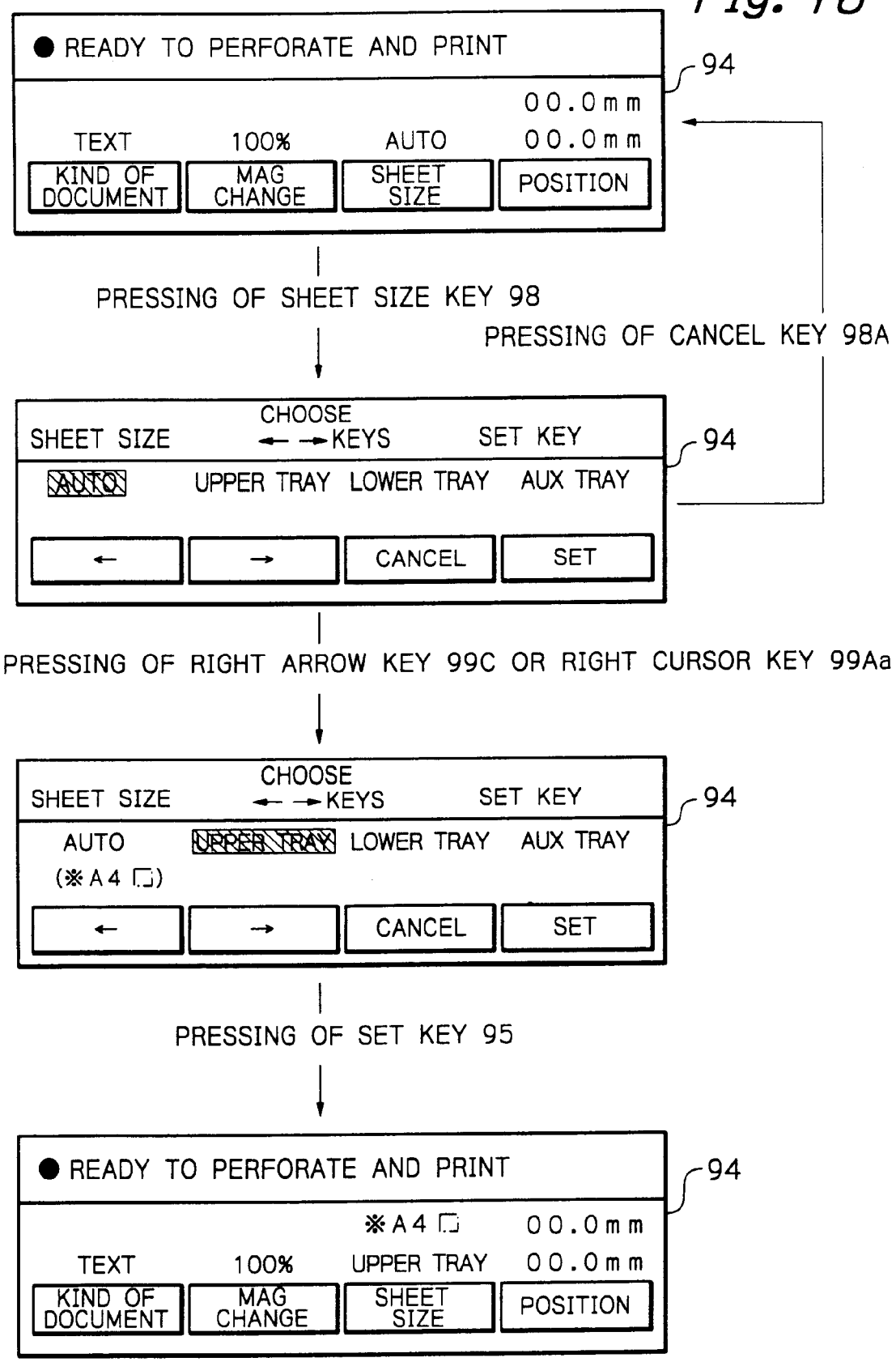
FIG. 18 is a plan view showing specific pictures to appear on an LCD (Liquid Crystal Display) mounted on the operation panel.

A specific picture to appear on the LCD 94 is shown at the top of FIG. 18. As shown, a rectangle appearing at the top of the picture shows a job to be selected by the operator, i.e., a message "Ready to make a master and print." When the operator watching this picture presses the sheet size key 98, the top picture is replaced with a second specific picture shown just below the top or first picture. In the second picture, "Automatic" highlighted is automatically selected, i.e., a sheet size matching with a document size is automatically set; the operator watching this picture may press any desired key. For example, when the operator presses the cancel key 98A, the original picture at the top of FIG. 18 again appears. When the operator presses the right arrow key 99C or the right cursor key 99A*a*, the above second picture is replaced with a third picture shown below the second picture; this picture shows "(*A4E$\sqrt[3]{}$)", i.e., that the sheets P of size A4 stacked on the "Upper Tray (tray 143)" are selected. As the operator watching this picture presses the set key 95, a fourth picture shown below the third picture appears.

Figure 17:
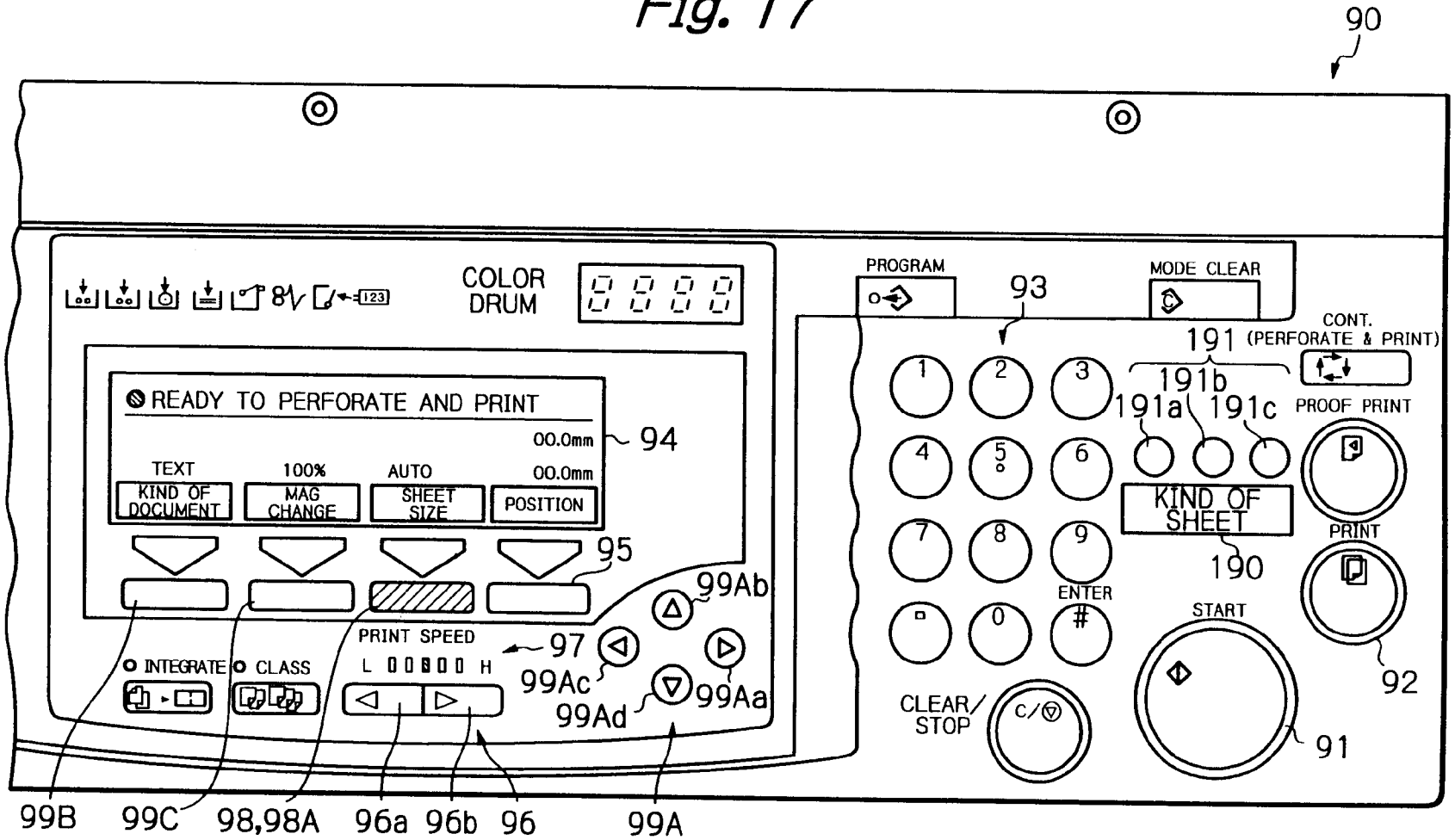
FIG. 17 is a fragmentary plan view of an operation panel included in the illustrative embodiment.

In the speed indicator 97, the center LED indicated by hatching is representative of "set print speed: third" which is the standard print speed usually used. This print speed is automatically set if the operator does not press the DOWN key 96*a* or the UP key 96*b*. In the illustrative embodiment, the leftmost LED to the rightmost LED, as viewed in FIG. 17, are respectively representative of "set print speed: first" which is the lowest speed of 60 printings/min or 60 rpm (revolutions per minute), "set print speed: second" which is a speed of 75 printings/min or 75 rpm, "set print speed: third" which is a speed of 90 printings/min or 90 rpm, "set print speed: fourth" which is a speed of 105 printings/min or 105 rpm, and "set print speed: fifth" which is the highest speed of 120 printings/min or 120 rpm.

A print speed assigned to trial printing and which does not appear on the speed indicator 97 (trial print speed hereinafter) will be briefly described. Trial printing, as distinguished from regular printing to occur just after master making, is effected to fill up the perforations of the master 2 wrapped around the ink drum 1 with ink and cause the master 2 to closely adhere to the ink drum 1. A printing produced by the trial printing is not dealt with or counted as a regular printing. The LEDs of the speed indicator sequentially turn on every time the DOWN key 96*a* or the UP key 96*b* is pressed, sequentially showing the first to fifth consecutive print speeds. The DOWN key 96*a* and UP key 96*b* adjoin the above LEDs. This allows the operator to surely see the print speed input and set.

The lamps 191, i.e., three lamps 191*a*, 191*b* and 191*c* are respectively representative of plain papers selected, relatively thick sheets selected, and relatively thin sheets selected. Every time the operator presses the kind-of-sheet input key 190, one of the lamps 191*a*–191*c* turns on; the lamp 191*a* turns on when the operator presses the key 190 one time, the lamp 191*b* turns on when the operator presses the key 190 two times, or the lamp 191*c* turns on when the operator presses the key 190 three times. The lamps 191 therefore indicate the kind of sheets selected by the operator or the kinds of sheets sensed by the kind-of-sheet sensors 195, 195-1 and 195-2.

There are shown in FIG. 19 sheet a printer feed controller 88 and a bank sheet feed controller 148 mainly assigned to the printer 100 and bank sheet feeding section 200, respectively. The sheet feed controllers 88 and 148 each are implemented by a microcomputer including a CPU, I/O (Input/Output) ports, a ROM (Read Only Memory), a RAM (Random Access Memory) and a timer interconnected by a signal bus, although not shown specifically. The sheet feed controllers 88 and 148 interchange ON/OFF signals, data signals and command signals with each other by serial communication.

The printer sheet feed controller 88, more specifically its CPU, is electrically connected to the various keys of the operation panel 90 via the input port for receiving key signals therefrom. The controller 88 is electrically connected to the displays and indicators of the operation panel 80 via the output ports for controlling them by sending command signals.

The controller 88 is electrically connected to the leading edge sensor 51 via the input port and receives from the sensor 51 a signal for rotating the sheet feed motor 74 in either one of opposite directions to cause the sheet P to form a loop. Also, the controller 88 is electrically connected to the registration sensor 52 via the input port and receives from the sensor 52 a signal for compensating for the slip of the sheet P on the registration rollers 33*a* and 33*b*.

The controller 88 is electrically connected to the sheet feed start sensor 65 via the input port and receives from the sensor 65 a signal (start signal) for starting driving the sheet feed motor 74 and registration motor 58.

The controller 88 is electrically connected to the bank sheet feed start sensor 66 via the input port and receives from the sensor 66 a signal (start signal) for starting driving the bank sheet feed motor 107 and bank registration motor 101. This signal is transferred from the controller 88 to the other or bank sheet feed controller 148. The sheet feed controller 88 is electrically connected to the upper and lower intermediate sensors 53 and 54 via the input port and receives from the sensors 53 and 54 data signals relating to the leading edge of the sheet P fed from the bank sheet feeding section 200.

The controller 88 is electrically connected to the encoder sensor 61 via the input port and receives from the sensor 61 a pulse signal relating to a change in the rotation speed of the press drum 20. The sheet feed controller 88 is electrically connected to the sensor group 50 (not shown in FIG. 19 for the simplicity of illustration) responsive to the sheet size of the auxiliary tray 31 via the input port. The controller 88 receives from the sensor group 50 data signals relating to the sheet size of the auxiliary tray 31.

The controller 88 is electrically connected to the sheet feed motor 74 via the output port. In response to the output (start signal) of the sensor 65 representative of alignment of the interrupter 68 with the sensor 65, the controller 88 drives the sheet feed motor 74 in the forward direction to thereby feed the leading edge of the sheet P toward the registration rollers 33*a* and 33*b*. In this sense, the controller 88 serves as sheet feed drive control means.

In response to the above signal or ON signal output from the sheet feed start sensor 65, the sheet feed controller 88 so controls the registration motor 58 as to feed the leading edge of the sheet P in synchronism with the arrival of the sheet clamper 21 at its clamp position. Subsequently, in response to the output of the registration sensor 52, the controller 88 so controls the registration motor 58 as to increase the speed and amount of rotation of the registration rollers 33*a* and 33*b* for compensating for the slip of the sheet P on the rollers 33*a* and 33*b* (slip correction hereinafter). In this sense, the controller 88 plays the role of registration drive control means. Specifically, the controller 88 controls the registration motor 58 by varying the number of drive pulses to be sent to the motor 58 as well as their width. After the slip correction, the controller 88 further varies the above pulse width in accordance with the output pulses of the encoder sensor 61 in order to control the motor 58 by feedback control.

Assume that the sheet P is fed from the auxiliary sheet feeding section 28, and that the print speed input on the print speed key 96 (DOWN key 96*a* or UP key 96*b*) is the fourth or fifth speed higher than the standard print speed. Then, in response to a signal representative of the input speed, the sheet feed controller 88 drives the sheet feed motor 74 in the forward direction such that the separation roller 32 and pickup roller 30 of the sheet feeding means 29 feed the sheet P at a speed matching with the input print speed. Assume that the print speed input on the key 96 or the print speed automatically set is lower than the standard speed (third, second or first speed or trial print speed). Then, in response to a signal representative of the print speed, the controller 88 drives the motor 74 in the forward direction such that the above separation roller 32 and pickup roller 30 feed the sheet P at a speed matching with the third or standard speed.

Assume that the sheet P is fed from the bank sheet feeding section 200. If the print speed input on the DOWN key 96*a* or the UP key 96*b* is higher than the standard speed (fourth or fifth speed), then, in response to a signal representative of the input speed, the controller 88 drives the motor 74 in the reverse direction such that the intermediate rollers 55*a* and 55*b* convey the sheet P at a speed matching with the input print speed. If the print speed input on the key 96*a* or 96*b* or the automatically set print speed is lower than the standard speed (third, second or first speed or trial print speed), then, in response to a signal representative of the above speed, the controller 88 drives the motor 74 in the reverse direction such that the rollers 55*a* and 55*b* convey the speed P at a speed matching with the standard or third speed.

When the sheet P is fed from the auxiliary sheet feeding section 28, the controller 88 drives the sheet feed motor 74 in the forward direction in response to the output of the leading edge sensor 51. The motor 74 causes the leading edge of the sheet P to abut against the registration roller pairs 33*a* and 33*b* and form a preselected loop.

Further, when the sheet P is fed from the bank sheet feeding section 200, the controller 88 drives the above motor 74 in the reverse direction in response to the output of the leading edge sensor 51. The motor 74 causes the leading edge of the sheet P to abut against the registration rollers 33*a* and 33*b* and form a preselected loop.

On the other hand, the bank sheet feed controller 148 assigned to the bank sheet feeding section 200 is electrically connected to the upper and lower size sensor groups 50-1 and 50-2 of the bank 200 via its input port. The controller 148 transfers size signals output from the sensor groups 50-1 to 50-2 to the sheet feed controller 88 assigned to the printer 100.

The controller 148 is electrically connected to the bank registration sensor 135 and bank feed sensor 136 via the input port and receives therefrom data signals relating to the leading edge of the sheet P.

The controller 148 is electrically connected to the upper limit sensor 137 and lower limit sensor 138 associated with the upper the sheet P at a speed matching with the third or standard speed.

Assume that the sheet P is fed from the lower sheet feeding section 202, and that the print speed input on the key 96*a* or 96*b* is higher than the standard speed (fourth or fifth speed). Then, in response to a signal representative of the above speed and transferred from the printer sheet feed controller 88, the controller 148 drives the motor 107 in the reverse direction such that the separation roller 32 and pickup roller 30 of the lower sheet feeding means 29-2 and intermediate rollers 118*a* and 118*b* convey the sheet P at a speed matching with the input print speed. If the input print speed or the automatically set print speed is lower than the standard speed (third, second or first speed or trial print speed), then, in response to a signal representative of the above speed and transferred from the printer sheet feed controller 88, the controller 148 drives the motor 107 in the reverse direction such that the above separation roller 32, pickup roller 30 and intermediate rollers 118*a* and 118*b* convey the sheet P at a speed matching with the third or standard speed.

Assume that the sheet P is fed from the tray 143 of the upper sheet feeding section 201. Then, in response to the output of the bank registration sensor 135, the controller 148 drives the motor 107 in the forward direction. The motor 107 causes the leading edge of the sheet P fed by the separation roller 32 and pickup roller 30 of the sheet feeding means 29-1 to abut against the registration rollers 106*a* and 106*b* and form a preselected loop. Assume that the sheet P is fed from the tray 145 of the lower sheet feeding section 202. Then, sheet feeding section via the input port and receive therefrom ON/OFF signals relating to the upper and lower limit positions of the upper tray 143. Likewise, the controller 148 is electrically connected to the upper limit sensor 139 and lower limit sensor 140 associated with the lower sheet feeding section via the input port and receive therefrom ON/OFF signals relating to the upper and lower limit positions of the lower tray 145. With the signals received from the sensors 139 and 140, the controller 148 controls the lower up-down motor 142.

The controller 148 is electrically connected to the bank sheet feed motor 107 via the output port. Assume that the sheet P is fed from the upper sheet feeding section 201, and that the print speed input on the DOWN key 96*a* or the UP key 96*b* is higher than the standard speed (fourth or fifth speed). Then, in response to a signal representative of the input print speed and transferred from the printer sheet feed controller 88, the controller 148 drives the bank sheet feed motor 107 in the forward direction such that the separation roller 32 and pickup roller 30 of the sheet feeding means 29-1 convey the sheet P at a speed matching with the input print speed. Assume that the input print speed or the automatically set print speed is lower than the standard speed (third, second or first speed or trial print speed). Then, in response to a signal representative of the above speed and transferred from the printer sheet feed controller 88, the controller 148 drives the motor 107 in the forward direction such that the above separation roller 32 and pickup roller 30 convey in response to the output of the registration sensor 135, the controller 148 drives the motor 107 in the reverse direction. The motor 107 causes the leading edge of the sheet P fed by the intermediate rollers 118*a* and 118*b* to abut against the registration rollers 106*a* and 106*b* and form a preselected loop.

In response to the output of the bank sheet feed start sensor 66 received via the printer sheet feed controller 88, the controller 148 so drives the motor 107 as to feed the leading edge of the sheet P toward the registration rollers 106*a* and 106*b*. In this sense, the controller 148 plays the role of bank sheet feed drive control means.

The controller 148 is electrically connected to the bank registration motor 101 via the output port. In response to a signal (start signal) transferred from the printer sheet feed controller 88, the controller 148 so controls the motor 101 as to feed the leading edge of the sheet P toward the registration rollers 33*a* and 33*b*. The controller 148 therefore serves as bank registration drive control means.

The controller 148 is electrically connected to the upper up-down motor 141 via the output port. In response to ON/OFF signals received from the upper limit sensor 137 and lower limit sensor 138 of the upper sheet feeding section, the controller 148 drives the motor 141 so as to move the upper tray 143 up or down. Likewise, the controller 148 is electrically connected to the lower up-down motor 142. In response to ON/OFF signals output from the upper limit sensor 139 and lower limit sensor 140 of the lower sheet feeding section, the controller 148 drives the lower up-down motor 142 so as to move the lower tray 145 up or down.

The controller 148 is electrically connected to the registration clutch 104 via the output port and selectively couples or uncouples it, i.e., sets up or interrupts the transmission of the output of the bank registration roller 101. Likewise, the controller 148 is electrically connected to the intermediate clutch 117 via the output port and selectively couples or uncouples it, i.e., sets up or interrupts the transmission of the output of the bank sheet feed motor 107. Further, the controller 148 is electrically connected to the sheet feed clutch 123 and selectively turns couples or uncouples it, i.e., sets up or interrupts the transmission of the output of the motor 107.

Figure 21A:
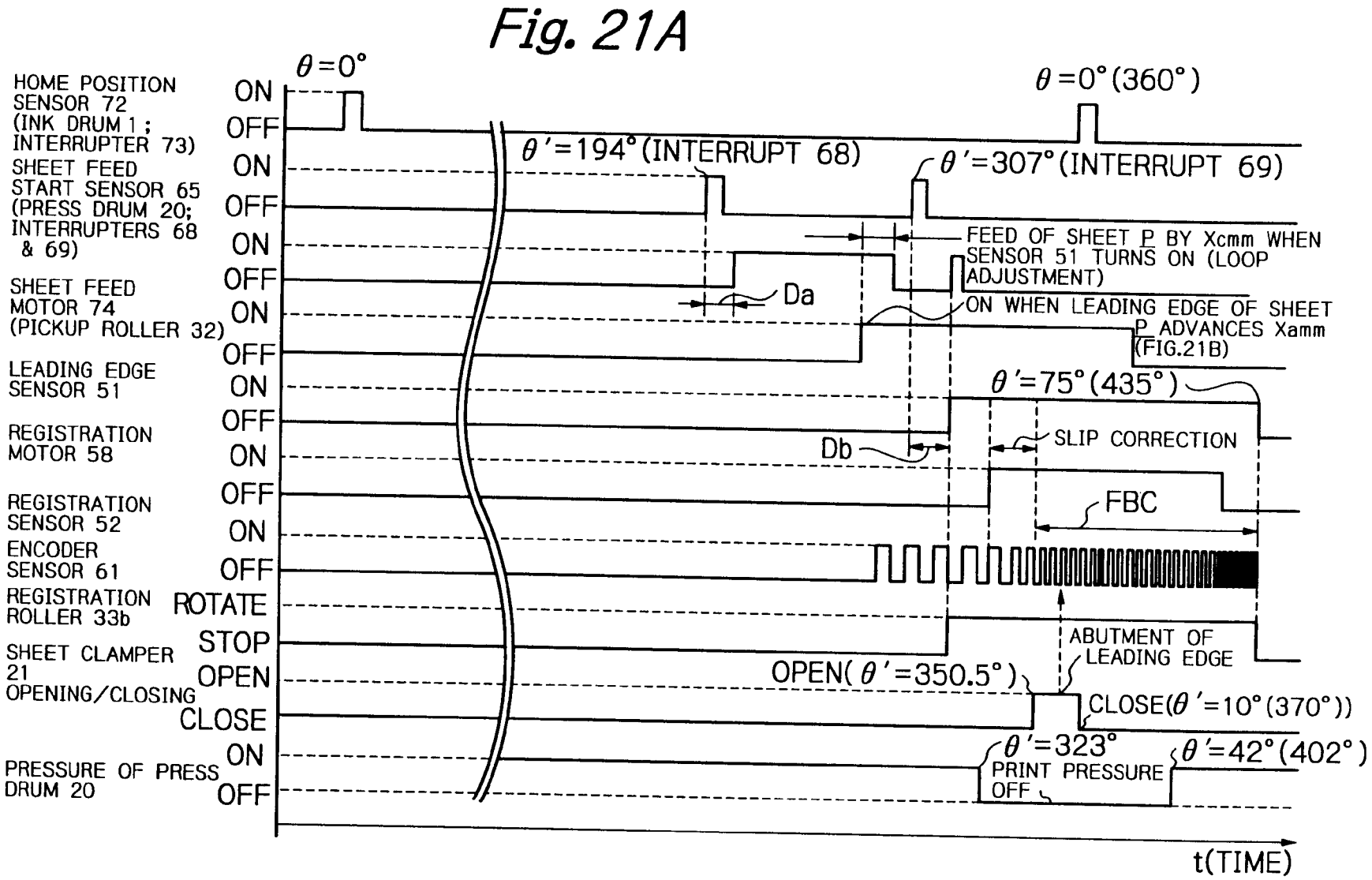
FIG. 21A is a timing chart representative of the feed of a sheet from the auxiliary sheet feeding section in accordance with the first embodiment.
Figure 21B:
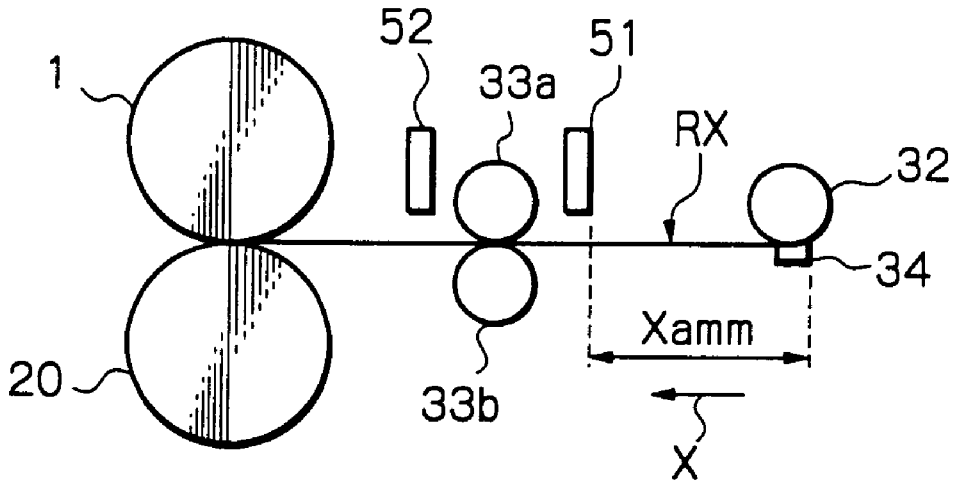
FIGS. 21B and 21C are views associated with FIG. 21A and showing the auxiliary sheet feeding section.

The ROM of the printer sheet feed controller 88 stores the following various data and operation programs. FIGS. 20 and 21 are timing charts showing the contents of control determined by, e.g., experiments beforehand. FIG. 22 shows the contents of variable control over drive pulses to be fed to the registration motor 58 and also determined by, e.g., experiments beforehand. FIGS. 28–31 are flowcharts demonstrating operation programs. The fixed distance between the leading edge sensor 51 and the nip between the registration rollers 33*a* and 33*b* is also stored in the above ROM in terms of the number of pulses of the sheet feed motor 74. In addition, the fixed distance between the nip between the registration rollers 33*a* and 33*b* and the nip between the press drum 20 and the ink drum 1 is stored in the ROM in terms of the number of pulses of the registration motor 58.

Further, some different tables are stored in the above ROM. The tables include a control pattern table for controlling the sheet feed motor 74 on the basis of the set print speed and a control data table for controlling, in response to the output of the leading edge sensor 51, the motor 74 such that the leading edge of the sheet P abuts against the registration rollers 33*a* and 33*b* and forms a preselected loop. Alternatively, the above data may suitably be stored in the ROM of the bank sheet feed controller 148.

The ROM of the bank sheet feed controller 148 stores a control pattern table for controlling the bank sheet feed motor 107 on the basis of the set print speed. In addition, the ROM stores a control data table for controlling, in response to the output of the bank registration sensor 135, the bank sheet feed motor 107 such that the leading edge of the sheet P abuts against the registration rollers 106*a* and 106*b* and forms a preselected loop.

The RAM of the printer sheet feed controller 88 is a work area used to temporarily store the results of calculations performed by the CPU. Also, the RAM is used to store data signals output from the sensors 51, 52, 65, 66, 53 and 54, a data signal output from the encoder sensor 61 or data signals output from the sensor groups 50-1 and 50-2 or sensors 135 and 136 of the bank sheet feed controller 148. The RAM of the bank sheet feed controller 148 temporarily stores data signals transferred from the printer sheet feed controller 88 or the results of calculations performed by the CPU.

The timer included in the printer sheet feed controller 88 sets delay times Da. Db, Dc, Dd, De and Df shown in FIGS. 20 and 21 while variably counting time.

It is to be noted that FIG. 19 does not show the structural elements of the drive sections to be controlled specifically. In this connection, the print speed set on the DOWN key 96*a* or the UP key 96*b* or automatically set is input not only to the CPU of the printer sheet feed controller 88 but also to, e.g., the CPU of a drum drive control unit, not shown, independent of the controller 88. The encoder sensor 152 and home position sensor 72 are electrically connected to the drum drive control unit via an I/O port. Also, the main motor 150 and a device for braking it, not shown, are electrically connected to the drum drive control unit via a main motor driver and the above I/O port. The drum drive control unit constantly monitors the output of the encoder sensor 152 representative of the rotation speed of the ink drum 1 and press drum 20. The control unit controls, based on the set print speed, the rotation speed of the main motor via the output port and main motor driver such that the ink drum 1 and press drum 20 rotate at the set print speed. Such a function of the control unit may, of course, be partly assigned to the printer sheet feed controller 88.

The operation of the stencil printer 100 with the auxiliary sheet feeding section 28 will be described first. When the operator lays a document on the document reading section 3 and then presses the perforation start key 91, the ink drum 1 held in its home position starts rotating. The master discharging section 18 peels of a used master wrapped around the ink drum 1 and discharges it. When the master clamper 12 on the ink drum 1 is brought to the substantially rightmost position in FIG. 2, the ink drum 1 stops rotating. Then, the shaft 12*a* supporting the master clamper 12 is rotated to open the master clamper 12 away from the stage. In this condition, the ink drums 1 waits for a new master 2.

Subsequently, the stepping motor 6 of the master making section 19 is driven to rotate the platen roller 9. The platen roller 9 conveys the stencil 2 while paying it out from the roll 10. In the document reading section 3, a scanner, not shown, reads the document laid thereon and outputs an image signal representative of a document image. The image signal is digitized by the analog-to-digital converter and then processed by the master making control section to turn out a digital image signal. The heating elements of the thermal head 17 are selectively energized in accordance with the digital image signal, selectively perforating the stencil 2 with heat.

The platen roller 9 in rotation conveys the leading edge of the stencil 2 being perforated toward the master clamper 12 held in its open position. When the number of steps of the pulse motor 6 reaches a preselected number, the shaft 12*a* is rotated to close the master clamper 12 toward the stage. As a result, the master clamper 12 clamps the leading edge of the perforated part of the stencil 2.

At the same time as the master clamper 12 clamps the stencil 2, the ink drum 1 and press drum 20 start rotating at a peripheral speed substantially equal to the speed at which the stencil 2 is conveyed. The perforated part of the stencil 2 is therefore sequentially wrapped around the ink drum 1. When the stencil 2 is wrapped around the ink drum 1 by a preselected length, the ink drum 1, press drum 20 and platen roller 9 stop rotating. At the same time, the cutter motor 7 is energized to lower the upper cutter member 4 via the eccentric cam 8, thereby cutting off the perforated part of the stencil 2, i.e., the master 2. Subsequently, the ink drum 1 again rotates clockwise to pull the trailing edge of the master 2 out of the master making section 19. Consequently, the entire master 2 is wrapped around the ink drum 1.

The conveyance of the sheet P will be described with reference made to FIGS. 20, 21A, 23, 27 and 28. FIG. 20 shows both of the sheet feed timing of the auxiliary sheet feeding section 28 and that of the bank sheet feeding section 200. The sheet feed timings particular to the printer 100 and bank 200 are respectively shown at the left-hand side and right-hand side of FIG. 20 with respect to the angular position θ' of 0°. FIG. 21A shows the sheet feed timing of the auxiliary sheet feeding section in detail together with the sheet feed timing substantially common to both of the sheet feeding sections 28 and 200 and following the start of rotation of the registration rollers 33*a* and 33*b*. The timing chart of FIG. 21 therefore partly overlaps with the timing chart of FIG. 20.

Figure 28A:
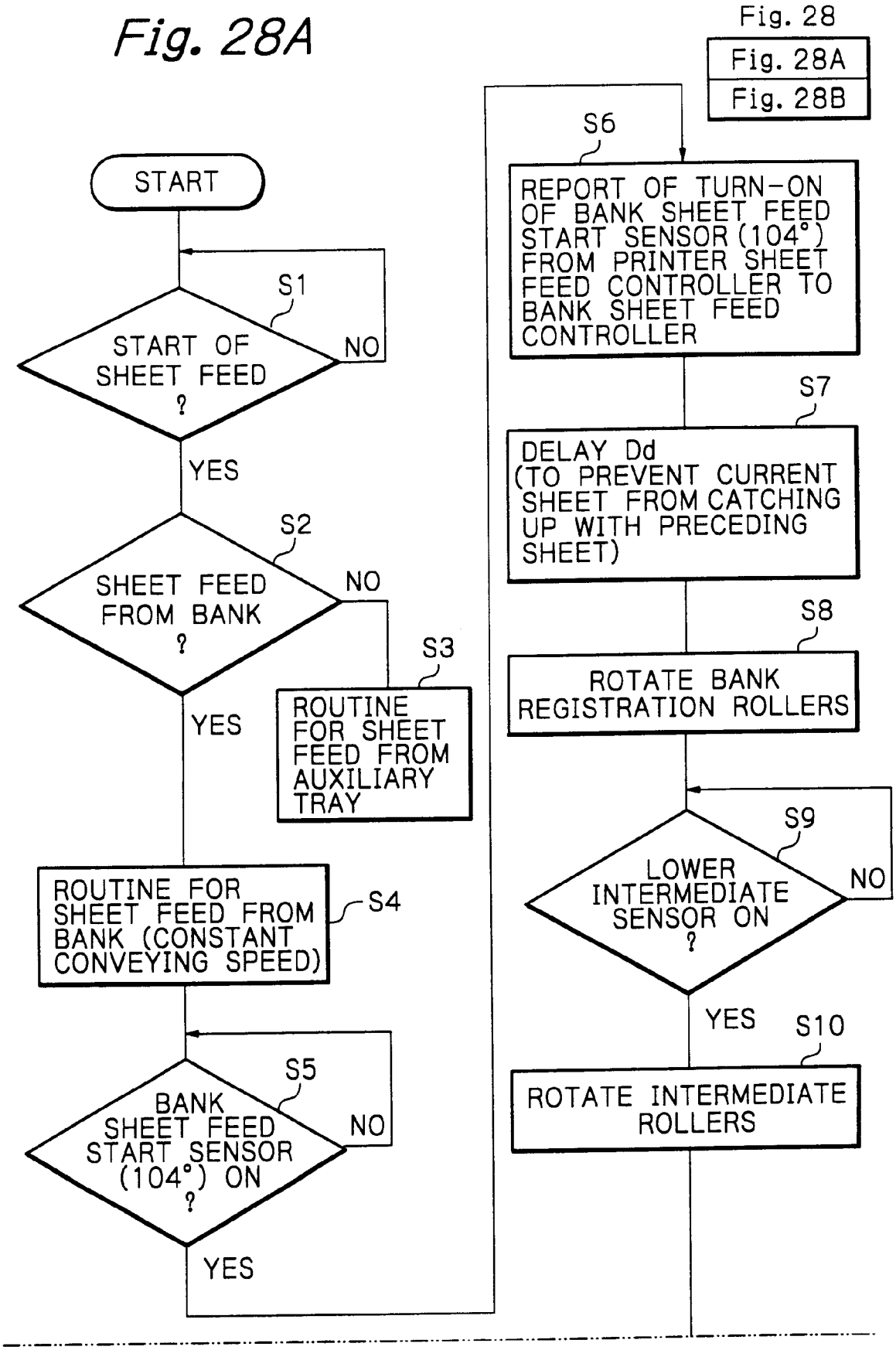
FIGS. 28 and 29 are flowcharts demonstrating a specific sheet feeding operation available with the first embodiment.
Figure 28B:
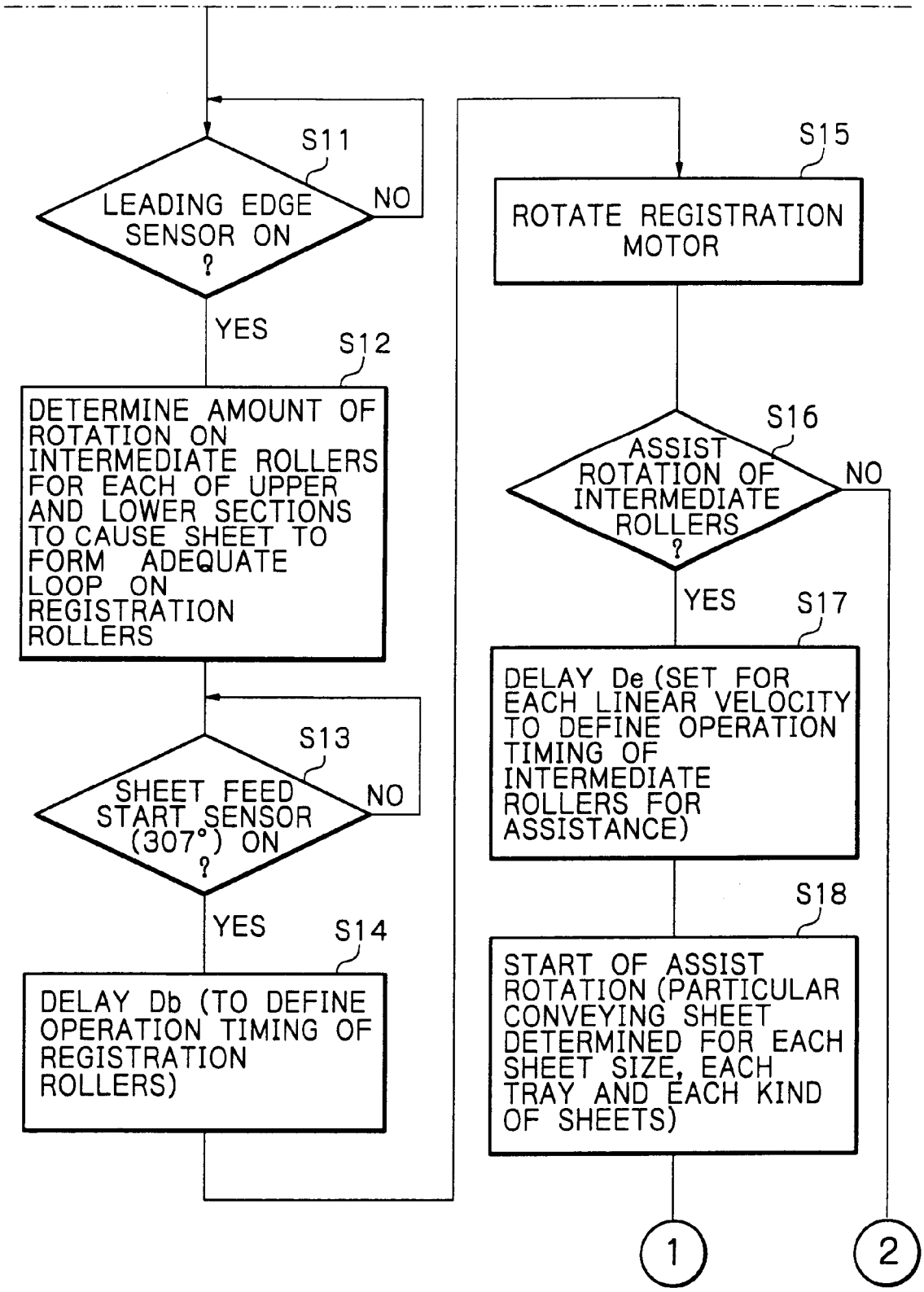
Figure 29:
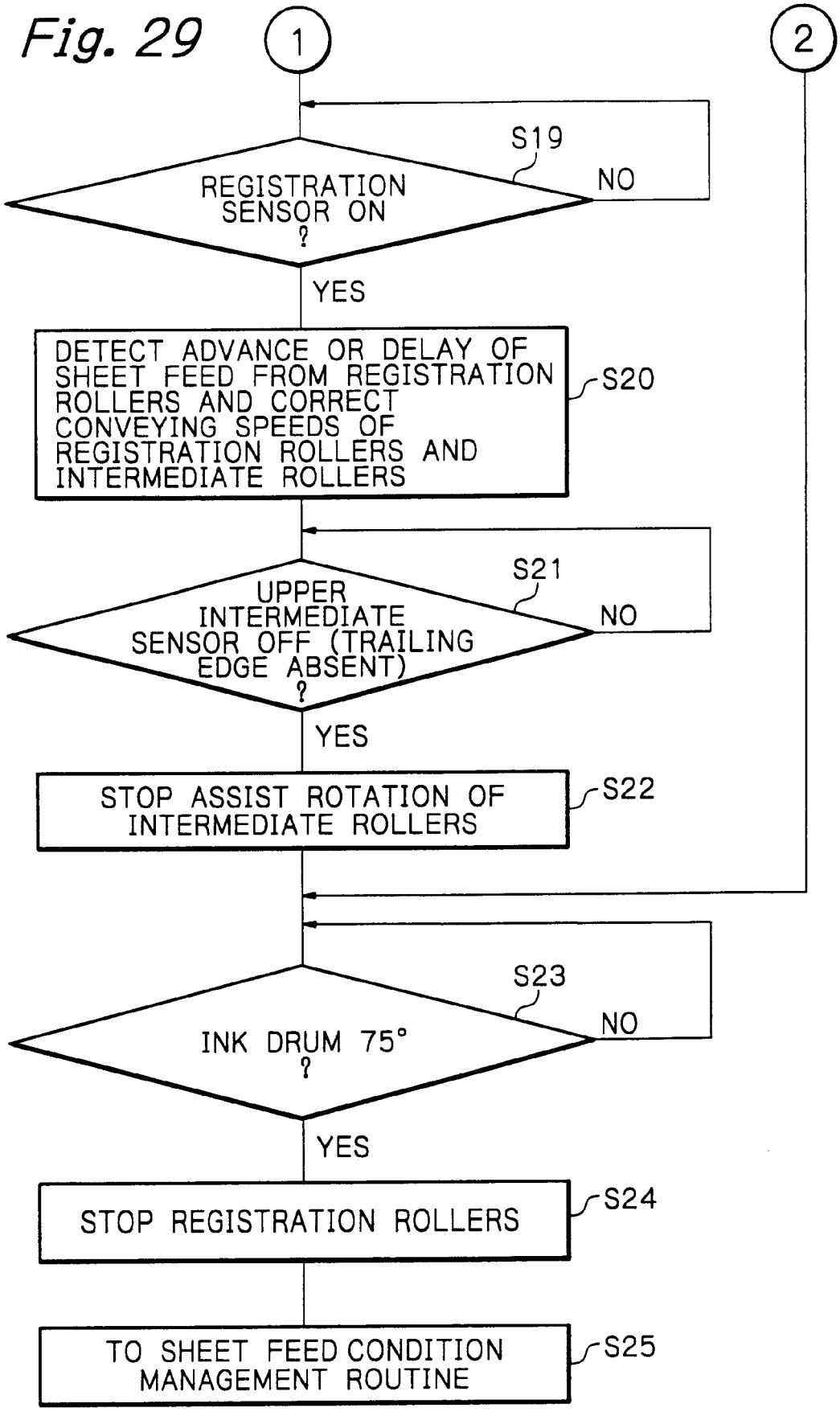

As shown in FIG. 28, first, whether or not the printer 100 is ready to start feeding a sheet P is determined (step S1). More specifically, whether or not the ink well 16 adequate for printing has been formed by the ink feeding device 22 and whether or not the printer 100 with such an ink well 16 can start printing when the perforation start key 91 is pressed are determined. If the answer of the step S1 is positive (YES), whether or not a sheet P is to be fed from the bank sheet feeding section 200 is determined (step S2). This decision is made on the basis of the auxiliary tray 31 or the upper tray 143 or the lower tray 202 of the bank sheet feeding section 200 and a sheet size selected and set the sheet size key 98 and set key 95 or automatically set. If the answer of the step S2 is negative (NO), meaning that a sheet P is to be fed from the auxiliary sheet feeding section 28, a routine for feeding a sheet from the auxiliary sheet feeding section 28 is executed (step S3). This routine will be described specifically before a routine for feeding a sheet P from the bank sheet feeding section 200 (step S4 and successive steps).

In the event of trial printing, the main motor 150 causes the ink drum 1 and press drum 20 to rotate at a peripheral speed matching with the automatically set print speed (sixteen printings/min or 16 rpm) assigned to trial printing.

Figure 23:
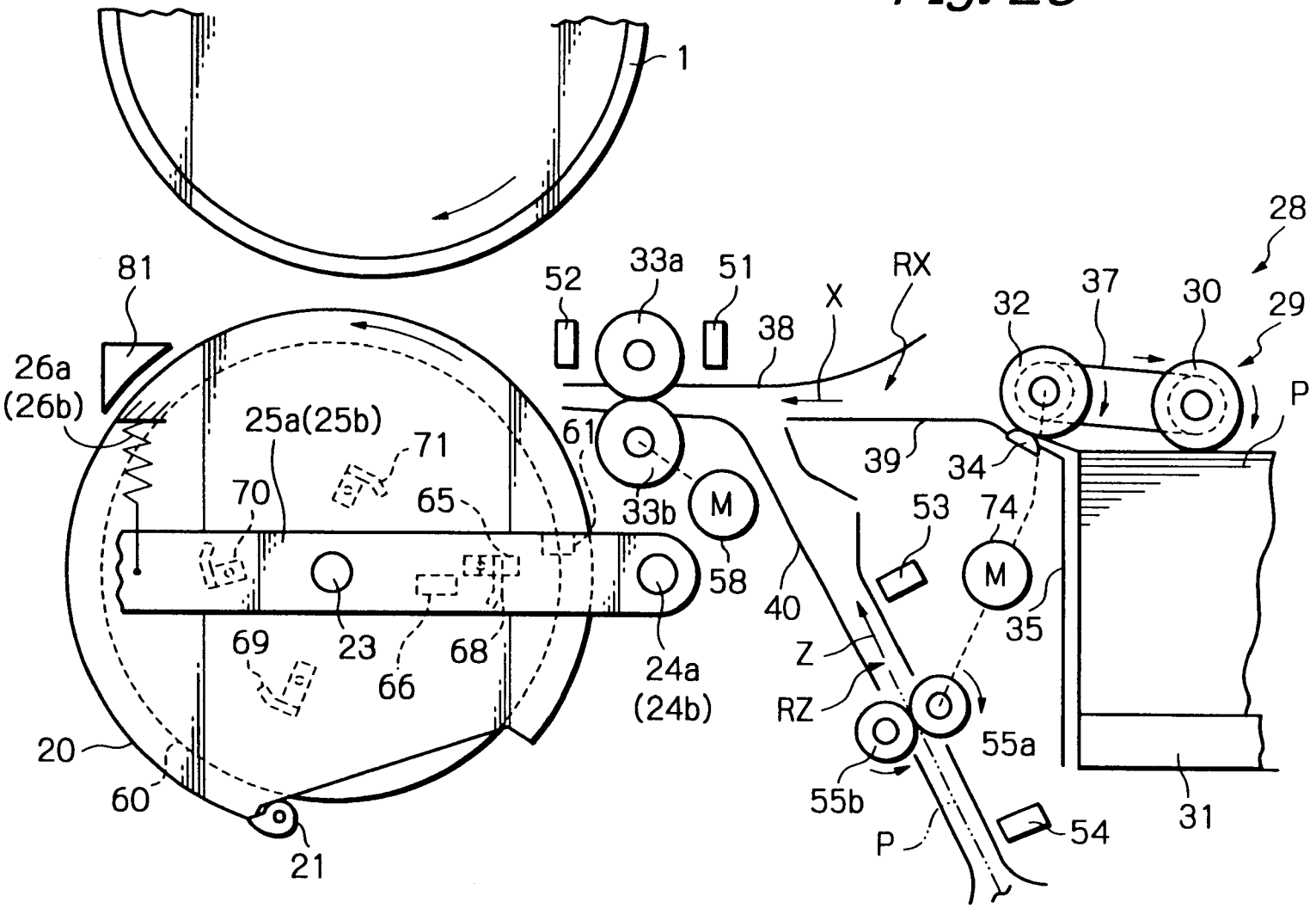
FIG. 23 is a front view showing how sheet feeding means and intermediate rollers convey a sheet at the beginning of drive.

As shown in FIGS. 20, 21A and 23, when the press drum 20 reaches an angular position θ of 194°, the interrupter 68 interrupts the optical path of the sheet feed start sensor 65. The resulting ON signal output from the sensor 65 is sent to the printer sheet feed controller 88. Then, on the elapse of a preselected delay Da, the sheet feed motor 74 is driven in the forward direction to rotate the separation roller 32 clockwise. The separation roller 32 and pickup roller 30 rotated in the same direction as the roller 32 cooperate to feed only the top sheet P toward the registration rollers 33*a* and 33*b*. As shown in FIG. 21B, the leading edge sensor 51 is located on the horizontal transport path RX downstream of the separation roller 32 by Xa mm. When the sensor 51 senses the leading edge of the above sheet P, it sends an ON signal to the printer sheet feed controller 88.

The trial print speed is lower than the standard print speed, as stated earlier. Therefore, the printer sheet feed controller 88 drives the sheet feed motor 74 such that the separation roller 32 and pickup roller 30 of the sheet feeding means 29 rotate at a conveying speed corresponding to the standard or third print speed (90 rpm), i.e., a peripheral speed of 847.8 mm/sec.

Figure 24:
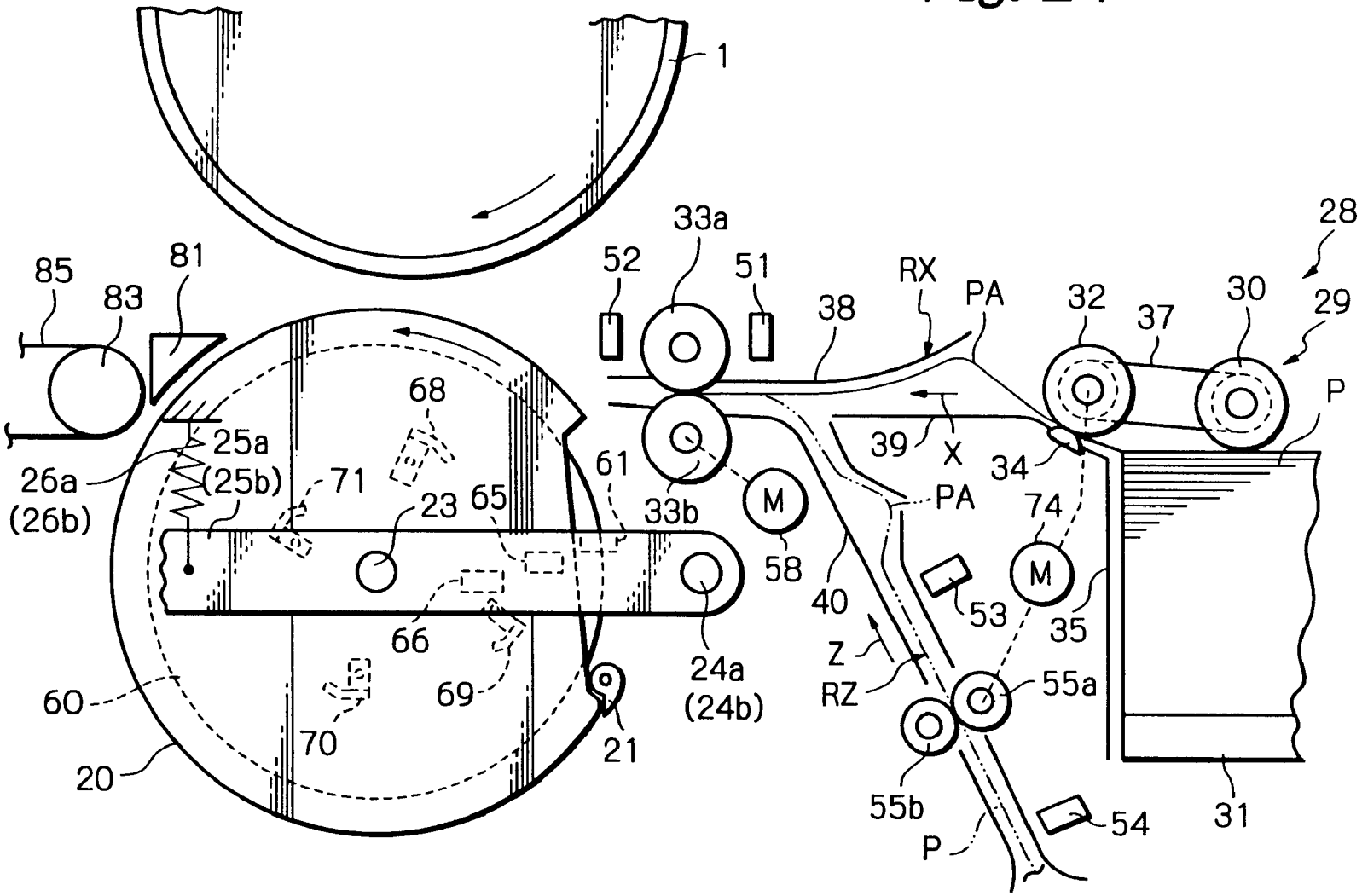
FIG. 24 is a fragmentary front view demonstrating how a sheet is caused to form a loop between registration rollers and the sheet feeding means or between the registration rollers and the intermediate rollers in the first embodiment.

As shown in FIGS. 5 and 24, the printer sheet feed controller 88 outputs, based on the output of the leading edge sensor 51, a command signal causing the leading edge of the sheet P to abut against the portion just upstream of the registration rollers 33*a* and 33*b* and form a preselected amount of loop PA. As a result, a preselected number of drive pulses are fed to the sheet feed motor 74 via the previously mentioned driver, so that the sheet P is fed by Xc mm (loop adjustment). When the leading edge of the sheet P forms the above loop PA convex upward, the sheet feed motor 74 and therefore the separation roller 32 and pickup roller 30 are caused to stop rotating.

The above loop PA is confined in an experimentally determined range which obviates the skew and feed failure ascribable to the rotation of the registration rollers 33*a* and 33*b*, and reduces noise because of the adequate amount of loop. To implement the adequate loop PA, the printer sheet feed controller 88 drives the sheet feed motor 74 such that the sheet feeding means 29 feeds the sheet P by a greater amount than the bank sheet feeding section 200.

In the illustrative embodiment, the amount of feed Xc of the sheet P is the sum of the distance of 19 mm between the nip between the registration rollers 33*a* and 33*b* and the leading edge sensor 51 and 6 mm, i.e., 25 mm in total. The printer sheet feed controller 88 translates the above amount of feed into the number of steps and then controls the sheet feed motor 74. As a result, the motor 74 causes the separation roller 32 to feed the sheet P such that the sheet P forms the loop PA.

As stated above, the printer sheet feed controller 88 controls the sheet feed motor 74 independently of the driveline assigned to the ink drum 1 in such a manner to effect the unique loop adjustment. This successfully obviates a short loop at low print speeds without resorting to the print speed varying every moment due to the aging of a belt included in the ink drum driveline and the backlashes of gears. In addition, the sheet P is prevented from skewing or from being not fed due to the rotation of the registration rollers 33*a* and 33*b*, and can therefor stably form the expected loop.

As for the delay Da, the leading edge of a sheet having the maximum length of 447 mm moves away from the front wall 35 when the press drum 20 reaches an angular position θ' of about 200°. The delay Da should therefore preferably be 10° or above in terms of the rotation angle of the press drum 20 including a margin. With the delay Da between the time when the leading edge sensor 65 turns on and the time when the sheet feed motor 74 starts rotating, it is possible to correct a scatter among machines and to implement control with software. Further, the delay Da is useful to define the operation timing of the sheet feed motor 74 by using the ON signal which the sheet feed start sensor 65 outputs at the angular position of 194° of the press drum 20 as a trigger.

Figure 25:
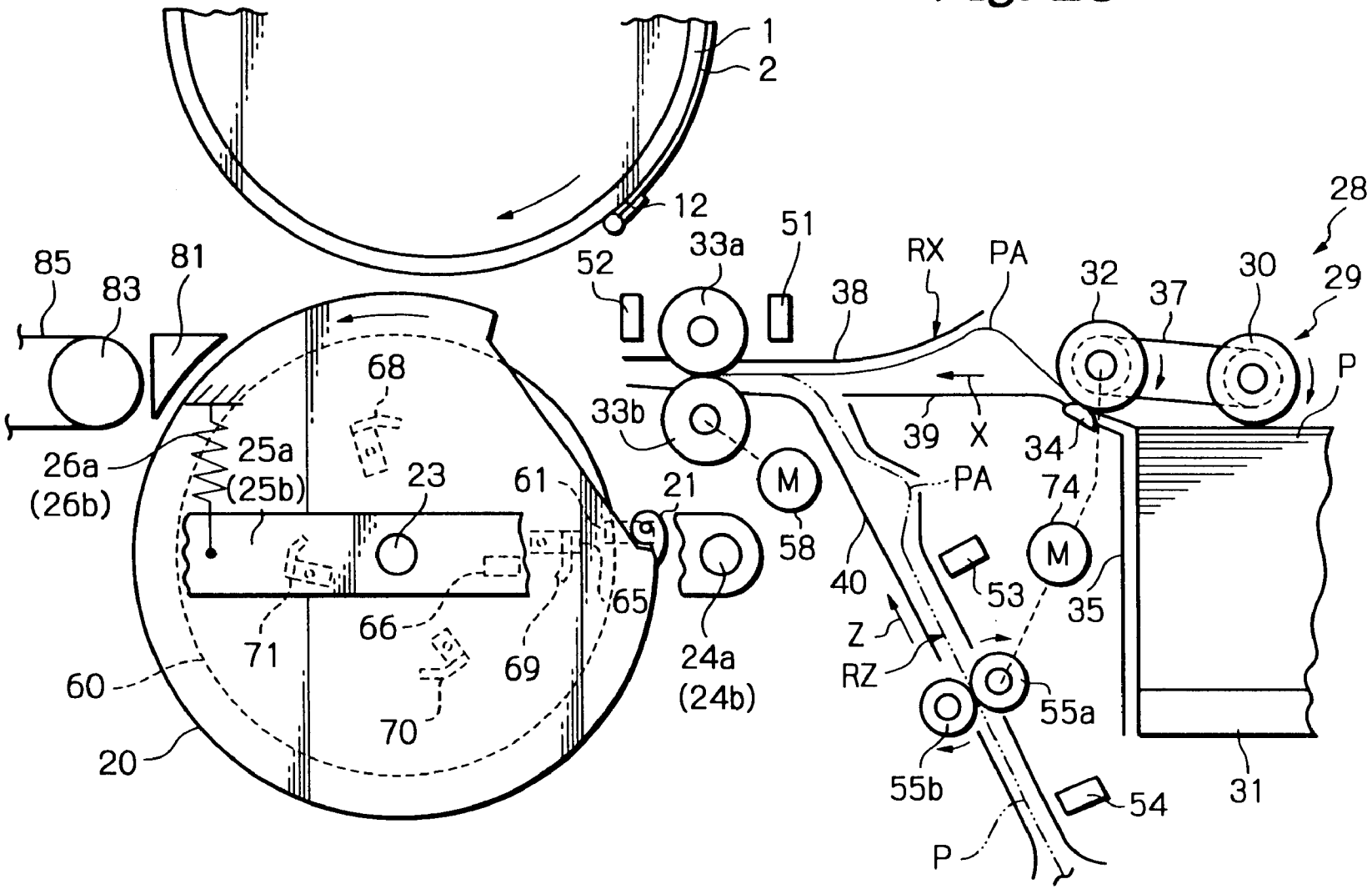
FIG. 25 is a front view showing how the registration rollers convey a sheet at the beginning of drive or how the intermediate rollers convey it during assist rotation in the first embodiment.

As shown in FIGS. 20, 21A and 25, when the press drum 20 further rotates counterclockwise to an angular position θ' of 307°, the interrupter 69 interrupts the optical path of the sheet feed start sensor 65. As a result, the sensor 65 sends an ON signal to the printer sheet feed controller 88. The controller 88 drives the registration motor 58 and sheet feed motor 74 on the elapse of a preselected delay Db since the arrival of the above ON signal. The registration motor 58 causes the registration roller 33*b* to start rotating counterclockwise and convey the leading edge of the sheet P toward the sheet clamper 21 of the press drum 20. At the same time, the sheet feed motor 74 causes the separation roller 32 to rotate at a low speed for a short period of time, thereby reducing noise produced by the sudden disappearance of the loop of the sheet P.

The above delay Db is useful to define the operation timing of the registration motor 58 by using the ON signal of the sheet feed start sensor 65 output at the angular position θ' of 307° of the press drum 20 as a trigger.

Figure 21C:
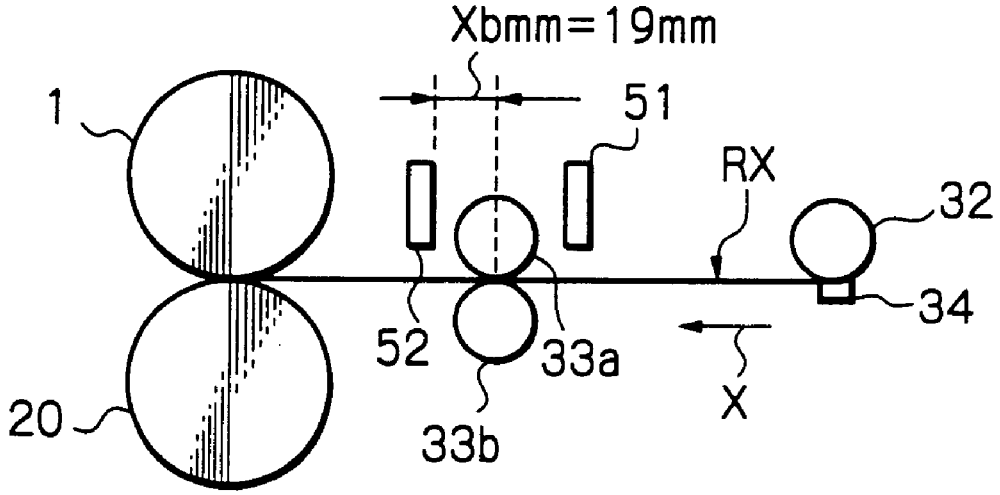
Figure 22:
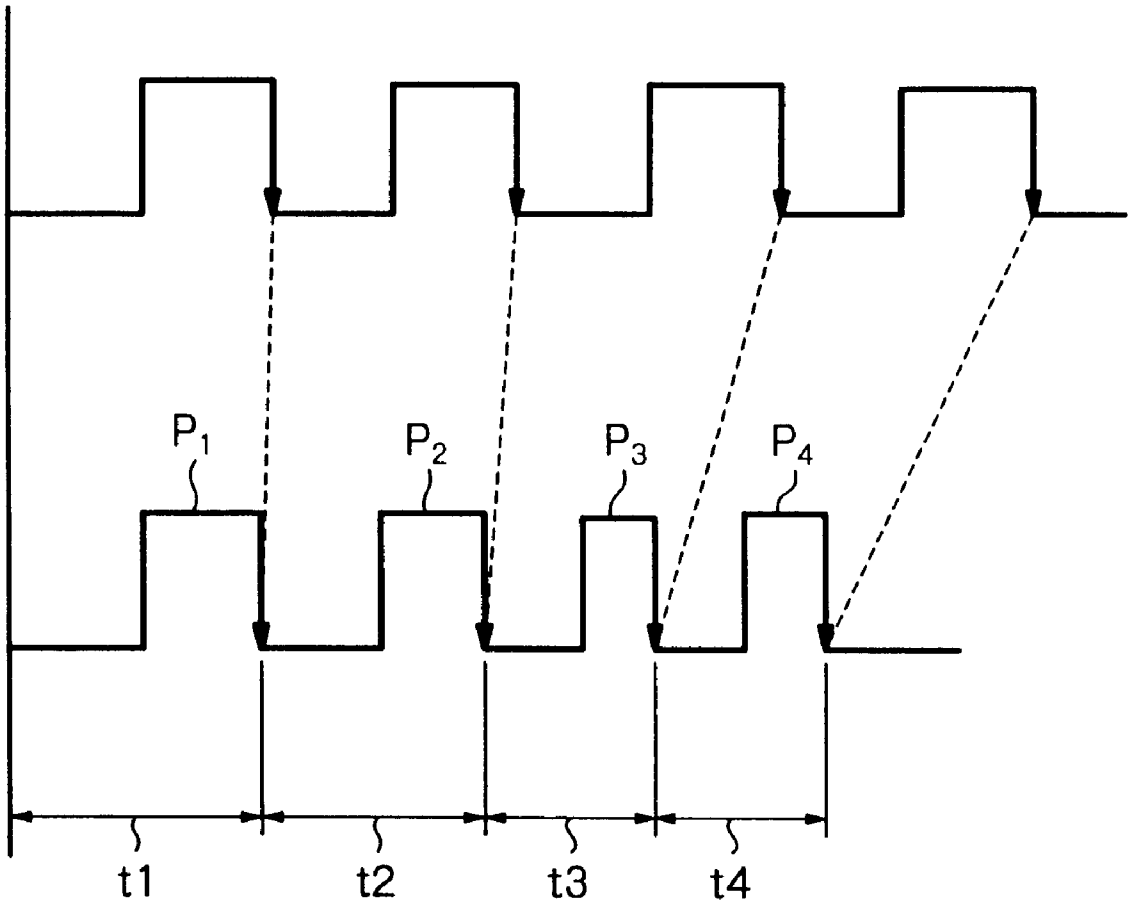
FIG. 22 is a chart showing how the number of pulses and the pulse width are varied in the first embodiment.

As shown in FIG. 21C, the registration rollers 33*a* and 33*b* convey the leading edge of the sheet P abutting against the portion just upstream of the nip between the rollers 33*a* and 33*b* to the downstream side of the transport path RX by a distance of Xb mm (19 mm in the illustrative embodiment). Then, the registration sensor 52 turns on and sends an ON signal to the printer sheet feed controller 88. At this instant, the distance between the position where the sheet P abuts against the nip between the registration rollers 33*a* and 33*b* is fixed, and therefore the count of drive pulses fed to the registration motor 58 is expected to be constant. However, the sheet P is apt to slip, particularly in the initial stage of rotation of the registration rollers 33*a* and 33*b*. The count of drive pulses is therefore apt to vary from one sheet to another sheet until the registration sensor 52 turns on. In light of this, the printer sheet feed controller 88 determines a delay of the sheet P on the basis of the count of drive pulses having been output until the turn-on of the registration sensor 52. The controller 88 increases, based on the determined delay, the speed and amount of the subsequent rotation of the registration motor 58, thereby correcting the slip of the sheet P.

Stated another way, assume that the printer sheet feed controller 88 counts drive pulses needed to cause the registration motor 58 to convey the sheet P until the registration sensor 62 turns on, and delivers drive pulses necessary for conveying the leading edge of the sheet P by Xd mm to the registration motor 581. Then, the controller 88 increases the number of drive pulses, i.e., the amount of rotation of the registration motor 58 in accordance with the slip of (Xd−Xb) mm of the sheet P on the registration rollers 33*a* and 33*b*. In addition, the controller 88 reduces the width of the drive pulses in order to increase the rotation speed (pps) of the registration motor 58.

More specifically, the distance between the registration sensor 52 and the nip between the registration rollers 33*a* and 33*b* on the horizontal transport path RX is fixed, as stated earlier. It follows that the number of drive pulses necessary for the registration motor 58 to rotate the registration roller 33*b* by an amount corresponding to the above distance is fixed. For example, assume that when the quality of the sheet P is changed, the registration sensor 52 does not turn on even after a preselected number of drive pulses have appeared since the start of rotation of the registration roller 33*b*, meaning that the sheet P has slipped. Then, the printer sheet feed controller 88 sends to the registration motor 58 a command signal for conveying the sheet by an extra amount corresponding to the difference between the preselected number of pulses and the number of pulses actually caused the registration sensor 52 to turn on. In addition, the controller 88 reduces the pulse width in order to increase the rotation speed of the motor 58.

As shown in FIG. 22, for the above slip correction, the printer sheet feed controller 88 varies the number of drive pulses ($P_1$–$P_4$) to be fed to the registration motor 58 and the pulse width ($t_1$–$t_4$) thereof.

After the slip correction, the printer sheet feed controller 88 controls, in accordance with the output pulses of the encoder sensor 61, the registration motor 58 in such a manner as to convey the leading edge of the sheet P to the sheet clamper 21 brought to its clamp position. This is so-called feedback control (FBC, FIG. 21A).

As stated above, the amount by which the sheet P is conveyed by the registration motor 58 in response to a single pulse and the amount by which the circumference of the press drum 20 is moved in response to a single pulse width of the encoder 60 are identical. For FBC, the printer sheet feed controller 88 counts a period of time necessary for a single pulse width of the encoder 60 with the timer thereof and decelerates the registration motor 58 if the above period of time increases due to, e.g., a change in the load acting on the press drum 20. Conversely, when the period of time necessary for a single pulse of the encoder 60 decreases, the controller 88 accelerates the motor 58.

Stated another way, the controller 88 constantly traces the irregular rotation, i.e., irregular peripheral speed of the press drum 20 in terms of changes in the pulses output from the encoder 61. The controller 88 variably controls the rotation speed of the registration motor 58 in accordance with the variation of pulses output from the encoder 61 (FBC using the encoder 61). At this instant, the controller 88 determines the angular position of the press drum 20 in terms of the number of pulses sensed by the encoder sensor 61 and determines the peripheral speed of the drum 20 in terms of the period of time t also sensed by the encoder sensor 61. As shown in FIG. 22, the controller 88 further varies the drive pulse width (t1–t4) for the registration motor 58 in order to control the motor 58 by FBC. This is successful to reduce misregistration.

The press drum 20 is rotating at a speed matching with the automatically set trial print speed. The sheet P is conveyed at a speed 1.4 times higher than the peripheral speed of the press drum 20. When the sheet clamper 21 of the press drum 21 is about to close, the sheet P reaches the clamper 21 and obtains a speed equal to the peripheral speed of the press drum 20.

The sheet clamper 21 of the press drum 20 is opened at a preselected timing shown in FIGS. 20 and 21A, i.e., when the press drum 20 reaches an angular position θ' of 350.5°.

Figure 26:
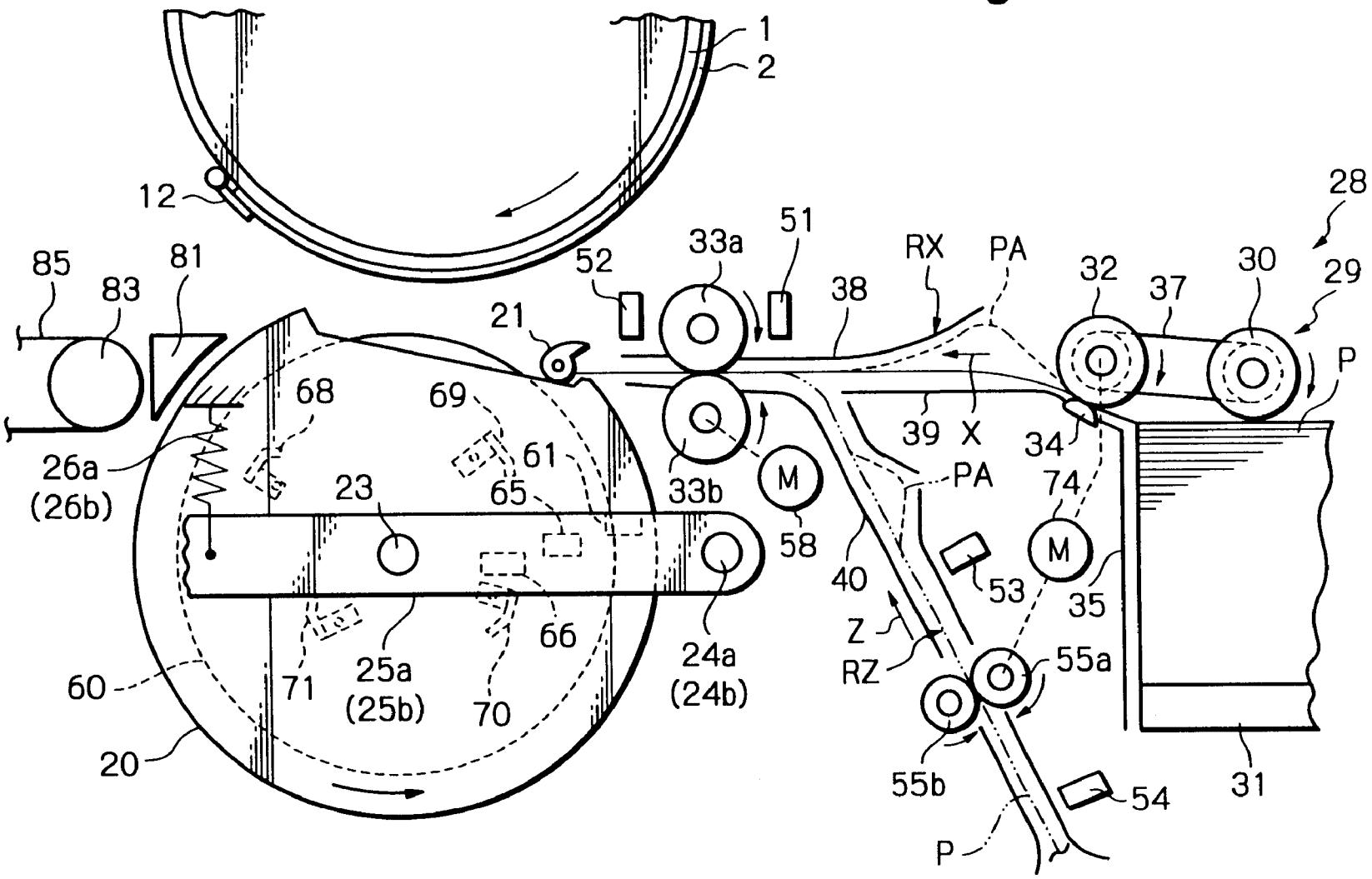
FIG. 26 is a fragmentary front view demonstrating the conveyance of the leading edge of a sheet toward a sheet damper included in the first embodiment.

Under the above encoder FBC of the controller 88, the registration roller 33*b* is rotated counterclockwise to, in turn, rotate the upper registration roller 33*b* clockwise via the sheet P. As a result, as shown in FIG. 26, the loop PA (indicated by a phantom line) of the sheet P disappears. The separation roller 32 and pickup roller 30 simply follow the movement of the sheet P due to the action of the one-way clutches 67. The leading edge of the sheet P is conveyed until it abuts against the sheet clamper 21.

Figure 27:
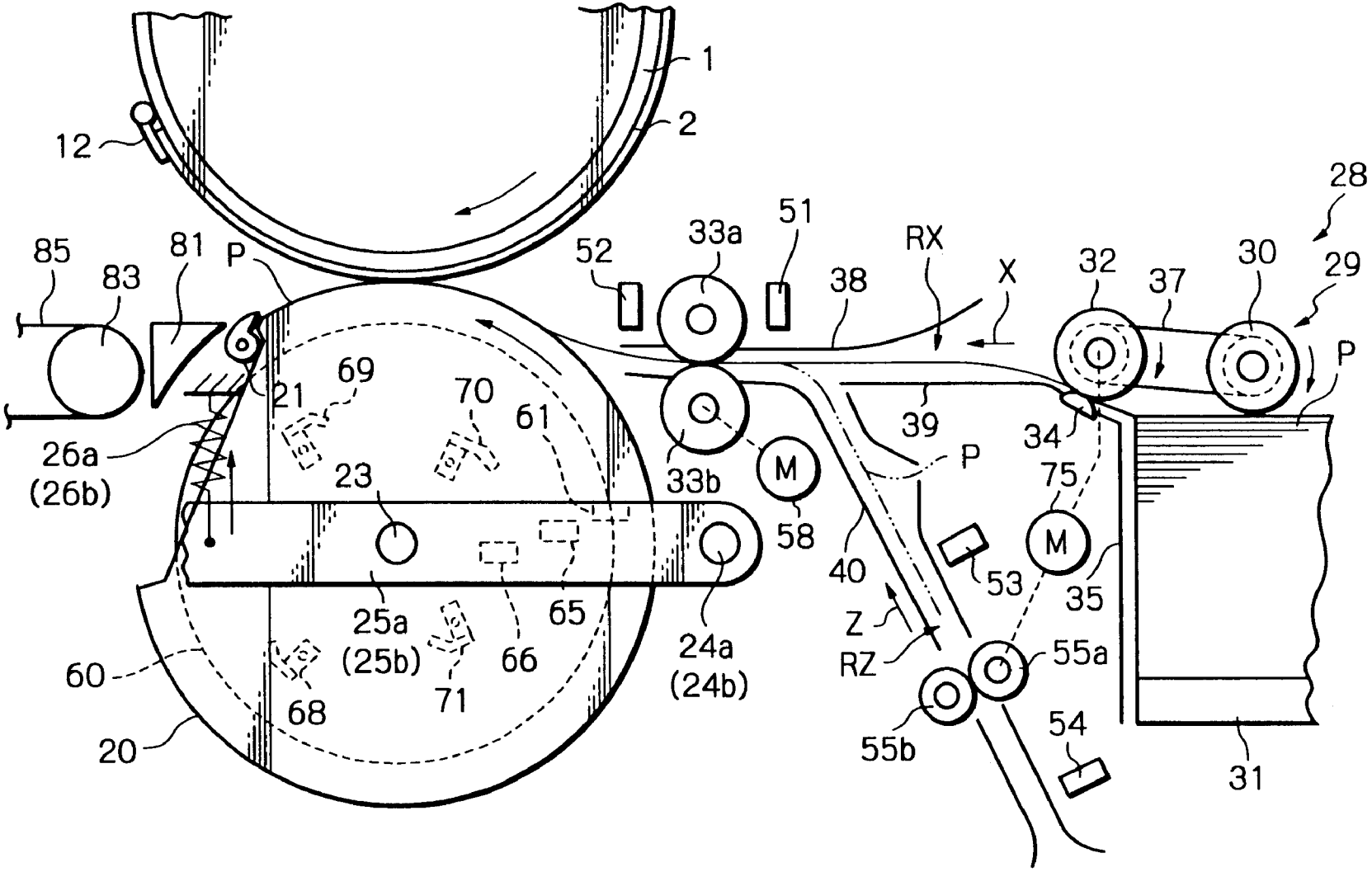
FIG. 27 is a fragmentary front view representative of the conveyance of a sheet at the initial stage of printing in accordance with the first embodiment.

As shown in FIGS. 21A, 26 and 27, as soon as the leading edge of the sheet P abuts against the sheet clamper 21, the clamper 21 is closed to grip it. In the illustrative embodiment, this occurs when the press drum 20 reaches an angular position θ' of 10° (370°). The press drum 20 therefore rotates while retaining the sheet P thereon and conveys it to the print position between the drum 20 and the ink drum 1.

As shown in FIG. 27, the press drum 20 is raised toward the ink drum 1 under the action of the springs 26*a* and 26*b*, forming a nip with the intermediary of the sheet P. In this condition, the press drum 20 presses the sheet P against the ink drum 1 (print pressure ON). As the sheet P is pressed against the master 2 wrapped around the ink drum 1, the master 2 is caused to closely adhere to the ink drum 1. At the same time, the ink is transferred to the sheet via the porous portion of the ink drum 1 and the perforations of the master 2, producing a printing. At this instant, the ink roller 13 rotates in the same direction as the ink drum 1. Therefore, the ink in the ink well 16 is deposited on the ink roller 13 and conveyed thereby to the inner periphery of the ink drum 1 while being regulated in amount by the doctor roller 15.

In the meantime, the printer sheet feed controller 88 continues the FBC using the encoder. When the controller 88 determines that the registration motor 58 has rotated by an amount stored in the ROM thereof (angular position θ' of 75° (435°) in the illustrative embodiment), it deenergizes the registration motor 58 and ends FBC.

When the press drum 20 is further rotated to a sheet discharge position preceding the peeler 81 (angular position θ' of 81.2° (441.2°) in the illustrative embodiment), the sheet clamper 21 is opened. Then, the peeler 81 peels off the sheet or trial printing P from the press drum 20. The trial printing P is then conveyed by the belt 85 to the tray 82. The press drum 20 is released from the ink drum 1 and held in its initial position.

The operator watching the above trial printing determines whether or not the quality and position of the image are adequate. If the trial printing acceptable, the operator inputs a desired number of printings on the numeral keys 93 and then presses the print start key 92. In response, the printer 100 repeats the sheet feed, printing and sheet discharge a number of times corresponding to the desired number of printings. In this case, because the operator has not touched the print speed keys 96, the standard or third print speed is automatically set. The main motor 150 drives the ink drum 1 and press drum 20 at a speed corresponding to the standard speed.

Because the set print speed is lower than the standard print speed (third, second or first speed or trial print speed), the printer sheet feed controller 8 causes the sheet feed motor 74 to rotate in the forward direction as during trial printing. Therefore, the separation roller 32 and pickup roller of the sheet feeding means 29 convey the consecutive sheets P at a speed corresponding to the standard or third print speed (90 rpm), i.e., at a peripheral speed of 847.8 mm/sec. Each sheet P has the amount of its loop adjusted in the same manner as during trial printing. After the lading edge of the sheet P has been moved away from the nip between the registration rollers 33*a* and 33*b*, the above unique conveyance and printing are effected at a conveyance speed and a printing speed corresponding to the third print speed.

Assume that the operator selects the second or first print speed lower than the standard speed on the print speed key 96. Then, the separation roller 32 and pickup roller 30 of the sheet feeding means 29 are rotated at a conveying speed corresponding to the standard or third print speed ) (90 rpm), i.e., at a peripheral speed of 847.8 mm/sec as during trial printing or during standard speed operation. Again, the sheet P is fed by an amount subjected to loop adjustment. After the leading edge of the sheet P has been moved away from the nip between the registration rollers 33*a* and 33*b*, the above unique conveyance and printing are effected at a conveyance speed and a printing speed corresponding to the second or first print speed.

As stated above, the printer sheet feed controller 88 controls the sheet feed motor 74 independently of the driveline assigned to the ink drum 1 in such a manner as to effect the unique conveyance speed adjustment and loop adjustment. This successfully obviates a short loop at low print speeds without regard to the print speed varying every moment due to the aging of a belt included in the ink drum driveline and the backlashes of gears. Further, the sheet P is prevented from skewing or from being not fed due to the rotation of the registration rollers 33*a* and 33*b*, and can therefor stably form the expected loop. In addition, there can be reduced noise at the standard print speed.

Assume that the operator selects the fourth print speed higher than the standard speed on the print speed key 96. Then, the main motor 150 rotates the ink drum 1 and press drum 20 in such a manner as to implement a print speed corresponding to the set fourth speed. The printer sheet feed controller 88 determines that the set print speed is higher than the standard speed. Then, the controller 88 drives the sheet feed motor 74 forward such that the separation roller 32 and pickup roller 30 of the sheet feeding means 29 convey the sheet P at a speed corresponding to the set fourth print speed, i.e., at a peripheral speed of 989.1 mm/sec. Again, the sheet P is fed by an amount subjected to the previously stated loop adjustment. After the leading edge of the sheet P has been moved away from the nip between the registration rollers 33*a* and 33*b*, the above unique conveyance and printing are effected at a conveyance speed and a printing speed corresponding to the fourth print speed.

Assume that the operator selects the fifth or highest print speed on the print speed key 96. Then, the main motor 150 rotates the ink drum 1 and press drum 20 in such a manner as to implement a print speed corresponding to the set fifth speed. The printer sheet feed controller 88 determines that the set print speed is higher than the standard speed. Then, the controller 88 drives the sheet feed motor 74 forward such that the separation roller 32 and pickup roller 30 of the sheet feeding means 29 convey the sheet P at a speed corresponding to the set fifth print speed (120 rpm), i.e., at a peripheral speed of 1,130.4 mm/sec. Again, the sheet P is fed by an amount subjected to the previously stated loop adjustment. After the leading edge of the sheet P has been moved away from the nip between the registration rollers 33*a* and 33*b*, the above unique conveyance and printing are effected at a conveyance speed and a printing speed corresponding to the fifth print speed.

As stated above, the printer sheet feed controller 88 controls the sheet feed motor 74 independently of the driveline assigned to the ink drum 1 in such a manner as to effect the unique conveyance speed adjustment and loop adjustment. This successfully obviates a short loop at low print speeds without regard to the print speed varying every moment due to the aging of a belt included in the ink drum driveline and the backlashes of gears. Further, the sheet P is prevented from skewing or from being not fed due to the rotation of the registration rollers 33*a* and 33*b*, and can therefor stably form the expected loop.

The above delay Db between the time when the sheet feed start sensor 65 outputs an ON signal and the time when the registration motor 58 is actually driven is useful to correct scattering among machines and to facilitate control using software.

The routine including the step S4 of FIG. 28 and successive steps and relating to the bank sheet feeding section 200 will be described with reference to FIGS. 30 and 31. The routine begins with the printer sheet feed controller 88. In response, the controller 88 informs the bank sheet feed controller 148 of the turn-on of the sensor 66 by serial communication (step S33).

Subsequently, whether or not the bank feed sensor 136 has turned on is determined (step S34). Specifically, by determining whether or not the trailing edge of the sheet fed before the second sheet to be fed has moved away from the bank feed sensor 136, it is possible to prevent the second sheet from catching up with the trailing edge of the preceding sheet and jamming the transport path. If the answer of the step S34 is YES, meaning that the trailing edge of the preceding sheet P has not moved away from the sensor 136 yet, the preceding sheet P is continuously conveyed until its trailing edge moves away from the sensor 136, i.e., until the sensor 136 turns on. If the answer of the step S34 is NO, meaning that the trailing edge of the preceding sheet P is passing the sensor 136, the sheet feed clutch 123 is coupled to allow the rotation of the bank sheet feed motor 107 to be transferred to the sheet feeding means 29-2. At the same time, the intermediate clutch 117 is coupled to allow the rotation of the motor 107 to be transferred to the intermediate rollers 118*a* and 118*b* (steps S35 and S36).

Subsequently, the bank sheet feed motor 107 is rotated in the reverse direction in order to rotate the intermediate rollers 118*a* and 118*b* to rotate in FIG. 15. The rollers 118*a* and 118*b* convey the trailing edge of the preceding sheet P toward the registration rollers 106*a* and 106*b* arranged on the vertical transport path RZ. At the same a step S30 of FIG. 30. The following description will concentrate on the third, second or first print speed or the trial print speed lower than the standard speed and set by the operator on the key 96 or automatically set. The main motor 150 drives the ink drum 1 and press drum 20 at a speed matching with the above set print speed.

First, the tray 143 of the upper sheet feeding section 201 or the tray 145 of the lower sheet feeding section 202 and a paper size thereof are selected and set on the sheet size key 98 and set key 95 or automatically set. Whether or not the tray 143 of the upper sheet feeding means 201 is selected is determined (step S30). If the answer of the step S30 is NO, the lower up-down motor 142 causes the tray 145 to rise until the top of the sheet stack P on the tray 145 reaches the sheet feed position, as determined by the lower limit sensor 139 (step S31). In this condition, the lower sheet feeding section 202 is ready to feed the sheet P thereof. It is to be noted that when the tray 145 of the lower sheet feeding section 202 and the sheet size thereof are selected and set either manually or automatically, the sheet size of the tray 145 is sensed by the sensor group 50-2 beforehand. This step, however, will not be described specifically in order to avoid redundancy.

Whether or not the press drum 20 is located at its home position is determined (step S32). Specifically, when the press drum 20 reaches the angular position θ' of 0°, the interrupter 70 interrupts the optical path of the bank sheet feed start sensor 66 (YES, step S32). The resulting ON signal output from the sensor 66 is sent to time, the sheet feeding means 29-2 starts picking up the top sheet S. More specifically, the drive mechanism 125B operates as described with reference to FIG. 16 with the result that the separation roller 32 and pickup roller 30 of the sheet feeding means 29-2 are rotated clockwise in FIG. 16 (counterclockwise in FIG. 15). As a result, only the top sheet P is paid out from the tray 145 in the direction X1 (step S37).

The bank sheet feed controller 148 identifies the set print speed lower than the standard speed, i.e., the third, second or first speed or the trial print speed on the basis of the signal transferred from the printer sheet feed controller 88. The controller 148 therefore drives the bank sheet feed motor 107 in the reverse direction such that the separation roller 32 and pickup roller 30 convey the sheet P at a speed corresponding to the third or standard speed (90 rpm), i.e., a peripheral speed of 847.8 mm/sec. As shown in FIG. 20, in the step S32, the controller 148 drives the motor 107 on the elapse of a delay Dc since the receipt of the ON signal output from the bank sheet feed sensor 66 (rotation angle θ' of 0° of the press drum 20).

After the step S37, whether or not the feed sensor 136 has turned on, i.e., whether or not the leading edge of the sheet P being paid out has reached the feed sensor 136 is determined (step S38). If the answer of the step S38 is YES, meaning that the leading edge of the sheet P being paid out has moved away from the sensor 136, the sheet feed motor 107 is driven by a designated number of steps in the reverse direction. As a result, the separation roller 32 and pickup roller 30 of the sheet feeding means 29-2 and intermediate rollers 118*a* and 118*b* are rotated by a distance of sheet conveyance corresponding to the reverse rotation of the motor 107. Then, the motor 107 is deenergized. Thereafter, the sheet feed clutch 123 is uncoupled to interrupt the transfer of rotation from the motor 107 to the separation roller 32 and pickup roller 30. As a result, so long as the trailing edge of the sheet P being paid out remains in contact with the two rollers 32 and 30, the rollers 32 and 30 simply follow the movement of the sheet P (steps S38–S40).

The step S40 is followed by a step S41 for determining whether or not the trailing edge of the preceding sheet P has moved away from the registration sensor 135. This is to obviate a jam stated earlier. If the answer of the step S41 is NO, meaning that the trailing edge of the preceding sheet P0 has not moved away form the registration sensor 135, the registration clutch 104 is turned on while the sheet feed motor 107 is driven in the reverse direction (steps S42 and S43).

After the step S43, whether or not the registration sensor 135 has turned on, i.e., whether or not the leading edge of the sheet P being conveyed has reached the registration sensor 135 is determined (step S44). If the answer of the step S44 is YES, meaning that the leading edge of the sheet P being conveyed has moved away from the sensor 135, the sheet feed motor 107 is rotated in the reverse direction by a designated number of steps so as to rotate the intermediate rollers 118*a* and 118*b* by a preselected amount. As a result, the leading edge of the sheet P abuts against the portion just upstream of the nip between the registration rollers 106*a* and 106*b* and forms an adequate loop. Then, the reverse rotation of the motor 107 is stopped (steps S44–S46).

In this manner, to cause the leading edge of the sheet P to form an adequate loop, the sheet feed motor 107 is driven by a designated number of steps in the reverse direction to rotate the intermediate rollers 118*a* and 118*b* by a preselected amount. In the illustrative embodiment, the sheet P is fed by an amount which is the sum of the distance of 19 mm between the upstream end of the nip between the registration rollers 106*a* and 106*b* and the registration sensor 135 on the vertical transport path RZ and 6 mm, i.e., 25 mm in total. The bank sheet feed controller 148 translates the above amount of feed into the number of steps and then controls the sheet feed motor 107. As a result, the motor 107 causes the intermediate rollers 118*a* and 118*b* to feed the sheet P such that the sheet P forms the preselected loop.

Subsequently, the registration motor 101 is driven forward by several steps until the registration rollers 106*a* and 106*b* nip the leading edge of the sheet P. While the rollers 106*a* and 106*b* are nipping the leading edge of the sheet P, the intermediate clutch 117 is uncoupled (steps S47 and S48).

The press drum 20 is caused to rotate counterclockwise. When the press drum 20 reaches an angular position θ' of 104°, the interrupter 71 interrupts the optical path of the bank sheet feed start sensor 66. The sensor 66 therefore sends an ON signal to the printer sheet feed controller 88. In response, the sheet feed controller 88 informs the bank sheet feed controller 148 of the turn-on of the sensor 66 (θ' of 104°) by serial communication (steps S49 and S50). This is followed by a delay Dd which prevents the leading edge of the sheet P being conveyed from catching up with the trailing edge of the preceding sheet P (step S51). Subsequently, the registration motor 101 is rotated by a designated number of steps to feed the leading edge of the sheet P toward the intermediate rollers 55*a* and 55*b* and registration rollers 33*a* and 33*b*. After the motor 101 has been deenergized, the registration clutch 104 is uncoupled (see steps S52–S55). This is followed by a routine for managing the condition of sheet feed.

The delay Dd intervenes between the time when the sheet feed start sensor 66 turns on and the time when the registration motor 101 actually starts rotating. The delay Dd defines the operation timing of the motor 101 by using the ON signal of the sensor 66 appearing at the angular position θ' of 104° of the press drum 20 as a trigger.

Assume that the tray 143 of the upper sheet feeding section 201 and its sheet size are selected and set (YES, step S30). Then, the upper up-down motor 141 raises the tray 143 until the upper limit sensor 137 senses the top sheet of the tray 143 (step S56).

When the press drum 20 is rotated to the angular position θ' of 0°, the interrupter 70 interrupts the optical path of the sheet feed start sensor 66 as in the step S33 (YES, step S57). The resulting ON signal output from the sensor 66 is sent to the printer sheet feed controller 88. In response, the controller 88 informs the bank sheet feed controller 148 of the turn-on of the sensor 66 by serial communication (step S58). Subsequently, whether or not the trailing edge of the preceding sheet P has moved away from the registration sensor 135 is determined (step S59). This is to obviate the previously stated occurrence. If the answer of the step S59 is NO, meaning that the trailing edge of the preceding sheet P has moved away from the sensor 135, the sheet feed motor 107 is driven forward to cause the sheet feeding means 29-1 to start picking up the sheet P in FIG. 15 (step S60). More specifically, the separation roller 32 and pickup roller 30 of the sheet feeding means 29-1 are rotated clockwise, as viewed in FIG. 16, by way of the operation of the drive mechanism 125B. As a result, only the top sheet P is paid out in the direction X1.

Because the set print speed is lower than the standard print speed the third, second or first speed or the trial print speed lower than the standard speed, the sheet feed controller 148 causes the sheet feed motor 107 to rotate in the forward direction. Therefore, the separation roller 32 and pickup roller of the sheet feeding means 29-1 convey the sheet P at a speed corresponding to the standard or third print speed (90 rpm), i.e., at a peripheral speed of 847.8 mm/sec.

Subsequently, whether or not the registration sensor 135 has turned on, i.e., whether or not the leading edge of the sheet P being paid out has reached the registration sensor 135 is determined (step S61). If the answer of the step S61 is YES, meaning that the above leading edge has reached the sensor 135, the sheet feed motor 107 is driven forward by a designated number of steps to rotate the separation roller 32 and pickup roller 30 by a preselected amount. As a result, the leading edge of the sheet P abuts against the portion just upstream of the nip between the registration rollers 106*a* and 106*b* and forms an adequate loop. Thereafter, the sheet feed motor 107 is deenergized (steps S62 and S63).

In the illustrative embodiment, to cause the leading edge of the sheet P to form an adequate loop, the above rotation of the separation roller 32 and pickup roller 30 conveys the sheet P by the same amount as the rotation of the separation roller 32 and pickup roller 30 of the lower sheet feeding means 29-2. To control the sheet feed motor 107 in accordance with the above amount of sheet feed, the sheet feed controller 148 translates the amount of sheet feed into a number of steps and delivers the number of steps to the motor 107. Consequently, the motor 107 causes the separation roller 32 and pickup roller 30 of the sheet feeding mean 29-1 to convey the sheet P by the amount for forming an adequate loop.

In the case of sheet feed from the bank sheet feeding section 200, the bank sheet feed controller 148 controls the sheet feed motor 107 independently of the driveline assigned to the ink drum 1 in such a manner as to effect the unique loop adjustment. Specifically, the leading edge of the sheet P abuts against the portion just upstream of the nip between the registration rollers 106*a* and 106*b* and forms the preselected loop PA. This successfully obviates a short loop at low print speeds without regard to the print speed varying every minute due to the aging of a belt included in the ink drum driveline and the backlashes of gears. Further, the sheet P is prevented from skewing or from being not fed due to the rotation of the registration rollers 106*a* and 106*b*, and can therefor stably form the expected loop.

Subsequently, the registration motor 101 is driven forward by several steps until the registration rollers 106*a* and 106*b* nip the leading edge of the sheet P (step S64). This is followed by the step S49 stated earlier.

Assume that a sheet P is to be fed from the tray 145 of the lower sheet feeding section 202, and that the operator selects and sets the fourth print speed on the print speed key 96. Then, the main motor 150 drives the ink drum 1 and press drum 20 at a speed matching with the set fourth print speed. Because the set print speed is higher than the standard speed, the bank sheet feed controller 148 drives the sheet feed motor 107 such that the intermediate rollers 118*a* and 118*b* convey the sheet P at a speed corresponding to the fourth print speed (105 rpm), i.e., a peripheral speed of 989.1 mm/sec. Again, the sheet P is subjected to loop adjustment as during trial printing.

Assume that the operator selects the fifth or highest print speed on the print speed key 96. Then, the main motor 150 rotates the ink drum 1 and press drum 20 in such a manner as to implement a print speed corresponding to the set fifth speed. Because the set print speed is higher than the standard speed, the bank sheet feed controller 148 drives the sheet feed motor 107 in the reverse direction such that the intermediate rollers 118*a* and 118*b* convey the sheet P at a speed corresponding to the set fifth print speed (120 rpm), i.e., a peripheral speed of 1,130.4 mm/sec. Again, the sheet P is fed by an amount subjected to the previously stated loop adjustment.

On the other hand, assume that a sheet P is to be fed from the tray 143 of the upper sheet feeding section 201, and that the operator selects the fourth print speed higher than the standard speed. Then, the sheet feed controller 148 drives the sheet feed motor 107 forward such that the separation roller 32 and pickup roller 30 of the upper sheet feeding means 29-1 convey the sheet at a speed corresponding to the set fourth print speed (105 rpm), i.e., a peripheral speed of 989.1 mm/sec. Again, the sheet P is fed by an amount subjected to the loop control.

Assume that the operator selects the fifth or highest print speed. Then, because the set print speed is higher than the standard speed, the bank sheet feed controller 148 drives the sheet feed motor 107 in the forward direction such that the separation roller 32 and pickup roller 30 of the sheet feeding means 29-1 convey the sheet P at a speed corresponding to the set fifth print speed (120 rpm), i.e., a peripheral speed of 1,130.4 mm/sec. Again, the sheet P is fed by an amount subjected to the previously stated loop adjustment.

The bank sheet feed controller 148 controls the sheet feed motor 107 independently of the driveline assigned to the ink drum 1 in such a manner as to effect the unique loop adjustment, as stated above. Specifically, the leading edge of the sheet P abuts against the portion just upstream of the nip between the registration rollers 106*a* and 106*b* and forms the preselected loop PA. This successfully obviates a short loop at low print speeds without regard to the print speed varying every moment due to the aging of a belt included in the ink drum driveline and the backlashes of gears. Further, the sheet P is prevented from skewing or from being not fed due to the rotation of the registration rollers 106*a* and 106*b*, and can therefore stably form the expected loop.

A step S5 and successive steps shown in FIG. 28 will be described with reference also made to FIGS. 23–27. In FIGS. 23–27, the sheet P fed from the bank 200 is indicated by a phantom line. Steps S5–S7 are identical with the steps S49–S51 of FIG. 31 and will not be described specifically in order to avoid redundancy. In a step S8, the registration motor 101 is driven to rotate the registration rollers 106*a* and 106*b*. When the intermediate sensor 54 senses the leading edge of the sheet P, the sheet feed motor 74 is driven in the reverse direction to rotate the intermediate rollers 55*a* and 55*b* (steps S9 and S10).

As shown in FIG. 20, a preselected delay Df occurs between the time when the registration motor 101 is driven and the time when the sheet feed motor 74 is driven in the reverse direction. The delay Df serves to reduce the duration of drive of the sheet feed motor 74 as far as possible. Specifically, as FIG. 20 suggests, the illustrative embodiment drives the sheet feed motor 74 over a relatively long period of time. For example, heat generated by a driver assigned to the motor 74 would result in, e.g., the loss of synchronism of the motor 74. It is to be noted that the above delay Df is not necessary if the duration of drive of the motor 74 is short.

The intermediate sensor 53 senses the leading edge of the sheet P being conveyed by the intermediate rollers 55*a* and 55*b*. The rollers 55*a* and 55*b* further convey the sheet P to the downstream side of the vertical transport path RZ. When the leading edge sensor 51 senses the leading edge of the sheet P (YES, step S11), the sensor 51 sends an ON signal to the printer sheet feed controller 88.

In the above condition, assume the set print speed is any one of the third, second, first and trail print speeds lower than the standard speed. Then, the sheet feed controller 88 drives the sheet feed motor 74 in the reverse direction such that the intermediate rollers 55*a* and 55*b* convey the sheet P at a speed corresponding to the standard or third speed (90 rpm), i.e., a peripheral speed of 847.8 mm/sec. If the set print speed is the fourth speed higher than the standard speed, the controller 88 drives the motor 74 in the reverse direction to cause the rollers 55*a* and 55*b* to convey the sheet P at a speed corresponding to the fourth speed (105 rpm), i.e., a peripheral speed of 989.1 mm/sec. Further, if the set print speed is the fifth or highest speed, the controller 88 drives the motor 74 in the reverse direction such that the rollers 55*a* and 55*b* convey the sheet at a speed corresponding to the fifth speed (120 rpm), i.e., a peripheral speed of 1,130.4 mm/sec.

As shown in FIG. 6, the above intermediate rollers 55*a* and 55*b* feed the sheet P by a preselected amount such that the leading edge of the sheet P abuts against the portion just upstream of the nip between the registration rollers 33 and 33*b* and forms the preselected loop PA. Specifically, the controller 88 sends particular drive pulses to the sheet feed motor 74 via the driver, depending on whether the sheets P is fed from the upper sheet feeding section 201 or whether it is fed from the lower feeding section 202 and on the sheet size. As a result, the rollers 55*a* and 55*b* convey the sheet P by a preselected amount (step S12).

The preselected loop PA is confined in an experimentally determined range capable of preventing the sheet P from skewing or being not fed due to the rotation of the registration rollers 33 and 33*b*, and capable of providing the loop PA with a size adequate enough to reduce noise. To implement such a loop PA, the controller 88 drives the sheet feed motor 74 in the reverse direction such that the sheet P paid out from the upper sheet feeding section 201 is conveyed by a greater amount than the sheet P paid out from the lower sheet feeding section 202, taking account of a sheet conveyance load, among others.

As stated above, the printer sheet feed controller 88 controls the sheet feed motor 74 independently of the driveline assigned to the ink drum 1 in such a manner to effect the unique conveyance speed adjustment and loop adjustment. This successfully obviates a short loop at low print speeds without regard to the print speed varying every moment due to the aging of a belt included in the ink drum driveline and the backlashes of gears. Further, the sheet P is prevented from skewing or from being not fed due to the rotation of the registration rollers 33*a* and 33*b*, and can therefor stably form the expected loop. Further, noise can be reduced at the standard print speed. In addition, a short loop is obviated with consideration given to noise reduction at high print speeds.

Subsequently, as shown in FIGS. 20 and 21A, when the press drum 20 is further rotated counterclockwise to an angular position θ' of 307°, the interrupter 69 interrupts the optical path of the sheet feed start sensor 65. The sensor 65 therefore turns on and sends an ON signal to the printer sheet feed controller 88. The controller 88 drives the registration motor 58 on the elapse of the delay Db since the receipt of the ON signal (steps S13 and S14). The motor 58 rotates the registration roller 33*b* counterclockwise and causes it to start conveying the leading edge of the sheet P toward the sheet clamper 21 of the press drum 20 (step S15).

After the leading edge of the sheet P has moved away from the nip between the registration rollers 33*a* and 33*b*, it is subjected to conveyance and printing at a print speed and a conveyance speed matching with a set print speed by unique operations which will be described hereinafter.

Assume that the above sheet P is of size A4 or greater. Then, the sheet feed motor 74 is driven in the reverse direction for a short period of time such that the intermediate rollers 55*a* and 55*b* perform unique assist or auxiliary rotation (step Sl6). This assist rotation successfully reduces a load acting on the registration rollers 33*a* and 33*b* and prevents the sheet P from slipping at the nip between the rollers 33*a* and 33*b*.

More specifically, the sheet feed motor 74 is driven to vary the conveying speed of the intermediate rollers 55*a* and 55*b* in order to maintain the loop PA of the sheet just upstream of the nip between the registration rollers 33*a* and 33*b* adequate. This is done in accordance with the position of the sheet feeding section, sheet size and print speed while the rollers 33*a* and 33*b* are conveying the sheet P. The above conveying sheet of the rollers 55*a* and 55*b* is stored in the ROM beforehand in the form of a control table. With the control table, it is possible to prevent the loop PA formed at the upstream side of the rollers 33*a* and 33*b* in the direction Z from disappearing or growing excessively while the rollers 33*a* and 33*b* are conveying the sheet S toward the sheet clamper 21. It was experimentally found that when the sheet size was B5 or smaller, the assist rotation of the rollers 55*a* and 55*b* was not necessary.

The above control executed by the printer sheet feed controller 88 over the conveying speed of the intermediate rollers 55*a* and 55*b* is far more advantageous over the conventional sheet conveyance relying only on the registration rollers 33*a* and 33*b*. The conventional conveyance is apt to dislocate an image on the sheet S due to scattering in the amount of conveyance, to limit the kind of sheets to convey, or to fail to follow high speed conveyance. For high speed conveyance, the conveying speed of the registration rollers 3*a* and 33*b* would have to be lowered.

Further, the sheet feed motor 74 implemented by a stepping motor exhibits sharp response when caused to rotate. In addition, the above control reduces noise ascribable to the sudden disappearance of the loop PA and a load to act on the registration rollers 33*a* and 33*b* and ascribable to the same.

In FIG. 20, the assist rotation of the intermediate rollers 55*a* and 55*b* is indicated by a phantom line. As shown, on the elapse of the delay De since the start of rotation of the registration motor 58, i.e., the registration rollers 33*a* and 33*b*, the sheet feed motor 74 causes the rollers 55*a* and 55*b* to perform the assist rotation. That is, the delay De intervenes between the time when the registration motor 58 starts its rotation and the time when the rollers 55*a* and 55*b* start their assist rotation. The delay De is therefore set for each of different conveying speeds (peripheral speeds or linear velocities) in order to define the operation timing of the sheet feed motor 74, i.e., the operation timing of the rollers 55*a* and 55*b* (step S17).

As stated above, in the step S18, the intermediate rollers 55*a* and 55*b* start their assist rotation. Specifically, the printer sheet feed controller 88 so controls the sheet feed motor 74 as to vary the conveying speed of the rollers 55*a* and 55*b* in accordance with the position of the sheet feeding section selected as well as the sheet size and print speed. Further, in the illustrative embodiment, the registration rollers 106*a* and 106*b* disposed in the bank sheet feeding section 200 convey the leading edge of the sheet P toward the registration rollers 33*a* and 33*b*. These registration rollers 106*a* and 106*b* cause a minimum of skew, lateral misregistration and crease to occur during sheet feed form the sheet feeding section 200. Moreover, the sheet conveyance control described above allows the sheets P to be fed toward the registration rollers 33*a* and 33*b* at a constant timing and therefore corrects the variation of the amount of sheet feed which may occur between the sheet feeding section 200 and the registration rollers 33*a* and 33*b* due to, e.g., the slip of the sheet P.

Assume the condition shown in FIG. 21C in which the registration rollers 33*a* and 33*b* convey the sheet P from the position where its leading edge abuts against the portion just upstream of the nip between the registration rollers 33*a* and 33*b* to the downstream side of the transport path RX by Xb mm (19 mm in the illustrative embodiment). Then, he registration sensor 52 turns on with the result that slip correction is effected in the same manner as during sheet feed from the auxiliary sheet feeding section 28.

After the above slip correction, the printer sheet feed controller 88 receiving the output pulses of the encoder sensor 61 controls the registration motor 58 such that the leading edge of the sheet P meets the sheet clamper 21 brought to its clamp position (FBC, FIG. 21A). In this case, the printer sheet feed controller 88 executes control different from the control described in relation to the auxiliary sheet feeding section 28, as follows. The controller 88 executes feedback control meant for the sheet feed motor 74 in accordance with the output pulses of the encoder sensor 61 in addition to the feedback control meant for the registration motor 58. By controlling the sheet feed motor 74, it is possible to prevent the loop PA of the sheet P from becoming excessively great or disappearing on the basis of the rotation of the intermediate rollers 55*a* and 55*b*.

As stated above, the amount in which the sheet P is conveyed by the registration motor 58 and sheet feed motor 74 in response to a single pulse and the amount in which the circumference of the press drum 20 is moved in response to a single pulse width of the encoder 60 are identical. For FBC, the printer sheet feed controller 88 counts a period of time necessary for a single pulse width of the encoder 60 with the timer thereof and decelerates the registration motors 58 and 74 if the above period of time increases due to, e.g., a change in the load acting on the press drum 20. Conversely, when the period of time necessary for a single pulse of the encoder 60 decreases, the controller 88 accelerates the motors 58 and 74.

Stated another way, the controller 88 constantly detects the advance or the delay of the leading edge of the sheet P being conveyed by the registration rollers 33*a* and 33*b* and corrects both of the conveying speed of the rollers 33*a* and 33*b* and the conveying speed of the intermediate rollers 55*a* and 55*b*. The controller 88 constantly traces the irregular rotation, i.e., irregular peripheral speed of the press drum 20 in terms of changes in the pulses output from the encoder 61. The controller 88 variably controls the rotation speeds of the registration motor 58 and sheet feed motor 74 in accordance with the variation of pulses output from the encoder 61 (FBC using the encoder 61). At this instant, the controller 88 determines the angular position of the press drum 20 in terms of the number of pulses sensed by the encoder sensor 61 and determines the peripheral speed of the drum 20 in terms of the period of time t also sensed by the encoder sensor 61. As shown in FIG. 22, the controller 88 further varies the drive pulse width (t1–t4) for the registration motor 58 in order to control the motors 58 and 74 by feedback control. This reduces misregistration and thereby increases registration accuracy.

Under the above encoder feedback control executed by the printer sheet feed controller 88, the upper registration roller 33*a* is rotated clockwise by the lower registration roller 33*b* rotating clockwise via the sheet P. This, coupled with the fact that the intermediate roller 55*b* is rotated clockwise via the sheet P, causes the loop PA of the sheet P to disappear little by little. When the intermediate sensor 53 turns off, i.e., when the trailing edge of the sheet P moves away from the sensor 53, the sheet feed motor 74 is caused to stop rotating in the reverse direction, causing the intermediate rollers 55*a* and 55*b* to stop their assist rotation. When the ink drum 1 reaches an angular position θ' of 75° (the press drum 20 also reaches the same angular position), the registration motor 58 is deenergized with the result that the registration rollers 33*a* and 33*b* stop rotating. This is followed by the routine for managing the sheet feed condition (steps S22–S25).

In the step S16, if the sheet size is B5 or smaller which does not need the assist rotation of the intermediate rollers 55*a* and 55*b*, then the operation is transferred to the step S23 in order to execute the steps described above. The operation to follow is identical with the sheet feeding and printing procedure relating to the auxiliary sheet feeding section 28 and will not be described in order to avoid redundancy.

The illustrative embodiment has the following various advantages in addition to the above advantages.

In a conventional sheet feeding device, a main motor assigned to the ink drum 1 and press drum 20 drives the separation roller 32 and pickup roller 30 via a sector gear system including belts and clutches. In this condition, the peripheral speeds of the separation rollers 32 and pickup rollers 30 of the sheet feeding means 29, 29-1 and 29-2 are dependent on the print speed slightly varying every moment. Therefore, the amount of the loop PA varies in accordance with the varying print speed. This brings about the skew and feed failure of a sheet ascribable to a short loop or noise ascribable to an excessive loop.

By contrast, in the illustrative embodiment, the interrupter 68 and sheet feed sensor 65 are mounted on the press drum 20 for determining the time when the leading edge of the sheet P should be fed toward the registration rollers 33*a* and 33*b*. The amount of loop is controlled on the basis of the output of the leading edge sensor 51 while the sheet feed motor 74 implemented by a stepping motor and independent of the main motor 150 drives the separation roller 32, pickup roller 30 and intermediate rollers 55*a* and 55*b*. With this configuration, the illustrative embodiment is capable of stably adjusting the amount of the loop and thereby reducing skew, feed failure and noise.

Generally, the coefficient of friction of the sheet P contacting the registration rollers 33*a* and 33*b* depends on the quality and thickness thereof. Even when sheets of the same quality and thickness are used, the slip of the sheet P increases due to the variation of conveying conditions (e.g. coefficient of friction between the sheet P and the registration rollers 33*a* and 33*b* or shape of the sheet P) ascribable to the varying environmental conditions including temperature and humidity. Also, the slip increases when the registration rollers 33*a* and 33*b* wear or is contaminated by, e.g., paper dust or deteriorated due to aging. The slip is greatest when the leading edge of the sheet P begins to be conveyed by the registration rollers 33*a* and 33*b*. In the illustrative embodiment, the registration sensor 52 is capable of determining the position of the leading edge of the sheet P. The interrupter 69 and sheet feed start sensor 65 are mounted on the press drum 20 for determining the time when the leading edge of the sheet P should be fed toward the sheet clamper 21. The printer sheet feed controller 88 corrects the slip of the sheet P on the basis of the output of the registration sensor 52 while controlling the registration motor 58 by FBC using the pulse encoder (encoder 60 and encoder sensor 61). The sheet clamper 21 can therefore clamp the sheet P surely and stably, preventing the sheet P from rolling up more positively. In addition, the sheet P can be fed toward the sheet clamper 21 with enhanced stability and reliability, so that accurate registration is further enhanced.

The driveline assigned to the registration rollers 33*a* and 33*b* is independent of the driveline including the main motor 150 and assigned to the ink drum 1 and press drum 20. This reduces the load to act on the driveline including the main motor 150 and therefore power required of the main motor 150. Therefore, the illustrative embodiment reduces the cost of the main motor 150.

Because the registration drive means is implemented by the registration motor 58 which is a stepping motor, mechanical parts for braking the registration rollers 33*a* and 33*b* while regulating the direction of rotation thereof are not necessary. This not only reduces the cost of the sheet feeding device, but simplifies the programs of the control unit. In addition, calculations are sped up to provide FBC with an accurate following ability.

The sheet feed drive means and sheet conveyance drive means are implemented by the sheet feed motor 74 which is also a stepping motor 74. Such means therefore exhibit sharp response at the time of drive and obviate the need for mechanical parts for regulating the direction of the separation roller 32, thereby reducing the cost of the device. In addition, the driveline assigned to the separation roller 32 and pickup roller 30 is independent of the driveline including the main motor 150 and assigned to the ink drum 1 and press drum 20. This reduces the load to act on the driveline including the main motor 150 and therefore further reduces power required of the main motor 150. Therefore, the illustrative embodiment further reduces the cost of the main motor 150.

The bank sheet conveyance drive means is implemented by the bank sheet feed motor 107 which is also a stepping motor. Such means therefore exhibit sharp response at the time of drive and obviate the need for mechanical parts for regulating the directions of rotation of the separation rollers 32 and pickup rollers 30 of the sheet feeding sections 29-1 and 29-2, thereby reducing the cost of the device. In addition, the driveline assigned to the separation rollers 32 and pickup rollers 30 is independent of the driveline including the main motor 150 and assigned to the ink drum 1 and press drum 20. This reduces the load to act on the driveline including the main motor 150 and therefore further reduces power required of the main motor 150.

Therefore, the illustrative embodiment further reduces the cost of the main motor 150.

The bank registration drive means is implemented by the bank registration roller 101 which is also a stepping motor. Such means therefore exhibits sharp response at the time of drive. Again, the driveline is independent of the driveline including the main motor 150. This reduces the load to act on the driveline including the main motor 150 and therefore further reduces power required of the main motor 150.

A second embodiment of the present invention will be described hereinafter. This embodiment differs from the above embodiment mainly in that a printer sheet feed controller 88A and a bank sheet feed controller 148A are substituted for the printer sheet feed controller 88 and bank sheet feed controller 148, respectively.

The printer sheet feed controller 88A differs from the printer sheet feed controller 88 in the following respect. Assume that a sheet is fed from the auxiliary sheet feeding section 28, and that the operator inputs the fourth or fifth print speed higher than the standard speed on the DOWN key 96*a* or UP key 96*b*. Then, in response to a signal representative of the set print speed, the printer sheet feed controller 88A drives the sheet feed motor 74 forward such that the separation roller 32 and pickup roller 30 of the sheet feeding means 29 convey the sheet at a speed corresponding to the fifth or highest print speed, i.e., a peripheral speed of 1,130.4 mm/sec. When the set print speed is the third, second, first or trial print speed lower than the standard speed, the sheet feed motor 74 operates in the same manner as in the first embodiment.

Assume that a sheet is fed from the bank sheet feeding section 200, and that the operator inputs the fourth or fifth print speed higher than the standard speed on the DOWN key 96*a* or UP key 96*b*. Then, in response to a signal representative of the set print speed, the printer sheet feed controller 88A drives the sheet feed motor 74 in the reverse direction such that the intermediate rollers 55*a* and 55*b* convey the sheet at a speed corresponding to the fifth or highest print speed, i.e., a peripheral speed of 1,130.4 mm/sec. When the set print speed is the third, second, first or trial print speed lower than the standard speed, the sheet feed motor 74 operates in the same manner as in the first embodiment.

As for the bank sheet feed controller 148A, assume that a sheet is fed from the upper sheet feeding section 201, and that the operator inputs the fourth or fifth print speed higher than the standard speed on the DOWN key 96*a* or UP key 96*b*. Then, in response to a signal representative of the set print speed and transferred from the printer sheet feed controller 88A, the bank sheet feed controller 148A drives the bank sheet feed motor 107 forward such that the separation roller 32 and pickup roller 30 of the sheet feeding means 29-1 convey the sheet at the highest speed corresponding to the fifth or highest print speed, i.e., a peripheral speed of 1,130.4 mm/sec. When the set print speed is the third, second, first or trial print speed lower than the standard speed, the sheet feed motor 74 operates in the same manner as in the first embodiment.

Assume that a sheet is fed from the lower sheet feeding section 202 of the bank sheet feeding section 200, and that the set print speed input on the DOWN key 96*a* or the UP key 96*b* is the fourth or fifth print speed higher than the standard speed. Then, the bank sheet feed controller 148A drives the bank sheet feed motor 107 in the reverse direction such that the intermediate rollers 118*a* and 118*b* convey the sheet at a speed corresponding to the fifth print speed, i.e., a peripheral speed of 1,130.4 mm/sec.

The operation of the second embodiment will not be described in detail because it is analogous to the operation of the first embodiment.

A third embodiment of the present invention includes a printer sheet feed controller 88B and a bank sheet feed controller 148B in placed of the printer sheet feed controller 88 and bank sheet feed controller 148 of the first embodiment.

Assume that a sheet is fed from the auxiliary sheet feeding section 28. Then, in response to a signal representative of a set print speed input on the DOWN key 96*a* or the UP key 96*b*, the printer sheet feed controller 88B drives, without regard to the set print speed, the sheet feed motor 74 forward such that the separation roller 32 and pickup roller 30 of the sheet feeding means 29 convey the sheet at a speed corresponding to the fifth or highest print speed, i.e., a peripheral speed of 1,130.4 mm/sec.

Assume that a sheet is fed from the bank sheet feeding section 200. Then, in response to a signal representative of the set print speed and input on the DOWN key 96*a* or the UP key 96*b*, the printer sheet feed controller 88B drives, without regard to the set print speed, the sheet feed motor 74 in the reverse direction such that the intermediate rollers 55*a* and 55*b* convey the sheet at a speed corresponding to the fifth or highest print speed, i.e., a peripheral speed of 1,130.4 mm/sec.

As for the bank sheet feed controller 148B, assume that a sheet is fed from the upper sheet feeding section 201. Then, in response to a signal representative of the set print speed input on the DOWN key 96*a* or the UP key 96*b* and transferred from the printer sheet feed controller 88B, the bank sheet feed controller 148B drives the bank sheet feed motor 107 forward such that the separation roller 32 and pickup roller 30 of the sheet feeding means 29-1 convey the sheet at a constant speed corresponding to the fifth or highest print speed, i.e., a peripheral speed of 1,130.4 mm/sec. When the set print speed is the third, second, first or trial print speed lower than the standard speed, the sheet feed motor 74 operates in the same manner as in the first embodiment.

Assume that a sheet is fed from the lower sheet feeding section 202 of the bank sheet feeding section 200. Then, in response to a signal representative of the set print speed input on the DOWN key 96*a* or the UP key 96*b* and transferred from the printer sheet feed controller 88B, the bank sheet feed controller 148B drives the bank sheet feed motor 107 in the reverse direction such that the intermediate rollers 118*a* and 118*b* convey the sheet at a constant speed corresponding to the fifth print speed, i.e., a peripheral speed of 1,130.4 mm/sec.

The operation of the third embodiment will not be described in detail because it is also analogous to the operation of the first embodiment.

A first modification of the first embodiment will be described with reference to FIG. 19. As shown in FIGS. 17 and 19, the modification differs from the first embodiment of FIGS. 1–31 in that it uses the kind-of-sheet key 190 for inputting the kind of sheets to be used and includes a printer sheet feed controller 88C in place of the printer sheet feed controller 88.

Usually, a stencil printer, among others, is operated with various kinds of sheets including low quality sheets to high quality sheets, envelopes, and thin sheets to thick sheets. The slip on the registration rollers 33*a* and 33*b* noticeably differs from one kind of sheets to another kind of sheets. Therefore, should the registration motor 65 be simply driven on the basis of an ON signal output from the sheet feed start sensor 65, the sheet P could not be stably conveyed. In light of this, the modification varies the timing for driving the registration motor 58 in accordance with the kind of sheets. For this purpose, the modification causes the printer sheet feed controller 88C to additionally play the role of registration drive start varying means for varying the drive start point of the delay Db, FIG. 21A.

Specifically, when the operator inputs the kind of sheets on the kind-of-sheet key 190, the printer sheet feed controller 88C varies the drive start point of the delay Db by using the ON output of the sheet feed start sensor 65 as a trigger. As a result, the timing for starting driving the registration motor 58 is varied in accordance with the kind of sheets. For example, as for thin sheets and thick sheets, the controller 88C sequentially reduces the delay Db from the thin sheets to the thick sheets. As for low quality sheets and high quality sheets as well as envelopes, optimal delay DB ranges may also be determined by, e.g., experiments.

The above control is also applicable to the registration motor 101 assigned to the bank sheet feeding section 200. Specifically, a bank sheet feed controller 148C replacing the bank sheet feed controller 148 may vary the drive start point of the delay Db, i.e., the start timing of the bank registration motor 101 by using the ON output of the bank sheet feed start sensor 66.

A second modification of the first embodiment will be described with reference to FIG. 19. As shown, this modification differs from the first modification mainly in that it includes a kind-of-sheet sensor 195, a bank upper kind-of-sheet sensor 195-1 and a bank lower kind-of-sheet sensor 195-2 (collectively kind-of-sheet sensing means) in place of the kind-of-sheet key 190, and a printer sheet feed controller 88D in place of the printer sheet feed controller 88C.

The kind-of-sheet sensors 195, 195-1 and 195-2 each may be of the type optically sensing the intensity of transmitted light representative of the thickness of the sheet P or of the type mechanically measuring a sheet thickness with an electrical sensor by increasing a gap between rollers. To vary the drive start point of the delay Db, the printer sheet feed controller 88D additionally plays the role of registration drive start varying means for varying the drive start point of the delay Db, i.e., the start timing of the registration motor 58. The control of the second modification will not be described in because it is analogous to the control of the first modification.

The above control is also applicable to the registration motor 101 assigned to the bank sheet feeding section 200. Specifically, a bank sheet feed controller 148D replacing the bank sheet feed controller 148C may vary the drive start point of the delay Db, i.e., the start timing of the bank registration motor 101 by using the ON output of the bank sheet feed start sensor 66.

In the first and second modifications, the delays Db and Dd may be set on the basis of time or on the basis of the rotation of the press drum 20 sensed by the pulse encoder including the encoder sensor 61. Because the printer sheet feed controller 88C or 88D and bank sheet feed controller 148C or 148D each are implemented by a microcomputer, the delays Db and Dd may be set and counted by the timer included in the microcomputer and variably controlled.

Figure 31A:
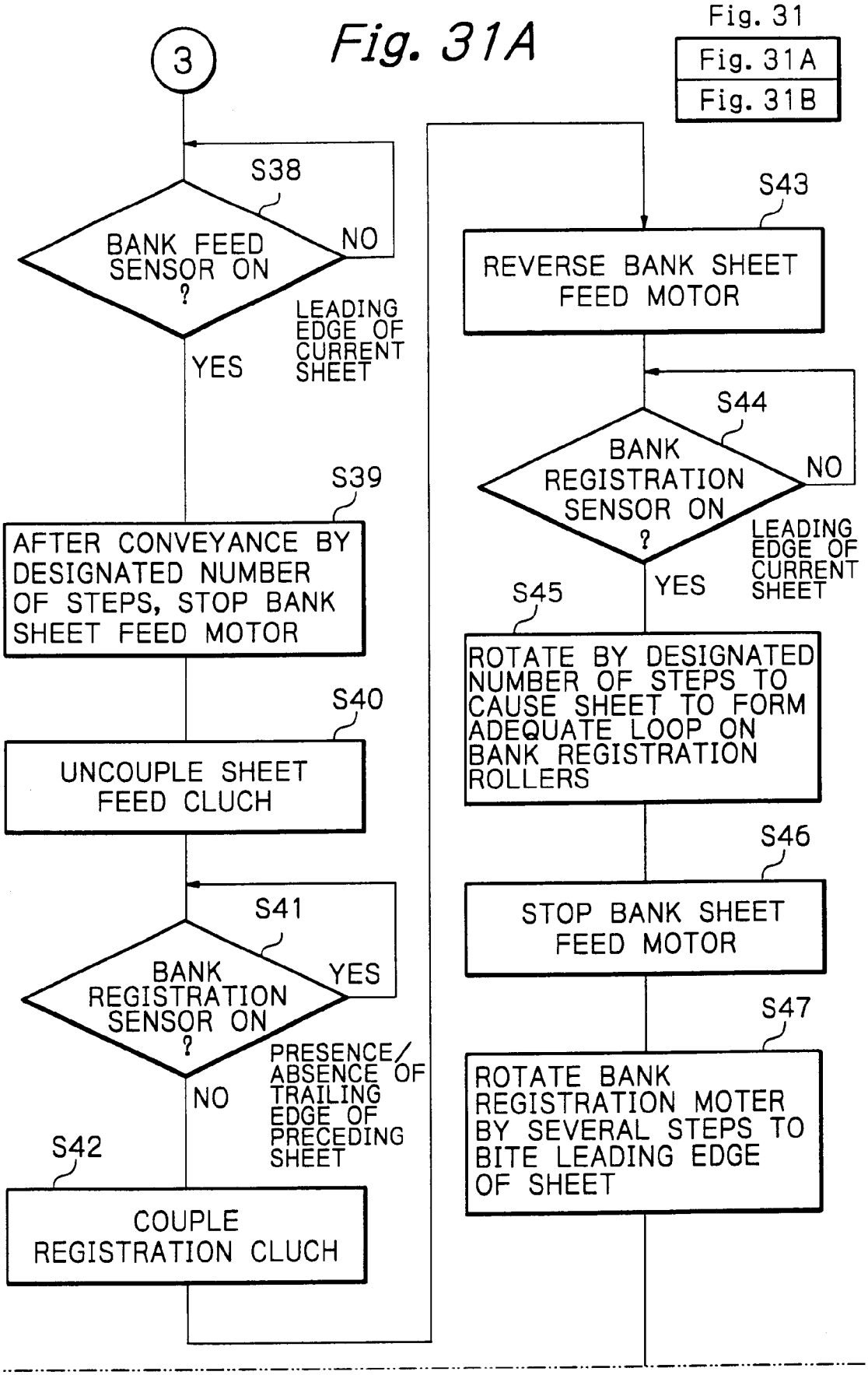
Figure 31B:
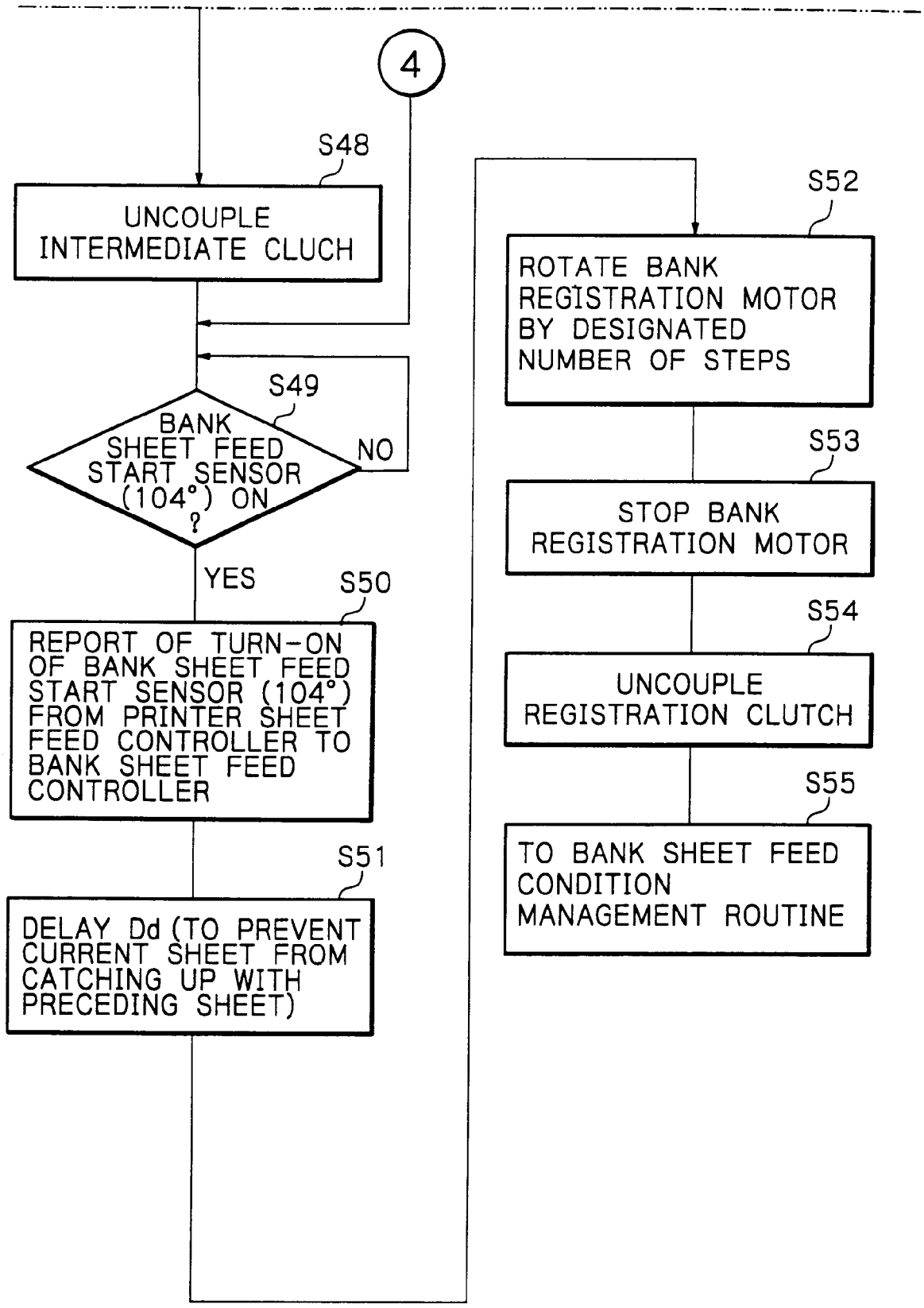
Figure 32:
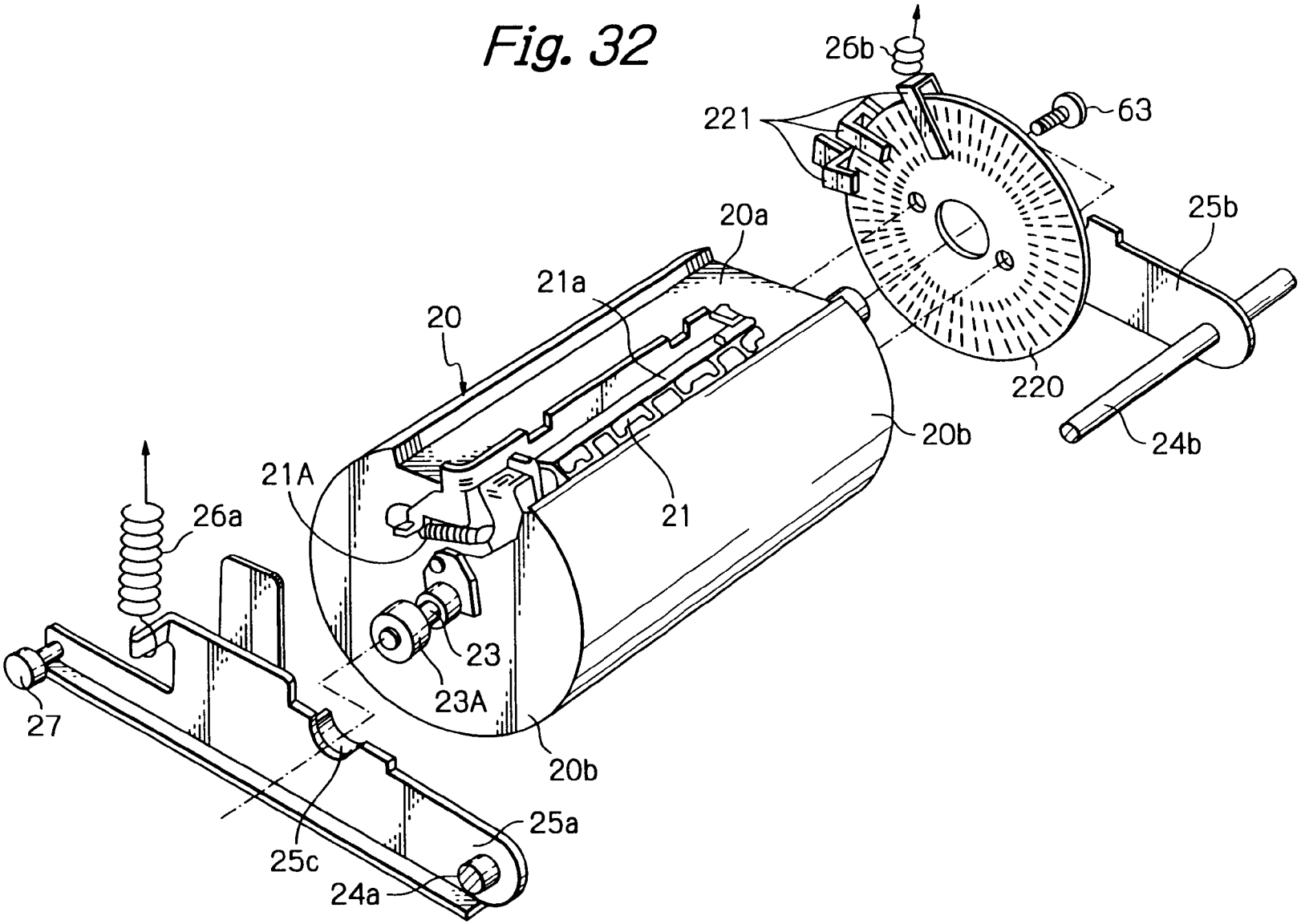
FIG. 32 is an exploded isometric view showing a structure for mounting parts around the ink drum in accordance with a modification of the first embodiment.

A third modification of the first embodiment will be described with reference to FIGS. 1–31. The third modification does not include the interrupters 68–71, sheet feed sensors 65 and 66, incremental encoder 60, and encoder sensor 61. As shown in FIG. 32, the third embodiment includes an absolute pulse encoder mounted on the press drum 20 and capable of sensing the variation of the rotation speed and the position of the press drum 20, i.e., an absolute amount of rotation.

Specifically, the absolute pulse encoder includes a multichannel photoencoder 220 mounted on the end wall 20*b* of the press drum 20 and formed with a number of concentric radial slits in its peripheral portion. A plurality of encoder sensors 221 are mounted on the arm 25*b*, and each sandwiches the peripheral portion of the photoencoder 220. The control available with the third modification is identical with the control of the first embodiment except that a single absolute encoder replaces the interrupters 69–71, sensors 65 and 66, incremental encoder 60, and encoder sensor 61.

Again, the delay Da intervenes between the time when the encoder sensor 221 outputs an ON pulse representative of the preselected angular position of the press drum 20 and the time when the sheet feed motor 74 begins to be driven. The other delays Db, Dc, Dd, De and Df are also set in the same manner as in the first embodiment.

The third embodiment is capable of reducing the number of parts for control although the control may be expensive and sophisticated at the present stage of development, while achieving the same advantages as the first and second embodiments and first and second modifications.

Technical arrangements unique to the present invention may be summarized as follows.

(1) In a first technical arrangement, a stencil printer includes an ink drum for wrapping a master therearound, a press drum including clamping means for clamping the leading edge of a sheet fed thereto and having substantially the same outside diameter as the ink drum, and registering means for feeding the leading edge of the sheet toward the clamping means. The press drum is pressed against the ink drum relative to the ink drum at the time of printing. A pulse encoder is used to control a timing for feeding the leading edge of the sheet toward the clamping means and includes an encoder sensor responsive to the variation of at least the rotation speed of the press drum. Registration drive means drives the registering means. Leading edge sensing means is located on a transport path between the press drum and the registering means for sensing the leading edge of the sheet. Registration drive control means controls, based on a signal output from the leading edge sensing means, the registration drive means for compensating for a slip of the sheet on the registering means. Subsequently, the registration drive control means controls, in response to a pulse signal output form the encoder sensor, the registration drive means for feeding the leading edge of the sheet in synchronism with the rotation of the clamping means.

The pulse encoder is of the incremental type capable of sensing the variation of rotation speed to thereby determine a relative amount of rotation or of the absolute type capable of sensing the variation of rotation speed and a position to thereby determine an absolute amount of rotation. The pulse encoder included in the first arrangement senses at least the variation of rotation speed of the press drum and therefore includes both of the incremental type and absolute type pulse encoders. While the pulse encoder should preferably be implemented by a photoencoder from the stability and reliability standpoint, it may be implemented by, e.g., a magnetic encoder if stability and reliability are not of primary importance. The pulse encoder should preferably be mounted on the press roller or may be mounted on a main motor for driving the ink drum or on the ink drum.

In the first arrangement, a second technical arrangement is characterized in that the registration drive control means is implemented by a stepping motor and controls the registration drive means by varying the number of drive pulses to be fed thereto.

In the second arrangement, a third technical arrangement is characterized in that after compensating for the slip of the sheet, the registration drive control means controls the registration drive means by feedback control in accordance with the output pulse signal of the encoder sensor and by varying the pulse width.

In the second arrangement, a fourth technical arrangement is characterized in that a delay time is provided between the time when the encoder sensor starts outputting the pulse signal and the time when the registration drive means begins to be driven (drive start point). Registration drive start varying means varies the drive start point and therefore the delay time in accordance with the kind of sheets.

In the first, second or third arrangement, a fifth technical arrangement is characterized in that timing sensing means is mounted on the press drum for determining a timing for feeding the leading edge of the sheet toward the clamping means.

In the fifth arrangement, a sixth technical arrangement is characterized in that a delay time is provided between the time when the timing sensing means outputs an ON signal and the drive start point at which the registration drive means begins to be driven. Registration drive start varying means varies the drive start point and therefore the delay in accordance with the kind of sheets.

In the fourth or sixth arrangement, a seventh technical arrangement is characterized in that the registration drive control means bifunctions as the registration drive start varying means.

In the fourth and sixth arrangements, the delay times may be set on the basis of time or on the basis of the angular position of the press drum sensed by an encoder including an encoder sensor. When the registration drive control means is implemented by a microcomputer, the delay times may be set and counted by a timer included in the microcomputer. In this case, a CPU included in the microcomputer is capable of playing the role of the registration drive varying means by suitably reading delay times matching with the kind of sheets out of a ROM also included in the microcomputer or out of an external storage.

In the fourth, six or seventh arrangement, an eighth technical arrangement is characterized in that kind-of-sheet setting means allows the kind of sheets to be set.

In the fourth, sixth or seventh arrangement, a ninth technical arrangement is characterized in that kind-of-sheet sensing means senses the kind of sheets.

In any one of the first to ninth arrangements, a tenth technical arrangement is characterized in that sheet feed timing sensing means determines a timing for feeding the leading edge of the sheet toward the registering means.

In the tenth arrangement, an eleventh technical arrangement is characterized in that sheet feeding means feeds the leading edge of the sheet toward the registering means, and in that sheet feed drive control means controls the sheet feed drive means in responsive to a signal output from the sheet feed timing sensing means for thereby feeding the leading edge of the sheet toward the registering means.

In the eleventh arrangement, a twelfth technical arrangement is characterized in that the sheet feed drive means is implemented by a stepping motor.

In any one of the first to twelfth arrangements, a thirteenth technical arrangement is characterized in that the leading edge sensing means functions to detect a sheet jam.

In the first and other arrangements, the outside diameter of the press drum substantially the same as the outside diameter of the ink drum may include a design tolerance. To press the press drum against the ink drum relative to the ink drum, the press drum may be pressed against the ink drum, or the ink drum may be pressed against the press drum, or the ink drum and press drum may be pressed against each other. The press drum movable into and out of contact with the ink drum may be implemented by the press drum and moving means included in the illustrative embodiments.

For the control means, bank registration drive control means, bank sheet feed drive control means, registration drive control means and sheet feed drive control means, use may advantageously be made of a microcomputer or a microprocessor including a CPU, I/O ports, ROM, RAM and a timer.

For the bank registration timing sensing means, bank sheet feed timing sensing means, timing sensing means and sheet feed timing sensing means, use may advantageously be made of transmission type optical sensors (photointrrupter type photosensors) and interrupters from the stable and reliable operation standpoint. Of course, use may be made of reflection type optical sensors which are low cost and stably operable.

For the bank leading edge sensing means and leading edge sensing means, use may advantageously be made of reflection type optical sensors which are inexpensive and stably operable. To further enhance stability and reliability, the reflection type optical sensors may be replaced with transmission type optical sensors and interrupters. The optical sensors may, of course, be replaced with, e.g., microswitches having mechanical contacts if importance is not attached to stabilization or reliability.

The press drum movable into and out of contact with the ink drum refers also to a member movable substantially in synchronism with the press drum. Likewise, the ink drum movable into and out of contact with the press drum refers also to an apparatus body adjoining the ink drum.

The bank sheet feeding means and sheet feeding means each may be implemented by a pickup roller and a pair of separation rollers, by a loosening roller (pickup roller bifunctioning as a separation roller) taught in Japanese Patent Publication No. 5-32296, or by the pickup roller, separation roller and separation pad included in the illustrative embodiments.

In summary, it will be seen that the present invention provides a sheet feeding device for a printer having various unprecedented advantages, as enumerated below.

(1) Sheet conveyance drive means independent of a driveline assigned to an ink drum so drives sheet conveying means as to set up a constant sheet conveying speed without regard to a print speed input on print speed setting means. It is therefore possible to obviate a short loop and therefore skew and feed failure without regard to the print speed varying every moment due to the extension of a belt included in the ink drum driveline due to aging and the backlashes of gears.

(2) The sheet conveyance drive means drives, if the set print speed is higher than a standard print speed, the sheet conveying means in such a manner as to set up a sheet conveying speed matching with the set print speed or drives, if the set print speed is lower than the standard print speed, the sheet conveying means in such a manner as to set up a sheet conveying speed matching with the standard print speed. It is therefore possible to obviate a short loop and therefore skew and feed failure at low print speeds without regard to the print speed varying every moment due to the extension of the above belt and the backlashes of gears, while taking account of the noise of the entire printer ascribable to sheet conveyance. In addition, noise at speeds lower than the standard print speed predominant over the other speeds is reduced.

(3) The sheet conveyance drive means drives, if the set print speed is higher than a standard print speed, the sheet conveying means in such a manner as to set up a sheet conveying speed matching with the highest print speed or drives, if the set print speed is lower than the standard print speed, the sheet conveying means in such a manner as to set up a sheet conveying speed matching with the standard print speed. This is also successful to achieve the above advantage (2).

(4) In response to a signal output from leading edge sensing means positioned on a transport path between registering means and sheet conveying means, control means controls the sheet conveyance drive means such that the leading edge of a sheet abuts against the registering means and forms a preselected loop. Generally, a load acting on sheet conveyance depends on the transport path or the sheet size while the coefficient of friction of the sheet contacting the sheet conveying means depends on the quality and thickness thereof. Even when sheets of the same quality and thickness are used, the slip of the sheet increases due to the variation of conveying conditions (e.g. coefficient of friction between the sheet and the sheet conveying means or intermediate rollers or shape of the sheet) ascribable to the varying environmental conditions including temperature and humidity. Also, the slip increases when the sheet conveying means wears or is contaminated by, e.g., paper dust or deteriorated due to aging. The leading edge sensing means senses the position of the leading edge of the sheet when the slip increases in order to further stabilize the loop, thereby surely obviating skew and feed failure.

(5) The press drum having substantially the same outside diameter as the ink drum is pressed against the ink drum relative to the ink drum. This prevents the sheet from rolling up, reduces noise, and enhances accurate registration.

(6) Bank registering means for feeding the leading edge of the sheet toward registering means is included in a bank sheet feeding section independently of the registering means. This reduces the skew, lateral misregistration and crease of the sheet when the sheet is fed from the bank sheet feeding section. Further, the timing for feeding the sheet toward the registering means of the printer body is free from irregularity, so that a change in the amount of sheet conveyance ascribable to, e.g., the slip of the sheet occurring between the bank sheet feeding section and the registering means is compensated for. Moreover, bank sheet conveyance drive means independent of the driveline assigned to the ink drum so drives bank sheet conveying means as to set up a constant sheet conveying speed without regard to the print speed input on the print speed setting means. It is therefore possible to obviate a short loop and therefore skew and feed failure without regard to the print speed varying every moment due to the extension of a belt included in the ink drum driveline due to aging and the backlashes of gears.

(7) When the set print speed is higher than the standard print speed, the bank sheet conveyance drive means drives the sheet conveying means in such a manner as to set up a conveying speed matching with the set print speed. When the set print speed is lower than the standard print speed, the bank sheet conveyance drive means drives the sheet conveying means in such a manner as to set up a conveying speed matching with the standard print speed. It is therefore possible to obviate a short loop and therefore skew and feed failure at low print speeds without regard to the print speed varying every moment due to the extension of the above belt and the backlashes of gears, while taking account of the noise of the entire printer ascribable to sheet conveyance. In addition, noise at speeds lower than the standard print speed predominant over the other speeds is reduced.

(8) When the set print speed is higher than the standard print speed, the bank sheet conveyance drive means drives the bank sheet feeding means in such a manner as to set up a conveying speed matching with the highest set print speed. When the set print speed is lower than the standard print speed, the bank sheet conveyance drive means drives the bank sheet feeding means in such a manner as to set up a conveying speed matching with the standard print speed. It is therefore possible to obviate a short loop and therefore skew and feed failure at low print speeds without regard to the print speed varying every moment due to the extension of the above belt and the back lashes of gears, while taking account of the noise of the entire printer ascribable to sheet conveyance. In addition, noise at speeds lower than the standard print speed predominant over the other speeds is reduced.

(9) In response to a signal output from bank leading edge sensing means positioned on a transport path between the bank registering means and the bank sheet conveying means, control means controls the bank sheet conveyance drive means such that the leading edge of a sheet abuts against the bank registering means and forms a preselected loop. Generally, a load acting on sheet conveyance depends on the transport path or the sheet size while the coefficient of friction of the sheet contacting the bank sheet conveying means depends on the quality and thickness thereof. Even when sheets of the same quality and thickness are used, the slip of the sheet increases due to the variation of conveying conditions (e.g. coefficient of friction between the sheet and the sheet conveying means or intermediate rollers or shape of the sheet) ascribable to the varying environmental conditions including temperature and humidity. Also, the slip increases when the bank sheet conveying means wears or is contaminated by, e.g., paper dust or deteriorated due to aging. The bank leading edge sensing means senses the position of the leading edge of the sheet when the slip increases in order to further stabilize the loop, thereby surely obviating skew and feed failure.

(10) Bank registration timing sensing means is mounted on the press drum for determining a timing for the bank registering means to feed the leading edge of the sheet toward the registering means. This enhances the stability and reliability of the timing for feeding the sheet toward the registering means.

(11) Bank registration drive control means is capable of controlling, in response to a signal output from the bank registration timing sensing means, the bank registration drive means in such a manner as to feed the leading edge of the sheet toward the registering means.

(12) Bank sheet feed timing sensing means is mounted on the press drum for determining a timing for the bank sheet feeding means to feed the leading edge of the sheet toward the bank registering means. This enhances the stability and reliability of the timing for feeding the sheet toward the bank registering means.

(13) Bank sheet feed drive control means is capable of controlling, in response to a signal output from the bank registration timing sensing means, the bank sheet feed drive means in such a manner as to feed the leading edge of the sheet toward the bank registering means.

Various modifications will become possible for those skilled in the art after receiving the teachings of the present disclosure without departing from the scope thereof.

What is claimed is:

1. A sheet feeding device for a printer comprising an ink drum rotatable at a variable speed in accordance with any one of a plurality of print speeds with a master wrapped therearound, pressing means pressed against said ink drum relative to said ink drum with the intermediary of a sheet, registering means for feeding a leading edge of the sheet toward a print position between said ink drum and said pressing means, a bank sheet feeding section positioned below said print position, and sheet conveying means for conveying the sheet fed from said bank sheet feeding section toward said registering means, said sheet feeding device comprising:

print speed setting means for setting a print speed such that said ink drum rotates in accordance with a set print speed included in the plurality of print speeds; and sheet conveyance drive means independent of a driveline assigned to said ink drum for driving said sheet conveying means;

said sheet conveyance drive means driving, when the set print speed is higher than a standard print speed, said sheet conveying means in such a manner as to set up a sheet conveying speed matching with said set print speed or driving, when said set print speed is lower than said standard print speed, said sheet conveying means in such a manner as to set up a sheet conveying speed matching with said standard print speed.

2. A sheet feeding device as claimed in claim 1, further comprising:

leading edge sensing means positioned on a transport path between said registering means and said sheet conveying means for sensing the leading edge of the sheet; and control means for controlling, in response to a signal output from said leading edge sensing means, said sheet conveyance drive means such that the leading edge of the sheet abuts against said registering means and forms a preselected loop.

3. A sheet feeding device as claimed in claim 1, wherein said pressing means comprises a press drum having substantially a same outside diameter as said ink drum and pressed against said ink drum relative to said ink drum during printing.

4. A sheet feeding device for a printer comprising an ink drum rotatable at a variable speed in accordance with any one of a plurality of print speeds with a master wrapped therearound, pressing means pressed against said ink drum relative to said ink drum with the intermediary of a sheet, registering means for feeding a leading edge of the sheet toward a print position between said ink drum and said pressing means, a bank sheet feeding section positioned below said print position, and sheet conveying means for conveying the sheet fed from said bank sheet feeding section toward said registering means, said sheet feeding device comprising:

print speed setting means for setting a print speed such that said ink drum rotates in accordance with a set print speed included in the plurality of print speeds; and sheet conveyance drive means independent of a driveline assigned to said ink drum for driving said sheet conveying means;

said sheet conveyance drive means driving, when the set print speed is higher than a standard print speed, said sheet conveying means in such a manner as to set up a sheet conveying speed matching with a highest set print speed included in the plurality of print speeds or driving, when said set print speed is lower than said standard print speed, said sheet conveying means in such a manner as to set up a sheet conveying speed matching with said standard speed.

5. A sheet feeding device as claimed in claim 4, further comprising:

leading edge sensing means positioned on a transport path between said registering means and said sheet conveying means for sensing the leading edge of the sheet; and control means for controlling, in response to a signal output from said leading edge sensing means, said sheet conveyance drive means such that the leading edge of the sheet abuts against said registering means and forms a preselected loop.

6. A sheet feeding device as claimed in claim 4, wherein said pressing means comprises a press drum having substantially a same outside diameter as said ink drum and pressed against said ink drum relative to said ink drum during printing.

7. A sheet feeding device for a printer comprising an ink drum rotatable at a variable speed in accordance with any one of a plurality of print speeds with a master wrapped therearound, pressing means pressed against said ink drum relative to said ink drum with the intermediary of a sheet, registering means for feeding a leading edge of the sheet toward a print position between said ink drum and said pressing means, and a bank sheet feeding section for conveying the sheet toward said registering means, said sheet feeding device comprising:

bank registering means included in said bank sheet feeding section independently of said registering means for feeding the leading edge of the sheet toward said registering means;

bank sheet conveying means for feeding the leading edge of the sheet toward said bank registering means such that said leading edge of said sheet abuts against said bank registering means and forms a loop;

bank sheet conveyance drive means independent of a driveline assigned to said ink drum for driving said bank sheet conveying means; and print speed setting means for setting a print speed such that said ink drum rotates in accordance with a set print speed included in the plurality of print speeds;

said bank sheet conveyance drive means driving said bank sheet conveying means in such a manner as to set up a constant sheet conveying speed without regard to the set print speed set via said print speed setting means.

8. A sheet feeding device as claimed in claim 7, further comprising:

bank leading edge sensing means positioned on a transport path between said bank registering means and said bank sheet conveying means for sensing the leading edge of the sheet; and control means for controlling, in response to a signal output from said bank leading edge sensing means, said bank sheet conveyance drive means such that the leading edge of the sheet abuts against said bank registering means and forms a preselected loop.

9. A sheet feeding device as claimed in claim 7, wherein said pressing means comprises a press drum having substantially a same outside diameter as said ink drum and pressed against said ink drum relative to said ink drum during printing.

10. A sheet feeding device as claimed in claim 9, further comprising bank registration timing sensing means mounted on said press drum for determining a timing for said bank registering means to feed the leading edge of the sheet toward said registering means.

11. A sheet feeding device as claimed in claim 10, further comprising:

bank registration drive means for driving said bank registering means: and bank registration drive control means for controlling, in response to a signal output from said bank registration timing sensing means, said bank registration drive means for driving the leading edge of the sheet toward said registering means.

12. A sheet feeding device as claimed in claim 9, further comprising:

bank sheet feeding means for feeding the leading edge of the sheet from a bank tray to said bank registering means; and bank sheet feed timing sensing means mounted on said press drum for determining a timing for said bank registering means to feed the leading edge of the sheet toward said registering means.

13. A sheet feeding device as claimed in claim 12, further comprising:

bank sheet feed drive means for driving said bank sheet feeding means; and bank sheet feed drive control means for controlling, in response to a signal output from said bank sheet feed timing sensing means, said bank sheet conveyance drive means for feeding the leading edge of the sheet toward said bank registering means.

14. A sheet feeding device for a printer comprising an ink drum rotatable at a variable speed in accordance with any one of a plurality of print speeds with a master wrapped therearound, pressing means pressed against said ink drum relative to said ink drum with the intermediary of a sheet, registering means for feeding a leading edge of the sheet toward a print position between said ink drum and said pressing means, and a bank sheet feeding section for conveying the sheet toward said registering means, said sheet feeding device comprising:

bank registering means included in said bank sheet feeding section independently of said registering means for feeding the leading edge of the sheet toward said registering means;

bank sheet conveying means for feeding the leading edge of the sheet toward said bank registering means such that said leading edge of said sheet abuts against said bank registering means and forms a loop;

bank sheet conveyance drive means independent of a driveline assigned to said ink drum for driving said bank sheet conveying means; and print speed setting means for setting a print speed such that said ink drum rotates in accordance with a set print speed included in the plurality of print speeds;

said bank sheet conveyance drive means driving, when the set print speed is higher than a standard print speed, said bank sheet conveying means in such a manner as to set up a sheet conveying speed matching with said set print speed or driving, when said set print speed is lower than said standard print speed, said bank sheet conveying means in such a manner as to set up a sheet conveying speed matching with said standard print speed.

15. A sheet feeding device as claimed in claim 14, further comprising:

bank leading edge sensing means positioned on a transport path between said bank registering means and said bank sheet conveying means for sensing the leading edge of the sheet; and control means for controlling, in response to a signal output from said bank leading edge sensing means, said bank sheet conveyance drive means such that the leading edge of the sheet abuts against said bank registering means and forms a preselected loop.

16. A sheet feeding device as claimed in claim 14, wherein said pressing means comprises a press drum having substantially a same outside diameter as said ink drum and pressed against said ink drum relative to said ink drum during printing.

17. A sheet feeding device as claimed in claim 16, further comprising bank registration timing sensing means mounted on said press drum for determining a timing for said bank registering means to feed the leading edge of the sheet toward said registering means.

18. A sheet feeding device as claimed in claim 17, further comprising:

bank registration drive means for driving said bank registering means; and bank registration drive control means for controlling, in response to a signal output from said bank registration timing sensing means, said bank registration drive means for driving the leading edge of the sheet toward said registering means.

19. A sheet feeding device as claimed in claim 16, further comprising:

bank sheet feeding means for feeding the leading edge of the sheet from a bank tray to said bank registering means; and bank sheet feed timing sensing means mounted on said press drum for determining a timing for said bank registering means to feed the leading edge of the sheet toward said registering means.

20. A sheet feeding device as claimed in claim 19, further comprising:

bank sheet feed drive means for driving said bank sheet feeding means; and bank sheet feed drive control means for controlling, in response to a signal output from said bank sheet feed timing sensing means, said bank sheet conveyance drive means for feeding the leading edge of the sheet toward said bank registering means.

21. A sheet feeding device for a printer comprising an ink drum rotatable at a variable speed in accordance with any one of a plurality of print speeds with a master wrapped therearound, pressing means pressed against said ink drum relative to said ink drum with the intermediary of a sheet, registering means for feeding a leading edge of the sheet toward a print position between said ink drum and said pressing means, and a bank sheet feeding section for conveying the sheet toward said registering means, said sheet feeding device comprising:

bank registering means included in said bank sheet feeding section independently of said registering means for feeding the leading edge of the sheet toward said registering means;

bank sheet conveying means for feeding the leading edge of the sheet toward said bank registering means such that said leading edge of said sheet abuts against said bank registering means and forms a loop;

bank sheet conveyance drive means independent of a driveline assigned to said ink drum for driving said bank sheet conveying means; and print speed setting means for setting a print speed such that said ink drum rotates in accordance with a set print speed included in the plurality of print speeds;

said bank sheet conveyance drive means driving, when the set print speed is higher than a standard print speed, said bank sheet conveying means in such a manner as to set up a sheet conveying speed matching with a highest set print speed included in the plurality of print speeds or driving, when said set print speed is lower than said standard print speed, said bank sheet conveying means in such a manner as to set up a sheet conveying speed matching with said standard print speed.

22. A sheet feeding device as claimed in claim 21, further comprising:

bank leading edge sensing means positioned on a transport path between said bank registering means and said bank sheet conveying means for sensing the leading edge of the sheet; and control means for controlling, in response to a signal output from said bank leading edge sensing means, said bank sheet conveyance drive means such that the leading edge of the sheet abuts against said bank registering means and forms a preselected loop.

23. A sheet feeding device as claimed in claim 21, wherein said pressing means comprises a press drum having substantially a same outside diameter as said ink drum and pressed against said ink drum relative to said ink drum during printing.

24. A sheet feeding device as claimed in claim 23, further comprising bank registration timing sensing means mounted on said press drum for determining a timing for said bank registering means to feed the leading edge of the sheet toward said registering means.

25. A sheet feeding device as claimed in claim 24, further comprising:

bank registration drive means for driving said bank registering means; and bank registration drive control means for controlling, in response to a signal output from said bank registration timing sensing means, said bank registration drive means for driving the leading edge of the sheet toward said registering means.

26. A sheet feeding device as claimed in claim 23, further comprising:

bank sheet feeding means for feeding the leading edge of the sheet from a bank tray to said bank registering means; and bank sheet feed timing sensing means mounted on said press drum for determining a timing for said bank registering means to feed the leading edge of the sheet toward said registering means.

27. A sheet feeding device as claimed in claim 26, further comprising:

bank sheet feed drive means for driving said bank sheet feeding means; and bank sheet feed drive control means for controlling, in response to a signal output from said bank sheet feed timing sensing means, said bank sheet conveyance drive means for feeding the leading edge of the sheet toward said bank registering means.

* * * * *

UNITED STATES PATENT AND TRADEMARK OFFICE

CERTIFICATE OF CORRECTION

PATENT NO. : 6,298,778 B1
DATED : October 9, 2001
INVENTOR(S) : Takayuki Onodera et al.

It is certified that error appears in the above-identified patent and that said Letters Patent is hereby corrected as shown below:

Column 1,
Line 31, please delete "in"; and
Line 49, please change "damper" to -- clamper --.

Column 4,
Line 33, please change "damper" to -- clamper --.

Column 5,
Lines 11, 57 and 65, please change "damper" to -- clamper --.

Column 6,
Line 17, please delete "a";
Line 28, please change "damper" to -- clamper --; and
Line 33, please delete first occurrence of "direction".

Column 8,
Line 32, please change "nitrite" to -- nitrile --.

Column 10,
Line 14, please change "under lying" to -- underlying --.

Column 11,
Line 11, please change "2." to -- 2, --.

Column 16,
Line 55, please change "be low" to -- below --.

Column 17,
Paragraph beginning at line 28, connect with previous paragraph after "201.".

Column 21,
Line 6, please change "i s" to -- is --.

UNITED STATES PATENT AND TRADEMARK OFFICE

CERTIFICATE OF CORRECTION

PATENT NO. : 6,298,778 B1
DATED : October 9, 2001
INVENTOR(S) : Takayuki Onodera et al.

It is certified that error appears in the above-identified patent and that said Letters Patent is hereby corrected as shown below:

Column 25,
Lines 41-42, delete and insert the following -- the upper sheet feeding section via the input port and receive therefrom ON/OFF signals relating to the upper and lower limit positions of the upper tray 143. Likewise, the controller 148 is electrically connected to the upper limit sensor 139 and lower limit sensor 140 associated with the lower sheet feeding section via the input port and receive therefrom ON/OFF signals relating to the upper and lower limit positions of the lower tray 145. With the signals received from the sensors 139 and 140, the controller 148 controls the lower up-down motor 142.

The controller 148 is electrically connected to the bank sheet feed motor 107 via the output port. Assume that the sheet P is fed from the upper sheet feeding section 201, and that the print speed input on the DOWN key 96a or the UP key 96b is higher than the standard speed (fourth or fifth speed). Then, in response to a signal representative of the input print speed and transferred from the printer sheet feed controller 88, the controller 148 drives the bank sheet feed motor 107 in the forward direction such that the separation roller 32 and pickup roller 30 of the sheet feeding means 29-1 convey the sheet P at a speed matching with the input print speed. Assume that the input print speed or the automatically set print speed is lower than the standard speed (third, second or first speed or trial print speed). Then, in response to a signal representative of the above speed and transferred from the printer sheet feed controller 88, the controller 148 drives the motor 107 in the forward direction such that the above separation roller 32 and pick roller 30 convey the sheet P at a speed matching with the third or standard speed. --

Column 26,
Delete lines 5-38, and insert the following -- Then, in response to the output of the registration sensor 135, the controller 148 drives the motor 107 in the reverse direction. The motor 107 causes the leading edge of the sheet P fed by the intermediate rollers 118a and 118b to abut against the registration rollers 106a and 106b and form a preselected loop. --

Column 27,
Line 53, please change "Da." to -- Da , --.

Column 28,
Line 14, please change "of" to -- off --.

UNITED STATES PATENT AND TRADEMARK OFFICE

CERTIFICATE OF CORRECTION

PATENT NO. : 6,298,778 B1
DATED : October 9, 2001
INVENTOR(S) : Takayuki Onodera et al.

It is certified that error appears in the above-identified patent and that said Letters Patent is hereby corrected as shown below:

Column 33,
Line 1, please insert -- is -- between "printing" and "acceptable";
Line 19, please change "lading" to -- leading --; and
Line 28, please delete first occurrence of ")".

Figures 30, 30A:
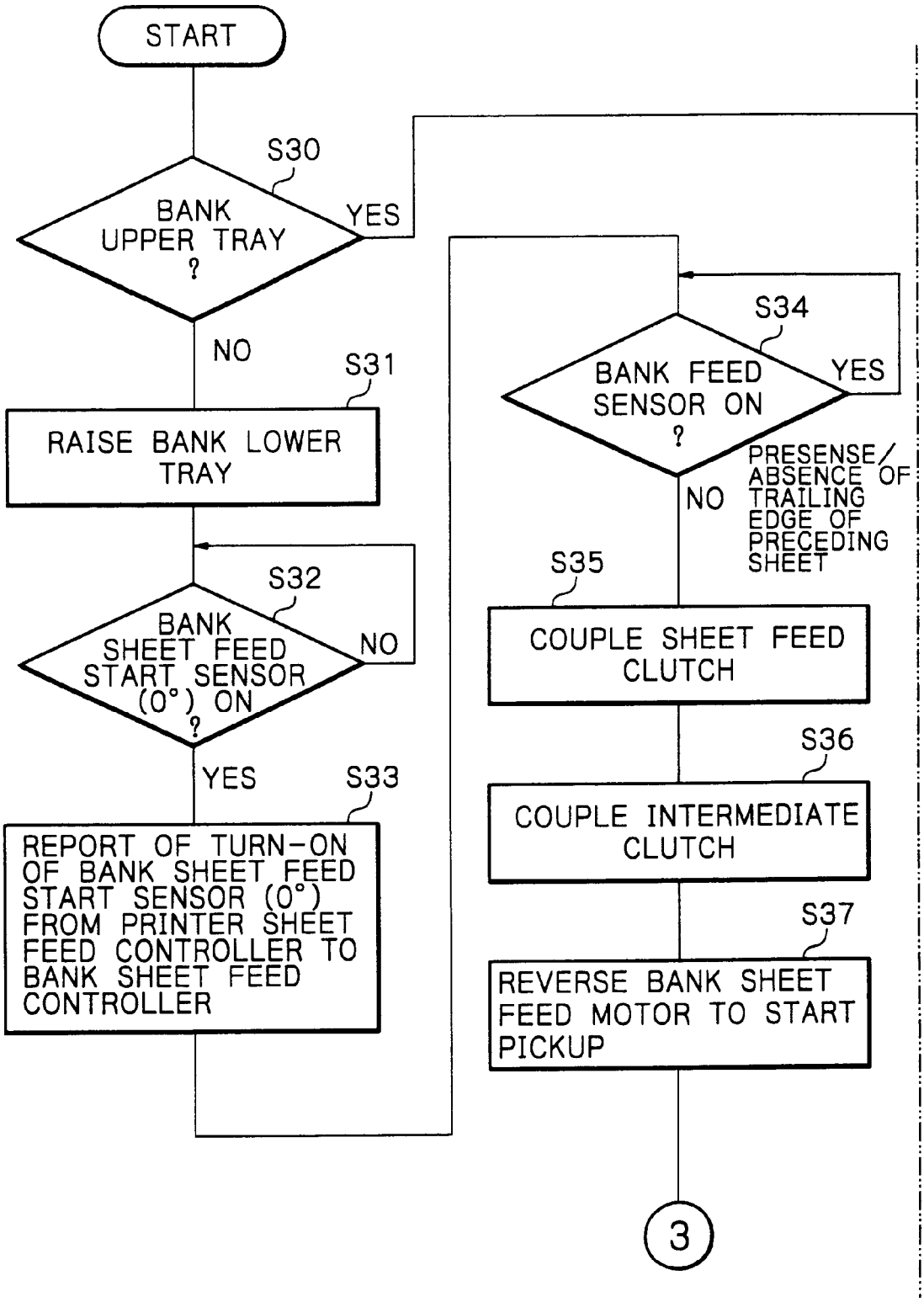
FIGS. 30 and 31 are flowcharts representative of the feed of a sheet in the bank sheet feeding section in accordance with the first embodiment.
Figure 30B:
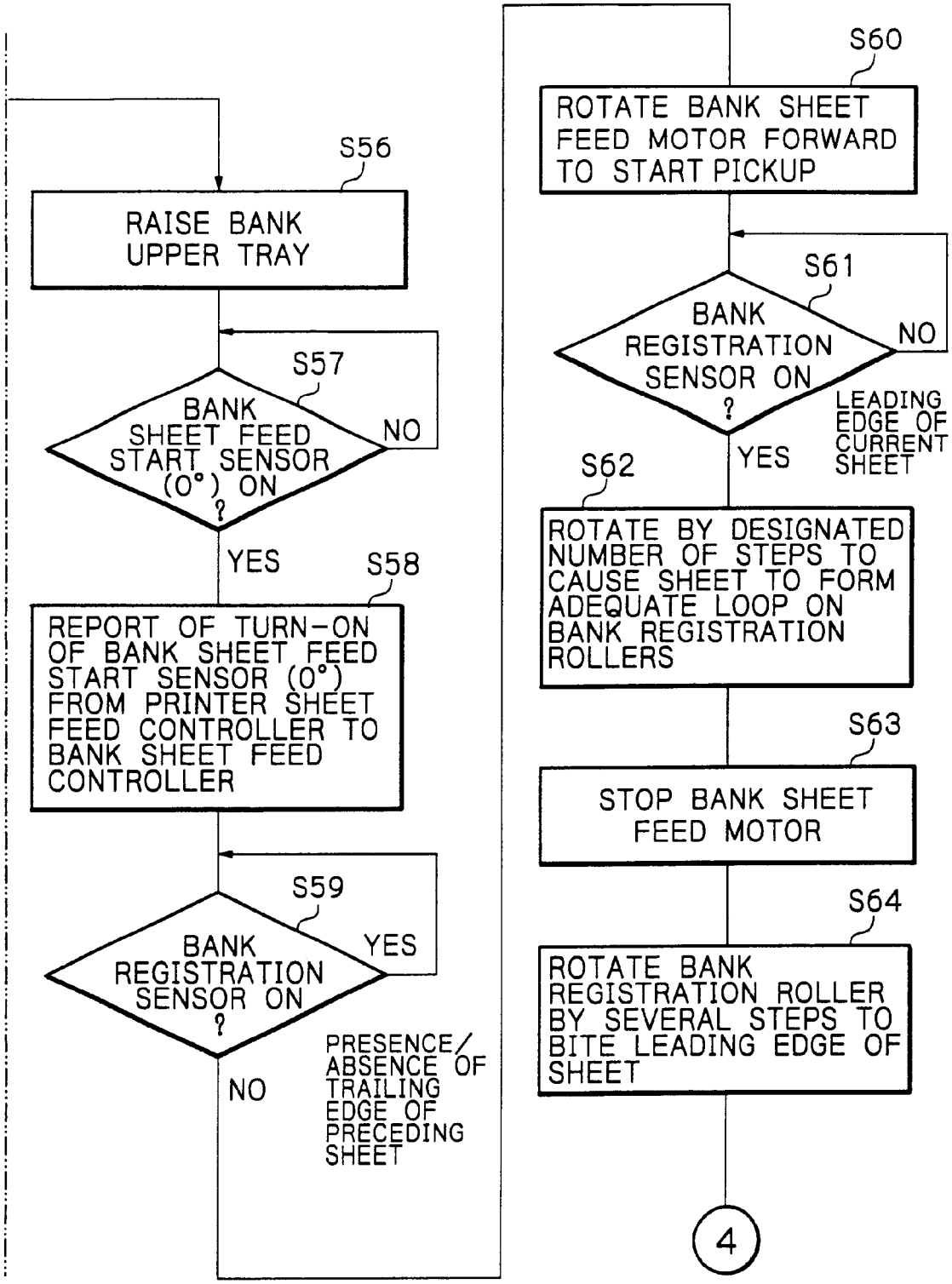

Column 34,
Delete lines 35-38, and insert the following -- routine beings with a step S30 of FIG. 30. The following description will concentrate on the third, second or first print speed or the trial print speed lower than the standard speed and set by the operator on the key 96 or automatically set. The main motor 150 drives the ink drum 1 and press drum 20 at a speed matching with the above set print speed.

First, the tray 143 of the upper sheet feeding section 201 or the tray 145 of the lower sheet feeding section 202 and a paper size thereof are selected and set on the sheet size key 98 and set key 95 or automatically set. Whether or not the tray 143 of the upper sheet feeding means 201 is selected is determined (step S30). If the answer of the step S30 is NO, the lower up-down motor 142 causes the tray 145 to rise until the top of the sheet stack P on the tray 145 reaches the sheet feed position, as determined by the lower limit sensor 139 (step S31). In this condition, the lower sheet feeding section 202 is ready to feed the sheet P thereof. It is to be noted that when the tray 145 of the lower sheet feeding section 202 and the sheet size thereof are selected and set either manually or automatically, the sheet size of the tray 145 is sensed by the sensor group 50-2 beforehand. This step, however, will not be described specifically in order to avoid redundancy.

Whether or not the press drum 20 is located at its home position is determined (step S32). Specifically, when the press drum 20 reaches the angular position θ' of 0°, the interruptor 70 interrupts the optical path of the bank sheet feed start sensor 66 (YES, step S32). The resulting ON signal output from the sensor 66 is sent to the printer sheet feed controller 88. In response, the controller 88 informs the bank sheet feed controller 148 of the turn-on of the sensor 66 by serial communication (step S33). --

Column 34, line 63 through Column 35, line 33,
Delete and insert the following -- the vertical transport path RZ. At the same time, the sheet feeding means 29-2 starts picking up the top sheet S. More specifically, the drive mechanism 125B operates as described with reference to FIG. 16 with the result that the separation roller 32 and pickup roller 30 of the sheet feeding means 29-2 are rotated clockwise in FIG. 16 (counterclockwise in FIG. 15). As a result, only the top sheet P is paid out from the tray 145 in the direction X1 (step S37). --

UNITED STATES PATENT AND TRADEMARK OFFICE

CERTIFICATE OF CORRECTION

PATENT NO. : 6,298,778 B1
DATED : October 9, 2001
INVENTOR(S) : Takayuki Onodera et al.

It is certified that error appears in the above-identified patent and that said Letters Patent is hereby corrected as shown below:

Column 40,
Line 65, please change "3a" to -- 33a --.

Column 41,
Line 28, please change "form" to -- from --; and
Line 41, please change "he" to -- the --.

Column 45,
Line 18, please change "placed" to -- place --.

Column 47,
Line 59, please change "form" to -- from --.

Column 49,
Line 35, please change "photointrrupter" to -- photointerrupter --.

Signed and Sealed this

Twenty-ninth Day of October, 2002

*Attest:*

*Attesting Officer*

JAMES E. ROGAN
*Director of the United States Patent and Trademark Office*